US007012580B2

(12) United States Patent
Mizobata

(10) Patent No.: US 7,012,580 B2
(45) Date of Patent: Mar. 14, 2006

(54) DRIVING METHOD FOR AC-TYPE PLASMA DISPLAY PANEL AND PLASMA DISPLAY DEVICE

(75) Inventor: Eishi Mizobata, Tokyo (JP)

(73) Assignee: Pioneer Corporation, Tokyo (JP)

( * ) Notice: Subject to any disclaimer, the term of this patent is extended or adjusted under 35 U.S.C. 154(b) by 129 days.

(21) Appl. No.: 10/738,090

(22) Filed: Dec. 18, 2003

(65) Prior Publication Data

US 2004/0130508 A1 Jul. 8, 2004

(30) Foreign Application Priority Data

Dec. 18, 2002 (JP) ..... 2002-366675

(51) Int. Cl.
*G09G 3/28* (2006.01)

(52) U.S. Cl. ..... 345/60; 345/62; 345/66; 345/67; 345/68

(58) Field of Classification Search ..... 345/60–69, 345/71–82; 315/169.1–169.4
See application file for complete search history.

(56) References Cited

U.S. PATENT DOCUMENTS

| | | | | |
|---|---|---|---|---|
| 6,023,258 | A * | 2/2000 | Kuriyama et al. | 345/60 |
| 6,097,358 | A * | 8/2000 | Hirakawa et al. | 345/63 |
| 6,175,194 | B1 * | 1/2001 | Saegusa et al. | 315/169.4 |
| 6,456,263 | B1 * | 9/2002 | Hashimoto et al. | 345/60 |
| 6,707,436 | B1 * | 3/2004 | Setoguchi et al. | 345/60 |

FOREIGN PATENT DOCUMENTS

| | | |
|---|---|---|
| JP | 10-105111 | 4/1998 |
| JP | 11-24626 | 1/1999 |
| JP | 11-327505 | 11/1999 |
| JP | 2000-206933 | 7/2000 |
| JP | 2000-214822 | 8/2000 |
| JP | 2000-231361 | 8/2000 |
| JP | 2001-134232 | 5/2001 |
| JP | 2001-184021 | 7/2001 |
| JP | 2001-184023 | 7/2001 |
| JP | 2001-228820 | 8/2001 |
| JP | 2001-272946 | 10/2001 |
| JP | 2001-296834 | 10/2001 |
| JP | 2001-350445 | 12/2001 |
| JP | 2002-132207 | 5/2002 |
| JP | 2002-229508 | 8/2002 |
| JP | 2002-351383 | 12/2002 |

* cited by examiner

*Primary Examiner*—Vijay Shankar
(74) *Attorney, Agent, or Firm*—Drinker Biddle & Reath LLP

(57) ABSTRACT

A method for driving a plasma display device is provided which is capable of causing writing discharge to normally occur. A sub-field includes an initializing period, a scanning period during which video data to display a video is written in a discharge cell by causing writing discharge to occur between a scanning electrode and a data electrode, and a sustaining period during which sustaining discharge to cause the discharge cell in which a writing discharge has occurred to emit light in a manner to correspond to video data is made to occur between the scanning electrode and a sustaining electrode. The initializing period includes a wall charge adjusting period during which wall charge adjusting discharge to adjust charges accumulated between the scanning electrode and the sustaining electrode is made to occur, a sustaining erasing period, a priming period, and a priming erasing period.

68 Claims, 20 Drawing Sheets

DRIVING METHOD FOR AC-TYPE PLASMA DISPLAY PANEL AND PLASMA DISPLAY DEVICE

BACKGROUND OF THE INVENTION

1. Field of the Invention

The present invention relates to a method for driving an AC-type plasma display panel and a plasma display device.

The present application claims priority of Japanese Patent Application No. 2002-366675 filed on Dec. 18, 2002, which is hereby incorporated by reference.

2. Description of the Related Art

Generally, a plasma display panel (hereinafter simply called a PDP) has many features that it is capable of being made thin, a large-screen display, providing a wide viewing angle, and giving a fast response (see Patent References 1 to 15 as be described later).

Therefore, in recent years, a PDP is used as a flat display device for a wall-hung television set, a public display board, or a like. A plasma display device using a PDP is classified, depending on its driving method, into two, one being a Direct Current discharge type of plasma display device (hereinafter referred to as DC-type plasma display device) and another being an Alternating Current discharge type of plasma display device (hereinafter referred to as AC-type plasma display device). In the DC-type plasma display device, electrodes are exposed in discharge space (discharge gas) and drive a PDP in a state where DC discharge occurs. In the AC-type plasma display device, an electrode is covered with a dielectric layer, not disposed directly in discharge gas and drives a PDP in a state where AC discharge occurs. In the DC-type plasma display device, discharge occurs in all periods during which a voltage is being applied to an electrode. In the AC-type plasma display device, discharge is sustained by reversing a polarity of a voltage to be applied to an electrode. Moreover, the AC-type plasma display device can be classified into two, one in which the number of electrodes formed in a cell is two and another in which the number of electrodes formed in a cell is three.

Now, a plasma display device using a three-electrode AC-type PDP as a plasma display device being applied to a conventional method for driving the conventional PDP is described.

FIG. 17 is a diagram showing schematically configurations of a conventional plasma display device (plan view of a conventional three-electrode AC-type PDP) . The conventional plasma display device, as shown in FIG. 17, includes a display screen 130, m-pieces of scanning electrodes 122 (scanning electrodes 122-1 to 122-m, where "m" is a positive integer greater than one), m-pieces of sustaining electrodes 123 (sustaining electrodes 123-1 to 123-m), n-pieces of data electrodes 129 (data electrodes 129-1 to 129-n, where "n" is a positive integer greater than one), and (m×n) pieces of display cells 131. The (m×n) pieces of the display cells 131 are arranged in m-rows and n-columns. In each of n-pieces of display cells belonging to one row out of m-rows, the scanning electrode 122-i (i=1, 2, . . . , m) and the sustaining electrode 123-i (i=1, 2, . . . , m) are formed in parallel to each other. In each of m-pieces of the display cells 131 belonging to one column out of n-columns, the data electrode 129-j (j=1, 2, . . . , n) is formed in a manner so as to be orthogonal to both the scanning electrode 122-i and the sustaining electrode 123-i. Between the scanning electrode 122-i and the sustaining electrode 123-i is provided a discharge gap 134 with a first interval between them.

Between the scanning electrode 122-i and the sustaining electrode 123-(i−1) and between the scanning electrode 122-(i+1) and the sustaining electrode 123-i, a non-discharge gap 135 is provided with a second interval between them.

To the conventional plasma display device is connected a driving control circuit 138 as shown in FIG. 17. The driving control circuit 138 includes a driving section 136 and a controlling section 137. The driving section 136 has a scanning driver (not shown), a sustaining driver (not shown), and a data driver (not shown). The scanning driver is connected to the scanning electrodes 122-1 to 122-m, the sustaining driver is connected to the sustaining electrodes 123-1 to 123-m, and the data driver is connected to the data electrodes 129-1 to 129-n. One terminal of the controlling section 137 is connected to a ground and another terminal of the controlling section 137 is connected to the driving section 136. The controlling section 137 drives the driving section 136 so that a potential described later is applied through the scanning driver, sustaining driver, data driver to the scanning electrodes 122-1 to 122-m, sustaining electrodes 123-1 to 123-m, and data electrodes 129-1 to 129-n. Here, a difference in an electric potential between two electrodes, between an electrode and the driving control circuit 138 or a like, as known well, is called a "voltage" or a "potential difference".

FIG. 18 is a cross-sectional view of one of display cells making up the conventional thee-electrode AC-type PDP as shown in FIG. 17. The conventional thee-electrode AC-type PDP, as shown in FIG. 18, further includes an upper insulating substrate (front substrate) 120, a lower insulating substrate (rear substrate) 121, a transparent dielectric layer 124, a protecting layer 125, a phosphor layer 127, a white dielectric layer 128, and metal trace electrodes 132. The front substrate 120 and the rear substrate 121 face each other. The front substrate 120 and the rear substrate 121 are made up of, for example, a glass substrate.

Between the front substrate 120 and the rear substrate 121, that is, on the front substrate 120, the scanning electrode 122-i and the sustaining electrode 123-i are mounted, with the first interval between them and in parallel to each other. The first interval is the discharge gap 134. Among the scanning electrode 122-i, the sustaining electrode 123-i, and the rear substrate 121, that is, on the scanning electrode 122-i and sustaining electrode 123-i, the metal trace electrodes 132 used to reduce wiring resistance are formed. Among the front substrate 120, the scanning electrode 122-i, the sustaining electrode 123-i, metal trace electrode 132, that is, on the front substrate 120, the scanning electrode 122-i, the sustaining electrode 123-i, and the metal trace electrode 132, the transparent dielectric layer 124 is formed. Between the transparent dielectric layer 124 and the rear substrate 121, that is, on the transparent dielectric layer 124, the protecting layer 125 used to protect the transparent dielectric layer 124 from damages caused by discharge is formed. The protecting layer 125 is made of, for example, MgO (Magnesium Oxide).

Between the protecting layer 125 and the rear substrate 121, that is, on the rear substrate 121, a data electrode 129-j is formed in a manner so as to be orthogonal to both the scanning electrode 122-i and the sustaining electrode 123-i. Between the protecting layer 125 and the data electrode 129-j, that is, on the data electrode 129-j, the white dielectric layer 128 is formed. Between the protecting layer 125 and the white dielectric layer 128, a first phosphor layer 127-1 and a second phosphor layer 127-2 are formed as the phosphor layer 127. That is, on the white phosphor layer 128 is formed the first phosphor layer 127-1. On the first phosphor layer 127-1, the second phosphor layer 127-2 extending from both sides of the first phosphor layer 127-1 to the protecting layer 125 in a vertically upward direction of the first phosphor layer 127-1 so that a discharge space 126 is formed. Between the front substrate 120 and the rear substrate 121, a non-discharge space 133 is formed in a manner that each display cell 131 is surrounded by end portions of the second phosphor layer 127-2 and first phosphor layer 127-1, the protecting layer 125, and the white dielectric layer 128. The second phosphor layer 127-2 serves as a rib (partition wall). The rib (second phosphor layer 127-2) plays a roll in securing the discharge space 126 and in partitioning a pixel (display cell 131). The discharge space 126 is filled with a discharging gas, such as a mixed gas of He (helium), Ne (neon), Xe (xenon).

Next, the method for driving the conventional plasma display device (conventional PDP) is described. A method for driving the plasma display device being presently in the mainstream is a scanning and sustaining separating method, that is, a method called an "ADS" (Address and Display Separation) method in which a scanning period is separated from a sustaining period. Hereinafter, the ADS method is explained. FIG. 19 is a timing chart showing waveforms of voltages applied for driving the conventional plasma display device.

As shown in FIG. 19, one sub-field 105 (hereafter simply referred to as a "sub-field" 105) includes an initializing period 102, a scanning period 103, and a sustaining period 104. The initializing period 102 is a period during which wall charges having been accumulated between the scanning electrode 122-i and the sustaining electrode 123-i when sustaining discharge occurred during the sustaining period are erased (initialized or reset), to which timing P106, P107, P108, P109, P110, P111, P112, and P113 following timing P101 corresponds. The scanning period 103 is a period during which video data to display a video is written in an address (display cell 131) by causing writing discharge to occur between the scanning electrode 122-i and data electrode 129-j, to which the timing P113, P114, P115, P116, . . . , P117, P118, and P119 corresponds.

The sustaining period 104 is a period during which sustaining discharge to cause the display cell 131 for which writing discharge was made to occur to emit light in a manner to correspond to video data is made to occur between the scanning electrode 122-i and the sustaining electrode 123-i, to which timing P119 and P120 corresponds.

The initializing period 102 includes a sustaining erasing period 108, a priming period 109, and a priming erasing period 110. The sustaining erasing period 108 is a period during which wall charges having been accumulated between the scanning electrode 122-i and the sustaining electrode 123-i when sustaining discharge occurred during the sustaining period 104 are erased (initialized or reset), to which the timing P106, P107, P108 and P109 corresponds. The priming period 109 is a period during which priming effect is made to be produced, to which the timing P109, P110 and P111 corresponds. The priming erasing period 110 is a period during which wall charges having been accumulated on the dielectric layer in each of the display cells 131 as a result of the priming effect are erased, to which the timing P111, P112 and P113 corresponds.

Driving waveforms applied during the sustaining period in a pre-subfield 101 existing before the sub-field 105 are described. A sustaining voltage Vs and a ground voltage GND being lower than the sustaining voltage Vs are alternately applied as a sustaining pulse to the sustaining electrode 123-1 to 123-m and a ground voltage GND and the sustaining voltage Vs are alternately applied to the scanning electrodes 122-1 to 122-m by the driving control circuit 138. By the driving control circuit 138, a ground voltage GND is applied to the data electrodes 129-1 to 129-n. At the timing P101 immediately before the initializing period 102, by the driving control circuit 138, a ground voltage GND is applied to the scanning electrodes 122-1 to 122-m and a sustaining voltage Vs is applied by the driving control circuit 138 to the sustaining electrodes 123-1 to 123-m.

Driving waveforms (ramp waveforms of voltages to be applied to electrodes during the sustaining erasing period 108) applied during the sustaining erasing period 108 in the initializing period 102 are described. For a period from the timing P106 to the timing P107, the sustaining voltage Vs having been applied to the scanning electrodes 122-1 to 122-m is held by the driving control circuit 138. During a period from the timing P107 to the timing P108, a voltage to be applied to the scanning electrodes 122-1 to 122-m is lowered gradually from the sustaining voltage Vs to a ground voltage GND by the driving control circuit 138. For a period from the timing P108 to the timing P109, the ground voltage GND having been applied to the scanning electrodes 122-1 to 122-m is held by the driving control circuit 138. At the timing P106, a sustaining voltage Vs is applied to the sustaining electrodes 123-1 to 123-m by the driving control circuit 138. For a period from the timing P106 to the timing P109, the sustaining voltage Vs having been applied to the sustaining electrodes 123-1 to 123-m is held by the driving control circuit 138. The sustaining voltage Vs is about 170 V. For a period from the timing P106 to the timing P109, the ground voltage GND having been applied to the data electrodes 129-1 to 129-n is held by the driving control circuit 138.

Driving waveforms (priming waveforms being ramp waveforms of voltages to be applied to electrodes during the priming period 109) applied during the priming period 109 in the initializing period 102 are described. At the timing P109, a sustaining voltage VS is applied to the scanning electrodes 122-1 to 122-m by the driving control circuit 138. Next, during a period from the timing P109 to the timing P110, the sustaining voltage Vs having been applied to the scanning electrodes 122-1 to 122-m is gradually boosted to a priming voltage Vp by the driving control circuit 138. The priming voltage Vp is higher than the sustaining voltage Vs and its crest value is about 380 V to 450 V. Next, for a period from the timing P110 to the timing P111, the priming voltage Vp having been applied to the scanning electrodes 122-1 to 122-m is held by the driving control circuit 138. During a period from the timing P109 to the timing P111, a ground voltage GND is applied to the sustaining electrodes 123-1 to 123-m by the driving control circuit 138. For a period from the timing 109 to the timing P111, the ground voltage GND having been applied to the data electrodes 129-1 to 129-n is held by the driving control circuit 138.

Driving waveforms (ramp waveforms being waveforms of voltages to be applied to electrodes during the priming erasing period 110) applied during the priming erasing period 110 in the initializing period 102 are described. At the timing P111, a voltage to be applied to the scanning electrodes 122-1 to 122-m is lowered from the priming voltage Vp to the sustaining voltage Vs by the driving control circuit 138. Next, during a period from the timing P111 to the timing P112, a voltage to be applied to the scanning electrodes 122-1 to 122-m is lowered from the sustaining voltage Vs to a ground voltage GND by the driving control circuit 138. Then, for a period from the timing P112 to the timing P113, the ground voltage GND having been applied to the scanning electrodes 122-1 to 122-m is held by the driving control circuit 138. At the timing P111, a sustaining voltage Vs is applied to the sustaining electrodes 123-1 to 123-m by the driving control circuit 138. Next, for a period from the timing P111 to the timing P113, the sustaining voltage Vs having been applied to the sustaining electrodes 123-1 to 123-m is held by the driving control circuit 138. During a period from the timing P111 to the timing P113, a ground voltage GND is applied to the data electrodes 129-1 to 129-n by the driving control circuit 138.

Driving waveforms applied during the scanning period 103 are described. For a period from the timing P113 to the timing P119, the sustaining voltage Vs having been applied to the sustaining electrodes 123-1 to 123-m is held by the driving control circuit 138. At the timing P113, a scanning base voltage Vbw is applied to the scanning electrodes 122-1 to 122-m by the driving control circuit 138. Next, for a period from the timing P113 to the timing P119, the scanning base voltage Vbw having been applied to the scanning electrodes 122-1 to 122-m is held by the driving control circuit 138. A lowest value of the scanning base voltage Vbw is a ground voltage GND being a reference voltage and its peak value is set to be lower than the sustaining voltage Vs, which is about 80 to 110 V. Next, while the scanning base voltage Vbw is being applied to the scanning electrodes 122-1 to 122-m, a scanning pulse potential 111 to counter the scanning base voltage Vbw is applied to the scanning electrodes 122-1 to 122-m by the driving control circuit 138 sequentially at the timing P114, P115, P116, . . . , and P117. The scanning pulse potential 111 is a pulse having a negative polarity which lowers from a set value being a highest value of the scanning base voltage Vbw to a ground voltage GND being a lowest value of the scanning base voltage Vbw. That is, when the scanning pulse potential 111 is applied to the scanning electrodes 122-1 during a period from the timing 114 to the timing P115 and to the scanning electrodes 122-2 during a period from the timing P115 to the timing P116, and to the scanning electrode 122-m during a period from the timing P117 to the timing P118, the scanning base voltage Vbw is not applied to the scanning electrodes 122-1 during a period from the timing P114 to the timing P115 and is not applied to the scanning electrode 122-2 during a period from the timing P115 to the timing P116 and is not applied to the scanning electrode 122-m during a period from the timing P117 to the timing P118. When the scanning pulse potential 111 is applied to the scanning electrodes 122-1 to 122-m, a data pulse potential 112 corresponding to video data (display pattern) is applied to the data electrodes 129-1 to 129-n by the driving control circuit 138.

Driving waveforms applied during the sustaining period are described. A sustaining voltage Vs is applied, as a primary sustaining pulse potential serving as a sustaining pulse potential, to the scanning electrodes 122-1 to 122-m by the driving control circuit 138 and a ground voltage GND is applied, as the primary sustaining pulse potential serving as the sustaining pulse potential to the sustaining electrodes 123-1 to 123-m by the driving control circuit 138. Thereafter, until the timing P120, the sustaining voltage Vs and ground voltage GND are alternately applied as the sustaining pulse potential to the scanning electrodes 122-1 to 122-m by the driving control circuit 138 and the ground voltage GND and sustaining voltage Vs are alternately applied as the sustaining voltage to the sustaining electrodes 123-1 to 123-m. During a period from the timing P119 to the timing P120, a ground voltage GND is applied to the data electrodes 129-1 to 129-n by the driving control circuit 138.

Next, roles of each of the periods for driving the conventional plasma display device are described.

First, roles of the initializing period 102 are explained. Before the initializing period, the sustaining period in the pre-subfield 101 exists. Depending on whether or not sustaining discharge occurs in the pre-subfield 101, an amount of formation of wall charges that are accumulated on the dielectric layers (transparent dielectric layer 124 formed on the scanning electrode 122-i, transparent dielectric layer 124 formed on the sustaining electrode 123-i, and the white dielectric layer 128 formed on the data electrode 129-j) formed on each of the electrodes in the display cell 131, by discharge, varies. If subsequent writing discharge is made to occur despite the above state, due to influences exerted by different amounts of formation of the wall charges, it is difficult to make writing discharge occur correctly and/or writing discharge is caused to erroneously occur with timing with which writing discharge should not occur. During the sustaining period, discharge intensity is great. Because of this, if sustaining discharge occurs, a large amount of space charges are generated in the discharge space 126. The space charges are attracted by an electric field in the display cell 131 and are accumulated on the dielectric layer on each of the electrodes. Since the amount of the space charges is large, wall charges are accumulated on each of the electrodes in the display cell 131 so that the electric field in the display cell 131 becomes zero. At this point, wall charges accumulated on each of the electrodes, at the timing P101, is put into such a state (arrangement of charges) as shown in FIG. 20A, and positive wall charges (+e) are accumulated on all the sustaining electrode 123-i and data electrode 129-i and negative wall charges (−e) are accumulated on all the scanning electrode 122-i. By the formation of the above wall charges, wall voltages (voltages produced by the wall charges between the electrode and dielectric layer) being almost equal to the sustaining voltage Vs are formed between the scanning electrode 122-i and sustaining electrode 123-i (that is, in the discharge gap 134).

Roles of the initializing period 102 are:

(1) to erase (initialize or reset) wall charges accumulated on the dielectric layer in each of the display cells 131 in a light emitting state during the sustaining period in the pre-subfield 101, and (2) to cause priming effects to occur in order to achieve easy occurrence of writing discharge when video data is written in a pixel (display cell 131) during the scanning period 103. In the first role above, by erasing (initializing or resetting) wall charges, a pixel (display cell 131) is forcedly discharged. During the initializing period 102, the above first role (1) is performed during the sustaining erasing period 108 and the above second role (2) is performed during the priming period 109 and the priming erasing period 110. During the sustaining erasing 108, discharge occurs only when sustaining discharge had occurred in the pre-subfield 101. During the priming period 109 and priming erasing period 110, discharge occurs irrespective of whether or not sustaining discharge had occurred in the pre-subfield 101.

Next, roles of the sustaining erasing period 108, priming period 109, and priming erasing period 110 are described. When the period is shifted from its sustaining period in the pre-subfield 101 to its sustaining erasing period 108, a difference in potential in the discharge space 126 between the scanning electrode 122-i and sustaining electrode 123-i gradually increases and weak discharge called "feeble discharge" occurs in a sustained manner. Discharge intensity of the feeble discharge is low. Due to this, feeble discharge occurs only in the vicinity of the discharge gap 134. At this point, wall charges accumulated in a portion being in the vicinity of the discharge gap 134 on the scanning electrode 122-i and on the sustaining electrode 123-i decrease and wall charges accumulated on each electrode are put into such a state (arrangements of wall charges) as shown in FIG. 20B. That is, negative wall charges (−e) in the portion being in the vicinity of the discharge gap 134 on the scanning electrode 122-i and positive wall charges (+e) in the portion being in the vicinity of the discharge gap 134 on the sustaining electrode 123-i decrease and negative wall charges (−e) are accumulated in the portion being in the vicinity of the discharge gap 134 on the sustaining electrode 123-i.

When the period is shifted from its sustaining erasing period 108 to its priming period 109, in addition to the feeble discharge occurring between the scanning electrode 122-i and sustaining electrode 123-i, feeble discharge also occurs between the scanning electrode 122-i and data electrode 129-i. At this time, wall charges are accumulated by the feeble discharge in the portion being in the vicinity of the discharge gap 134 on the scanning electrode 122-i, sustaining electrode 123-i, and data electrode 129-j and wall charges accumulated on each electrode is put into such a state (arrangements of wall charges) as shown in FIG. 20C. That is, negative wall charges (−e) are further accumulated in the portion being in the vicinity of the discharge gap 134 on the scanning electrode 122-i and positive wall charges (+e) are further accumulated in the portion being in the vicinity of the discharge gap 134 on the sustaining electrode 123-i and positive charges (+e) are further accumulated in the portion being in the vicinity of the discharge gap 134 on the data electrode 129-j and on a surface facing the scanning electrode 122-i.

When the period is shifted from its priming period 109 to its priming erasing period 110, feeble discharge occurs in the vicinity of the discharge gap 134. At this time, during the priming period 109, wall charges accumulated in the portion being in the vicinity of the discharge gap 134 on the scanning electrode 122-i, sustaining electrode 123-i, and data electrode 129-j decrease and wall charges accumulated on each electrode is, at timing of the P112, put into such a state (arrangements of wall charges) as shown in FIG. 2D. That is, negative wall charges (−e) accumulated in the portion being in the vicinity of the discharge gap 134 on the scanning electrode 122-i, positive wall charges (+e) accumulated in the portion being in the vicinity of the discharge gap 134 on the sustaining electrode 123-i, and positive wall charges (+e) accumulated in the portion being in the vicinity of the discharge gap 134 on the data electrode 129-j decrease and negative wall charges (−e) are accumulated in the portion being in the vicinity of the discharge gap 134 on the sustaining electrode 123-i.

Next, roles of the scanning period are described. The driving control circuit 138, during the scanning period 103, in order to write video data in an address (display cell 131) by causing writing discharge to occur between the scanning electrode 122-i and data electrode 129-j, when applying a scanning pulse potential 111 sequentially to the scanning electrodes 122-1 to 122-m, applies a data pulse potential 112 corresponding to the video data (display pattern) to the data electrodes 129-1 to 129-n. At this time, wall charges accumulated on each electrode is put into such a state (arrangements of wall charges) as shown in FIG. 2E. That is, negative wall charges (−e) accumulated on the scanning electrode 122-i, positive wall charges (+e) accumulated on the sustaining electrode 123-i, and positive wall charges (+e) accumulated on the data electrode 129-j decrease and positive wall charges (+e) are accumulated on all portions on the scanning electrode 122-i and negative wall charges (−e) are accumulated on all portions on the sustaining electrode 123-i.

In a pixel (here, display cell 131) in which the data pulse potential 112 has been applied to the data electrodes 129-1 to 129-n, wall voltages are superimposed on voltages existing in the discharge space 126 between the scanning electrode 122-i and data electrode 129-j and, as a result, a voltage exceeding a discharge initiating voltage is applied between the scanning electrode 122-i and data electrode 129-j. Due to this, writing discharge occurs between the scanning electrode 122-i and data electrode 129-j. A difference in potential between the scanning electrode 122-i and sustaining electrode 123-i appearing when the writing discharge occurs is "Vs". When such the potential difference occurs, if writing discharge occurs between the scanning electrode 122-i and data electrode 129-j, surface discharge is induced between the scanning electrode 122-i and sustaining electrode 123-i. At this time, negative wall charges (−e) are accumulated on the sustaining electrode 123-i, positive wall charges (+e) are accumulated on the scanning electrode 122-i, and a state in which wall charges are accumulated on each electrode in a manner as shown in FIG. 20D is changed, at the timing P119, to be such a state (arrangements of wall charges) as shown in FIG. 20E. On the other hand, in a pixel (here, display cell 131) in which a data pulse potential 112 is not applied to the data electrodes 129-1 to 129-n, since a discharge initiating voltage is not exceeded, no writing discharge occurs and wall charges still remains in such a state as shown in FIG. 20D. Thus, depending on absence or presence of the data pulse potential 112 being applied to the data electrodes 129-1 to 129-n, two kinds of states of wall charges can be brought about.

Next, roles of the sustaining period 104 are described. When application of the scanning pulse potential 111 to all lines of the electrodes (scanning electrodes 122-1 to 122-m) has been completed, since the driving control circuit 138 makes sustaining discharge occur that causes the display cell 131 in which writing discharge occurred to emit light in a manner to correspond to video data between the scanning electrode 122-i and sustaining electrode 123-i, the period is shifted from its scanning period 103 to its sustaining period 104. A sustaining voltage Vs is applied, as a sustaining pulse potential, alternately to the scanning electrodes 122-1 to 122-m and sustaining electrodes 123-1 to 123-m. The sustaining voltage Vs (sustaining pulse potential), in a pixel (display cell 131) in which no writing discharge occurs, is set to be a voltage at which discharge (surface discharge) between the scanning electrode 122-i and sustaining electrode 123-i is not initiated.

In a pixel (display cell 131) in which writing discharge occurred, positive wall charges (+e) are accumulated on the scanning electrode 122-i and negative wall charges (−e) are accumulated on the sustaining electrode 123-i. Due to this, these positive and negative wall voltages are superimposed on a first sustaining pulse potential (being called a "first sustaining pulse potential") to be applied to the scanning electrode 122-i. At this time, a voltage exceeding a discharge initiating voltages is applied to the discharge space 126, causing sustaining discharge to occur. By this sustaining discharge, negative wall charges are accumulated on the scanning electrode 122-i and positive wall charges are accumulated on the sustaining electrode 123-i. The wall voltages are superimposed on a subsequent sustaining pulse potential (being called a "second sustaining pulse potential") to be applied to the sustaining electrode 123-i. At this time, a voltage exceeding the discharge initiating voltage is applied to the discharge space 126, causing sustaining discharge to occur. By this sustaining discharge, a wall charge of a polarity opposite to the first sustaining pulse potential is accumulated on the scanning electrode 122-i and sustaining electrode 123-i. That is, positive wall charges are accumulated on the scanning electrode 122-i and negative wall charges are accumulated on the sustaining electrode 123-i. Since a sustaining voltage Vs (sustaining pulse potential) continues to be applied alternately to the scanning electrode 122-1 to 122-m and sustaining electrode 123-1 to 123-m for a period until the sustaining period 104 terminates, the sustaining discharge occurs in a sustained manner. During the sustaining period 104, a potential difference produced by wall charges that occurred by the x-th (x=1, 2, 3, . . . ) time sustaining discharge is superimposed on the (x+1) th time sustaining pulse, thus causing the sustaining discharge to occur in a sustained manner. Light emitting luminance is determined according to the number of times of sustaining discharge.

Thus, the initializing period 102, scanning period 103, and sustaining period 104 are collectively called a "sub-field" 105. When gray-level display is performed, one field during which one screen of image information is displayed is made up of a plurality of the sub-fields 105. The gray-level display is made possible by changing the number of potentials of the sustaining pulse in each of the sub-fields 105 and by causing a display cell to emit light or not in each of the sub-fields 105.

However, in the conventional plasma display device using the conventional three-electrode AC-type PDP and in the conventional method for driving the same, when a data pulse potential 112 is low and/or a pulse width of the data pulse potential 112 is short, surface discharge cannot be satisfactorily induced. In this case, unless sufficient negative wall charges (−e) are accumulated on the sustaining electrode 123-i, even if writing discharge occurs, sustaining discharge does not occur during the sustaining period 104, thus causing erroneous discharge (erroneous lighting-off). When the first sustaining pulse potential is applied to the scanning electrode 122-i, since a voltage being applied to the scanning electrode 122-i becomes a sustaining voltage Vs and a voltage being applied to the sustaining electrode 123-i becomes a ground voltage GND, negative wall charges (−e) accumulated on the sustaining electrode 123-i play an important role in causing the sustaining discharge following the writing discharge to occur. In the conventional method described above, in a state before occurrence of the writing discharge, as shown in FIG. 20D, positive wall charges (+e) are accumulated on the sustaining electrode 123-i. Therefore, to reverse the positive wall charges (+e) accumulated on the sustaining electrode 123-i to be positive wall charges (−e) by writing discharge, much current is required.

In the conventional method for driving the conventional PDP, when writing discharge is made to occur, in addition to currents required for discharge between the scanning electrode 122-i and data electrode 129-j, currents required for discharge between the scanning electrode 122-i and sustaining electrode 123-i has to be flown through the scanning electrode 122-i. Due to this, when writing discharge occurs in all pixels (display cells 131) on one line, currents (writing current) required for causing writing discharge to occur is about 500 mA to 700 mA at its peak value in the case of a 42-inch panel, which flow through the scanning electrodes 122-1 to 122-m (one line). Especially, when a peak value of a required writing current is larger than a reference value, due to high resistance occurring when the scanning electrodes 122-1 to 122-m are wired and/or voltage drop that occurs when current supplying capability of the scanning driver is small, voltages being applied to the scanning electrode 122-i and data electrode 129-j decrease.

Therefore, since the voltage being applied to the scanning electrode 122-i and data electrode 129-j decreases, unless a data pulse potential being higher than the data pulse potential 112 is applied, normal writing discharge does not occur anymore. Thus, in the conventional method, due to display load (scanning electrode wring resistance) in a direction (row direction) from the scanning electrode 122-1 to the scanning electrode 122-m, in some cases, normal writing discharge does not occur.

To solve this problem, methods are available in which a data pulse potential is set to be higher than the data pulse potential 112 used in the conventional method, a scanning electrode wiring resistance is set to be lower than the scanning electrode wiring resistance used in the conventional method, a current supply capability of a scanning driver is higher than the current supply capability used in the conventional method, or a like. However, if the data pulse potential is set to be higher than that employed in the conventional method and if the current supply capability of the scanning driver is set to be higher than that employed in the conventional method, costs for driving a plasma display device become higher than that for driving conventional plasma display device. Moreover, in order to make the scanning electrode wiring resistance be lower than that employed in the conventional method, if a thickness of a film of the scanning electrode 122-i is increased, costs for electrode materials used to increase its film thickness and for compensating for a drop in a throughput become higher compared with the case of the conventional method for driving the conventional PDP.

Patent references cited in the above description include the followings:

1. Japanese Patent Application Laid-open No. 2001-350445
2. Japanese Patent Application Laid-open No. 2001-296834
3. Japanese Patent Application Laid-open No. 2000-231361
4. Japanese Patent Application Laid-open No. 2000-206933
5. Japanese Patent Application Laid-open No. 2000-214822
6. Japanese Patent Application Laid-open No. 2001-134232
7. Japanese Patent Application Laid-open No. 2001-184021
8. Japanese Patent Application Laid-open No. 2001-272946
9. Japanese Patent Application Laid-open No. 2002-132207
10. Japanese Patent Application Laid-open No. Hei 10-105111
11. Japanese Patent Application Laid-open No. 2001-184023
12. Japanese Patent Application Laid-open No. 2001-228820
13. Japanese Patent Application Laid-open No. 2002-229508
14. Japanese Patent Application Laid-open No. Hei 11-024626
15. Japanese Patent Application Laid-open No. Hei 11-327505

SUMMARY OF THE INVENTION

In view of the above, it is an object of the present invention to provide a method for driving an AC-type PDP (Plasma Display Panel) and a plasma display device which are capable of causing writing discharge to normally occur. It is another object of the present invention to provide a method for driving an AC-type PDP and a plasma display device which are capable of causing writing discharge to normally occur even at a data pulse potential being lower than that employed in the conventional method. It is still another object of the present invention to provide a method for driving a PDP and a plasma display device which are capable of causing writing discharge to normally occur irrespective of display load. It is another object of the present invention to provide a method for driving a PDP and a plasma display device which are capable of reducing costs for manufacturing and operations (driving) of the PDP.

According to a first aspect of the present invention, there is provided a method for driving an AC-type PDP having two pieces of insulating substrates including a first insulating substrate and a second insulating substrate both being faced each other, on the first insulating substrate of which a plurality of pairs of electrodes is mounted each pair being made up a scanning electrode and a sustaining electrode both being placed in parallel to each other and on the second insulating substrate of which a plurality of data electrodes is mounted each being placed so as to be orthogonal to both the scanning electrode and the sustaining electrode in which each of the scanning electrodes, the sustaining electrodes and the data electrodes is covered with a dielectric layer, the method including:

a step of repeatedly setting periods in order of a scanning period, a sustaining period and an initializing period, during the scanning period of which a potential of each of the data electrodes is changed in a manner to correspond to video data for each of the scanning electrodes and the video data is written according to occurrence or non-occurrence of writing discharge between each of the scanning electrodes and each of the data electrodes, during the sustaining period of which sustaining discharge is repeated by repeatedly applying a sustaining pulse to display an image corresponding to the video data written during the scanning period, and during the initializing period of which a state arisen during the sustaining period is reset and initialized, wherein the initializing period has a wall charge adjusting period during which, when the sustaining discharge occurs immediately before a start of the initializing period, wall charge adjusting discharge whose intensity is lower than that of the sustaining discharge is made to occur between each of the scanning electrodes and each of the sustaining electrodes and a sustaining erasing period during which, after termination of the wall charge adjusting period, a difference in potential between each of the scanning electrodes and each of the sustaining electrodes gradually increases in a direction of a voltage having a polarity opposite to a potential difference between each of the scanning electrodes and each of the sustaining electrodes occurring at time of the wall charge adjusting discharge.

In the foregoing, a preferable mode is one that the wall charge adjusting period has a first wall charge adjusting period during which a potential difference between each of the scanning electrodes and each of the sustaining electrodes is gradually increased in a direction of a voltage having a polarity opposite to that of the sustaining pulse having been applied last during the sustaining period and a second wall charge adjusting period during which a potential difference between each of the scanning electrodes and each of the sustaining electrodes changes more rapidly than during the first wall charge adjusting period and a potential difference between each of the scanning electrodes and each of the sustaining electrodes is increased up to a wall charge adjusting pulse potential being higher, by a wall charge adjusting voltage being lower than a potential difference in the sustaining pulse between each of the scanning electrodes and each of the sustaining electrodes, than a final reaching potential difference between each of the scanning electrodes and each of the sustaining electrodes during the first wall charge adjusting period and the wall charge adjusting pulse voltage is held for a period being equivalent to a wall charge adjusting pulse width, the second wall charge adjusting period following the first wall charge adjusting period.

Also, a preferable mode is one wherein a change ratio of a potential difference during the first wall charge adjusting period is 10 [V/μsec] or less.

Also, a preferable mode is one wherein a change ratio of a potential difference during the second wall charge adjusting period is 20 [V/μsec] or more.

Also, a preferable mode is one wherein a change ratio of a potential difference during the sustaining erasing period is 10 [V/μsec] or less.

Also, a preferable mode is one wherein the sustaining pulse is applied repeatedly and alternately at a first potential and at a second potential being lower than the first potential to each of the scanning electrodes and each of the sustaining electrodes and wherein, during the first wall charge adjusting period, a potential of each of the scanning electrodes is made to be at the first potential and a potential of each of the sustaining electrodes is gradually changed from the first potential to a third potential being an intermediate potential between the first potential and the second potential and wherein, during the second wall charge adjusting period, the potential of each of the sustaining electrodes is changed from the third potential to the second potential.

Also, a preferable mode is one wherein the sustaining pulse is applied repeatedly and alternately at a first potential and at a second potential being lower than the first potential to each of the scanning electrodes and each of the sustaining electrodes and wherein, during the first wall charge adjusting period, a potential of each of the scanning electrodes is made to be at a fourth potential being an intermediate potential between the first potential and the second potential and the potential of each of the sustaining electrodes is gradually changed from the first potential to the second potential and wherein, during the second wall charge adjusting period, the potential of each of the scanning electrodes is changed from the fourth potential to the first potential.

Also, a preferable mode is one wherein the sustaining pulse is applied repeatedly and alternately at a first potential and at a second potential being lower than the first potential to each of the scanning electrodes and each of the sustaining electrodes and wherein, during the first wall charge adjusting period, the potential of each of the scanning electrodes is made to be at a fifth potential and the potential of each of the sustaining electrodes is gradually changed from the first potential to a third potential being an intermediate potential between the first potential and the second potential and wherein, during the second wall charge adjusting period, the potential of each of the scanning electrodes is held at the fifth potential and the potential of each of the sustaining electrodes is changed from the third potential to the second potential and the fifth potential, when no sustaining discharge has occurred during the sustaining period immediately before the initializing period, is a potential at which no discharge occurs between each of the scanning electrodes and each of the sustaining electrodes during the second wall charge adjusting period and being higher than the first potential.

Also, a preferable mode is one wherein the sustaining pulse is applied repeatedly and alternately at a first potential and at a second potential being lower than the first potential to each of the scanning electrodes and each of the sustaining electrodes and wherein, during the first wall charge adjusting period, the potential of each of the scanning electrodes is made to be at the first potential and the potential of each of the sustaining electrodes is gradually changed from the first potential to the second potential and wherein, during the second wall charge adjusting period, the potential of each of the scanning electrodes is changed from the first potential to a sixth potential and the sixth potential, when no sustaining discharge has occurred during the sustaining period immediately before the initializing period, is a potential at which no discharge occurs between each of the scanning electrodes and each of the sustaining electrodes and being higher than the first potential.

Also, a preferable mode is one wherein, after termination of the second wall charge adjusting period, immediately after the wall charge adjusting pulse voltage has been held for a period being equivalent to the wall charge adjusting pulse width, the potential of each of the sustaining electrodes is boosted to the first potential.

Also, a preferable mode is one wherein, after termination of the second wall charge adjusting period, immediately after the wall charge adjusting pulse voltage has been held for a period being equivalent to the wall charge adjusting pulse width, the potential of each of the sustaining electrodes is boosted to a seventh potential being equal to the sustaining potential occurring during the scanning period.

Also, a preferable mode is one wherein the wall charge adjusting pulse width is less than 2 [$\mu$sec].

Also, a preferable mode is one wherein, during the wall charge adjusting period, after termination of the second wall charge adjusting period, an auxiliary sustaining erasing period is provided during which, while the potential of each of the scanning electrodes is held at the first potential, a potential of each of the sustaining electrode is gradually lowered to the second potential.

Also, a preferable mode is one wherein, during the wall charge adjusting period, a wall charge adjusting pulse voltage having a polarity opposite to that of the sustaining pulse applied last during the sustaining period and being smaller than a potential difference of the sustaining pulse between each of the scanning electrodes and each of the sustaining electrodes is applied between each of the scanning electrodes and each of the sustaining electrodes.

Also, a preferable mode is one wherein the sustaining pulse is applied repeatedly and alternately at a first potential and at a second potential being lower than the first potential to each of the scanning electrodes and each of the sustaining electrodes and wherein, during the wall charge adjusting period, the potential of each of the scanning electrodes is made to be at the first potential and the potential of each of the sustaining electrodes is made to be at an eighth potential being an intermediate potential between the first potential and the second potential.

Also, a preferable mode is one wherein, during the sustaining erasing period, while a potential of each of the sustaining electrodes is held at a specified level, a potential of each of the scanning electrodes is gradually lowered from the first potential to the second potential.

Also, a preferable mode is one wherein a potential of each of the sustaining electrodes during the sustaining erasing period is the first potential or the seventh potential.

Also, a preferable mode is one wherein a priming period is provided between the wall charge adjusting period and the sustaining erasing period, during which a potential having a priming waveform is applied to each of the scanning electrodes to boost the potential of each of the scanning electrodes to a potential being higher than the first potential, and while the potential having the priming waveform is being applied, a potential of each of the data electrodes is made equal to a data electrode potential at which no writing discharge occurs during the scanning period.

Also, a preferable mode is one wherein a priming period is provided after the sustaining erasing period, during which a voltage having a priming waveform to boost the potential of each of the scanning electrodes to a potential being higher than the first potential and, while the voltage having the priming waveform is being applied, a potential of each of the data electrodes is made equal to a data electrode potential at which no writing discharge occurs during the scanning period and a priming erasing period is provided after the priming period, during which, while a potential of each of the sustaining electrodes is being held at a specified level, a potential of each of the scanning electrodes is gradually lowered from the first potential.

Also, a preferable mode is one wherein a final reaching potential of each of the scanning electrodes during the priming erasing period is equal to a ninth potential to be applied to each of the scanning electrodes when the writing discharge is made to occur during the scanning period.

Also, a preferable mode is one wherein a final reaching potential of each of the scanning electrodes during the priming erasing period is higher than the ninth potential to be applied to each of the scanning electrodes when the writing discharge is made to occur during the scanning period and a potential difference between the final reaching potential and the ninth potential is 20 V or less.

Also, a preferable mode is one wherein the ninth potential is a ground voltage.

Also, a preferable mode is one wherein a potential of each of the sustaining electrodes during the priming period is equal to the first potential or the seventh potential.

Also, a preferable mode is one wherein pulse waveforms of a voltage to be applied to each of the scanning electrodes, each of the sustaining electrodes, and each of the data electrodes during the sustaining erasing period are same as those of a voltage to be applied to each of the scanning electrodes, each of the sustaining electrodes, and each of the data electrodes during the priming erasing period.

Also, a preferable mode is one wherein the potential of each of the sustaining electrodes during the priming period is equal to the second potential.

Also, a preferable mode is one wherein the first potential is a positive potential and the second potential is a ground potential.

Also, a preferable mode is one wherein at least one initializing period, out of a plurality of the initializing periods, exists during which the voltage having the priming waveform during the priming period is not applied at least one time based on a regular cycle.

Also, a preferable mode is one wherein initializing periods, out of a plurality of the initializing periods, exist during which both the potential having the priming waveform during the priming period and a potential having a priming erasing waveform during the priming erasing period is not applied at least one time based on a regular cycle.

Also, a preferable mode is one wherein a potential to be applied to each of the scanning electrodes when the writing discharge is made to occur is a negative potential.

According to a second embodiment of the present invention, there is provided a plasma display device including:

scanning electrodes and sustaining electrodes formed in a manner that each of the scanning electrodes and each of the sustaining electrodes are placed in parallel to each other;

data electrodes formed so as to face the scanning electrodes and the sustaining electrodes and placed in a manner to be orthogonal to the scanning electrodes and the sustaining electrodes; and a driving section to drive the scanning electrodes, sustaining electrodes, and data electrodes and a control section;

wherein a sub-field includes an initializing period, a scanning period during which video data to display a video is written in a cell by writing discharge made to occur between each of the scanning electrodes and each of the data electrodes, and a sustaining period during which sustaining discharge is made to occur between each of the scanning electrodes and each of the sustaining electrodes, which causes the cell in which the writing discharge has occurred to emit light in a manner to correspond to the video data;

wherein the initializing period includes a wall charge adjusting period during which wall charge adjusting discharge is made to occur to adjust charges accumulated between each of the scanning electrodes and each of the sustaining electrodes when the sustaining discharge was made to occur and an erasing period; and wherein, during the wall charge adjusting period, the control section drives the driving section so that the wall charge adjusting discharge whose intensity is lower than that of the sustaining discharge occurs between each of the scanning electrodes and each of the sustaining electrodes and so that, during the erasing period after termination of the wall charge adjusting period, an erasing potential, which is gradually boosted to an erasing period difference of a potential having a polarity opposite to that of a wall charge adjusting period difference of a potential occurring when the wall charge adjusting discharge occurs between each of the scanning electrodes and each of the sustaining electrodes, is applied between each of the scanning electrodes and each of the sustaining electrodes.

In the foregoing, a preferable mode is one wherein the wall charge adjusting period includes a first wall charge adjusting period and a second wall charge adjusting period and wherein the control section drives the driving section so that, during the sustaining period, a sustaining pulse potential is applied alternately to each of the scanning electrodes and each of the sustaining electrodes and so that, during the first wall charge adjusting period, an adjusting potential, which is gradually boosted to a first wall charge adjusting period difference of a potential having a polarity opposite to that of a sustaining period difference of a potential occurring when the sustaining pulse potential was applied between each of the scanning electrodes and each of the sustaining electrodes last during the sustaining period, is applied between each of the scanning electrodes and each of the sustaining electrodes and so that, during the second wall charge adjusting period, a wall charge adjusting pulse potential, which rapidly changes to be a second wall charge adjusting period potential difference being larger than the first wall charge adjusting period potential difference, is applied between each of the scanning electrodes and each of the sustaining electrodes and the wall charge adjusting pulse potential is held for a period being equivalent to a wall charge adjusting pulse width, and wherein the wall charge adjusting pulse width is time during which the wall charge adjusting pulse potential is being applied between each of the scanning electrodes and each of the sustaining electrodes.

Also, a preferable mode is one wherein the control section drives the driving section so that, during the sustaining period, a first potential and a second potential being lower than the first potential are alternately applied to each of the scanning electrodes as the sustaining pulse potential and the second potential and the first potential are alternately applied to each of the sustaining electrodes as the sustaining pulse potential and so that, during the first wall charge adjusting period, the first potential is applied to each of the scanning electrodes as the adjusting potential and a potential to be applied to each of the sustaining electrodes is gradually lowered from the first potential to a third potential being an intermediate potential between the first potential and the second potential and so that, during the second wall charge adjusting period, a potential to be applied to each of the scanning electrodes is set and held to be the first potential as the wall charge adjusting pulse potential for a period being equivalent to the wall charge adjusting pulse width and a potential to be applied to each of the sustaining electrodes is lowered from the third potential to the second potential, and thus set and held to be the second potential for a period being equivalent to the wall charge adjusting pulse width.

Also, a preferable mode is one wherein the control section drives the driving section so that, during the sustaining period, a first potential and a second potential being lower than the first potential are alternately applied to each of the scanning electrodes as the sustaining pulse potential and the second potential and the first potential are alternately applied to each of the sustaining electrodes as the sustaining pulse potential and so that, during the first wall charge adjusting period, a potential to be applied, as the adjusting potential, to each of the sustaining electrodes is gradually lowered from the first potential to a third potential being an intermediate potential between the first potential and the second potential and a fourth potential being higher than the first potential is applied to each of the scanning electrodes and so that, during the second wall charge adjusting period, a potential to be applied, as the wall charge adjusting pulse potential, to each of the scanning electrodes is held to be at the fourth potential for a period being equivalent to the wall charge adjusting pulse width and a potential to be applied to each of the sustaining electrodes is lowered from the third potential to the second potential and is held to be at the second potential for a period being equivalent to the wall charge adjusting pulse width and wherein the fourth potential is a potential at which the wall charge adjusting discharge does not occur between each of the scanning electrodes and each of the sustaining electrodes during the second wall charge adjusting period when the sustaining discharge does not occur during the sustaining period.

Also, a preferable mode is one wherein the control section drives the driving section so that, during the sustaining period, a first potential and a second potential being lower than the first potential are alternately applied to each of the scanning electrodes as the sustaining pulse potential and the second potential and the first potential are alternately applied to each of the sustaining electrodes as the sustaining pulse potential and so that, during the first wall charge adjusting period, a fifth potential being an intermediate potential between the first potential and the second potential is applied as the adjusting potential to each of the scanning electrodes and a potential to be applied to each of the sustaining electrodes is gradually lowered from the first potential to the second potential and so that, during the second wall charge adjusting period, a potential to be applied as the wall charge adjusting pulse potential to each of the sustaining electrodes is held to be at the second potential for a period being equivalent to the wall charge adjusting pulse width and a potential to be applied to each of the scanning electrodes is boosted from the fifth potential to the first potential and is held at the first potential for a period being equivalent to the wall charge adjusting pulse width.

Also, a preferable mode is one wherein the control section drives the driving section so that, during the sustaining period, a first potential and a second potential being lower than the first potential are alternately applied to each of the scanning electrodes as the sustaining pulse potential and the second potential and the first potential are alternately applied to each of the sustaining electrodes as the sustaining pulse potential and so that, during the first wall charge adjusting period, the first potential is applied as the adjusting potential to each of the scanning electrodes and a potential to be applied to each of the sustaining electrodes is gradually lowered from the first potential to the second potential and so that, during the second wall charge adjusting period, a potential to be applied, as the wall charge adjusting pulse potential, to each of the sustaining electrodes is held to be at the second potential for a period being equivalent to the wall charge adjusting pulse width and a potential to be applied to each of the scanning electrodes is boosted from the first potential to a sixth potential being higher than the first potential and is held to be at the sixth potential for a period being equivalent to the wall charge adjusting pulse width and wherein the sixth potential is a potential at which the wall charge adjusting discharge does not occur between each of the scanning electrodes and each of the sustaining electrodes during the second wall charge adjusting period when the sustaining discharge does not occur during the sustaining period.

Also, a preferable mode is one wherein a change ratio, which indicates an average rate of change that occurs, during the first wall charge adjusting period, from time at which the first potential begins to lower to time at which it lowers fully to the third potential, is set to be 10 [V/μsec] or less.

Also, a preferable mode is one wherein a change ratio, which indicates an average rate of change that occurs, during the third wall charge adjusting period, from time at which the second potential begins to lower to time at which it lowers fully to the second potential, is set to be 20 [V/μsec] or more.

Also, a preferable mode is one wherein a change ratio, which indicates an average rate of change that occurs, during the first wall charge adjusting period, from time at which the first potential begins to lower to time at which it lowers fully to the second potential, is set to be 10 [V/μsec] or less.

Also, a preferable mode is one wherein the wall charge adjusting pulse width is less than 2 μsec.

Also, a preferable mode is one wherein the control section drives the driving section so that, during the sustaining period, a sustaining pulse potential is applied alternately to each of the scanning electrodes and each of the sustaining electrodes and so that, during the wall charge adjusting period, the wall charge adjusting period difference of a potential having a polarity opposite to a sustaining period difference of a potential occurring when the sustaining pulse potential is applied between each of the scanning electrodes and each of the sustaining electrodes last during the sustaining period, is applied, as an adjusting potential being smaller than the sustaining pulse potential, to each of the scanning electrodes and each of the sustaining electrodes.

Also, a preferable mode is one wherein the control section drives the driving section so that, during the sustaining period, a first potential and a second potential being lower than the first potential are alternately applied to each of the scanning electrodes as the sustaining pulse potential and the second potential and the first potential are alternately applied as the sustaining pulse potential to each of the sustaining electrodes and so that, during the wall charge adjusting period, a potential to be applied to each of the scanning electrodes is held to be at the first potential as the adjusting potential and a seventh potential being an intermediate potential between the first potential and the second potential is applied to each of the sustaining electrodes.

Also, a preferable mode is one wherein the erasing period includes a sustaining erasing period, wherein the control section drives the driving section so that, during the sustaining erasing period, an eighth potential is applied to each of the sustaining electrodes and a potential to be applied to each of the scanning electrodes is gradually lowered from the first potential to the second potential, and wherein the eighth potential is a potential to be applied to each of the sustaining electrodes during the scanning period.

Also, a preferable mode is one wherein the erasing period includes a sustaining erasing period, wherein the control section drives the driving section so that, during the sustaining erasing period, an eighth potential is applied to each of the sustaining electrodes and a potential to be applied to each of the scanning electrodes is gradually lowered from the fourth potential to the second potential, and wherein the eighth potential is a potential to be applied to each of the sustaining electrodes during the scanning period.

Also, a preferable mode is one wherein the erasing period includes a sustaining erasing period, wherein the control section drives the driving section so that, during the sustaining erasing period, an eighth potential is applied to each of the sustaining electrodes and a potential to be applied to each of the scanning electrodes is gradually lowered from the sixth potential to the second potential, and wherein the eighth potential is a potential to be applied to each of the sustaining electrodes during the scanning period.

Also, a preferable mode is one wherein the initializing period includes an auxiliary sustaining erasing period and the erasing period includes a sustaining erasing period, wherein the control section drives the driving section so that, during the auxiliary sustaining erasing period, a potential to be applied to each of the scanning electrodes is held to be at the first potential and an eighth potential is applied to each of the sustaining electrodes and a potential to be applied to each of the sustaining electrodes is gradually lowered from the eighth potential to the second potential and so that, during the sustaining erasing period, an eighth potential is applied to each of the sustaining electrodes and a potential to be applied to each of the scanning electrodes is gradually lowered from the first potential to the second potential and wherein the eighth potential is a potential to be applied to each of the sustaining electrodes during the scanning period.

Also, a preferable mode is one wherein the initializing period includes an auxiliary sustaining erasing period and wherein the control section drives the driving section so that, during the auxiliary sustaining erasing period, a potential to be applied to each of the scanning electrodes is held to be at the first potential and an eighth potential is applied to each of the sustaining electrodes and a potential to be applied to each of the sustaining electrodes is gradually lowered from the eighth potential to the second potential, and wherein the eighth potential is a potential to be applied to each of the sustaining electrodes during the scanning period.

Also, a preferable mode is one wherein the erasing period includes a sustaining erasing period and wherein the control section drives the driving section so that, during the sustaining erasing period, a potential to be applied to each of the sustaining electrodes is boosted from the seventh potential to an eighth potential being higher than the seventh potential and a potential to be applied to each of the scanning electrodes is gradually lowered from the first potential to the second potential, and wherein the eighth potential is a potential to be applied to each of the sustaining electrodes during the scanning period.

Also, a preferable mode is one wherein the erasing period includes a sustaining erasing period and wherein the control section drives the driving section so that, during the sustaining erasing period, an eighth potential is applied to each of the sustaining electrodes and a potential to be applied to each of the scanning electrodes is gradually lowered from the first potential to a ninth potential being lower than the second potential, and wherein the eighth potential is a potential to be applied to each of the sustaining electrodes during the scanning period.

Also, a preferable mode is one wherein a change ratio, which indicates an average rate of change that occurs, during the sustaining erasing period, from time at which the first potential begins to lower to time at which it lowers fully to the second potential, is set to be 10 [V/μsec] or less.

Also, a preferable mode is one wherein a change ratio, which indicates an average rate of change that occurs, during the sustaining erasing period, from time at which the fourth potential begins to lower to time at which it lowers fully to the second potential, is set to be 10 [V/μsec] or less.

Also, a preferable mode is one a change ratio, which indicates an average rate of change that occurs, during the sustaining erasing period, from time at which the sixth potential begins to lower to time at which it lowers fully to the second potential, is set to be 10 [V/μsec] or less.

Also, a preferable mode is one wherein a change ratio, which indicates an average rate of change that occurs, during the sustaining erasing period, from time at which the first potential begins to lower to time at which it lowers fully to the ninth potential, is set to be 10 [V/μsec] or less.

Also, a preferable mode is one wherein a change ratio, which indicates an average rate of change that occurs, during the auxiliary sustaining erasing period, from time at which the eighth potential begins to lower to time at which it lowers fully to the second potential, is set to be 10 [V/μsec] or less.

Also, a preferable mode is one wherein the initializing period includes a priming period and the erasing period includes a priming erasing period and wherein the control section drives the driving section so that, during the priming period, the second potential is applied to each of the sustaining electrodes and the first potential is applied to each of the scanning electrodes and a potential to be applied to each of the scanning electrodes is gradually boosted from the first potential to a tenth potential being higher than the first potential and so that, during the priming erasing period following the priming period, the eighth potential is applied to each of the sustaining electrodes and a potential to be applied to each of the scanning electrodes, after having been lowered from the tenth potential to the first potential, is gradually lowered from the first potential to the second potential.

Also, a preferable mode is one wherein the initializing period includes a priming period and the erasing period includes a priming erasing period and wherein the control section drives the driving section so that, during the priming period, the second potential is applied to each of the sustaining electrodes and the first potential is applied to each of the scanning electrodes and a potential to be applied to each of the scanning electrodes is gradually boosted from the first potential to a tenth potential being higher than the first potential and so that, during the priming erasing period following the priming period, the eighth potential is applied to each of the sustaining electrodes and a potential to be applied to each of the scanning electrodes, after having been lowered from the tenth potential to the first potential, is gradually lowered from the first potential to the ninth potential.

Also, a preferable mode is one wherein the control section drives the driving section so that, during the scanning period, the eighth potential is applied to each of the sustaining electrodes and, after a set potential being higher than the second potential has been applied to each of the scanning electrodes, when a scanning pulse potential that lowers from the set potential to the second potential is applied to each of the scanning electrodes, a data pulse potential corresponding to the video data is applied to each of the data electrodes.

Also, a preferable mode is one wherein the control section drives the driving section so that, during the scanning period, the eighth potential is applied to each of the sustaining electrodes and, after a set potential being higher than the ninth potential has been applied to each of the scanning electrodes, when a scanning pulse potential that lowers from the set potential to the ninth potential is applied to each of the scanning electrodes, a data pulse potential corresponding to the video data is applied to each of the data electrodes.

Also, a preferable mode is one wherein a final reaching potential being the ninth potential to be applied to each of the scanning electrodes during the priming erasing period is higher than a scanning pulse potential occurring when lowering from the set potential to the ninth potential as the scanning pulse potential to be applied to each of the scanning electrodes during the scanning period and a potential difference between the final reaching potential and the scanning pulse potential is 20 V or less.

Also, a preferable mode is one wherein the control section drives the driving section so that a field is operated periodically and the field is made up of a plurality of the sub-fields and each of the plurality of the sub-fields is operated sequentially and wherein the initializing period in at least one sub-field out of the plurality of the sub-fields does not include the priming period and the priming erasing period.

Also, a preferable mode is one wherein the eighth potential is the first potential.

Furthermore, a preferable mode is one wherein the second potential is a ground potential.

With the above configurations, it made possible to cause writing discharge to normally occur. Normal writing discharge is made possible at a data pulse potential being lower than that employed in the conventional plasma display device. It is possible to cause writing discharge to normally occur irrespective of display loads. Costs needed for manufacturing and operating (driving) of a plasma display device can be reduced.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Embodiments of the present invention are described using a plasma display device having a three-electrode AC-type PDP as a plasma display device to be applied to a method for driving a PDP of the present invention.

Figure 1:
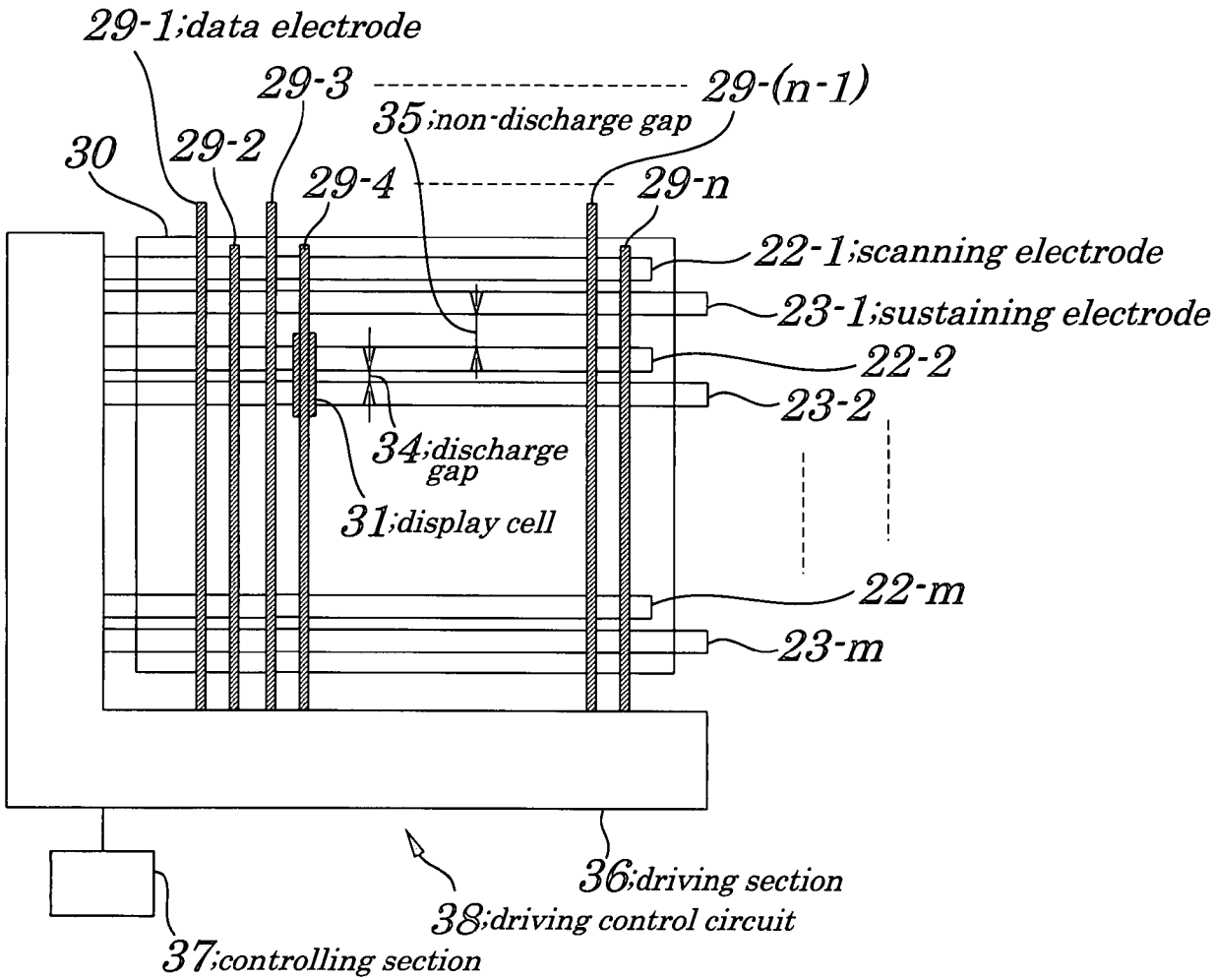
FIG. 1 is a diagram showing configurations of a plasma display device of the present invention (plan view of a three-electrode AC-type PDP of the present invention)

FIG. 1 is a diagram showing configurations of a plasma display device of the present invention (plan view of a three-electrode AC-type PDP of the present invention). The plasma display device of the present invention, as shown in FIG. 1, includes a display screen 30, m-pieces of scanning electrodes 22 (scanning electrodes 22-1 to 22-m, m=1, 2, 3, . . . ), m-pieces of sustaining electrodes 23 (scanning electrodes 23-1 to 23-m), n-pieces of data electrodes 29 (data electrodes 29-1 to 29-n; n=1, 2, 3, . . . ,), and (m×n) pieces of display cells 31. The (m×n) pieces of the display cells 31 are arranged in m-rows and n-columns. In each of n-pieces of display cells 31 belonging to one row out of m-rows, the scanning electrode 22-i (i=1, 2, . . . ,m) and the sustaining electrode 23-i (i=1, 2, . . . ,m) are formed in parallel to each other. In each of m-pieces of the display cells 31 belonging to one column out of n-columns, the data electrode 29-j (j=1, 2, . . . ,n) is formed in a manner so as to be orthogonal to both the scanning electrode 122-i and the sustaining electrode 123-i. Between the scanning electrode 22-i and the sustaining electrode 23-i is provided a discharge gap 34 with a first interval between them. Between the scanning electrode 22-i and the sustaining electrode 23-(i−1) and between the scanning electrode 22-(i+1) and the sustaining electrode 23-i, a non-discharge gap 35 is provided with a second interval between them.

To the plasma display device of the present invention is connected a driving control circuit 38. The driving control circuit 38 includes a driving section 36 and a controlling section 37. The driving section 36 has a scanning driver (not shown), a sustaining driver (not shown), and a data driver (not shown). The scanning driver is connected to the scanning electrodes 22-1 to 22-m, the sustaining driver is connected to the sustaining electrodes 23-1 to 23-m, and the data driver is connected to the data electrodes 29-1 to 29-n. One terminal of the controlling section 37 is connected to a GND (ground) and another terminal of the controlling section 37 is connected to the driving section 36. The controlling section 37 drives the driving section 36 so that a potential described later is applied through the scanning driver, sustaining driver, data driver to the scanning electrodes 22-1 to 22-m, sustaining electrodes 23-1 to 23-m, and data electrodes 29-1 to 29-n. Here, a difference in potential between any two electrodes, between any electrode and the driving control circuit 38 or a like is called a "voltage" or an "electric potential difference".

Figure 2:
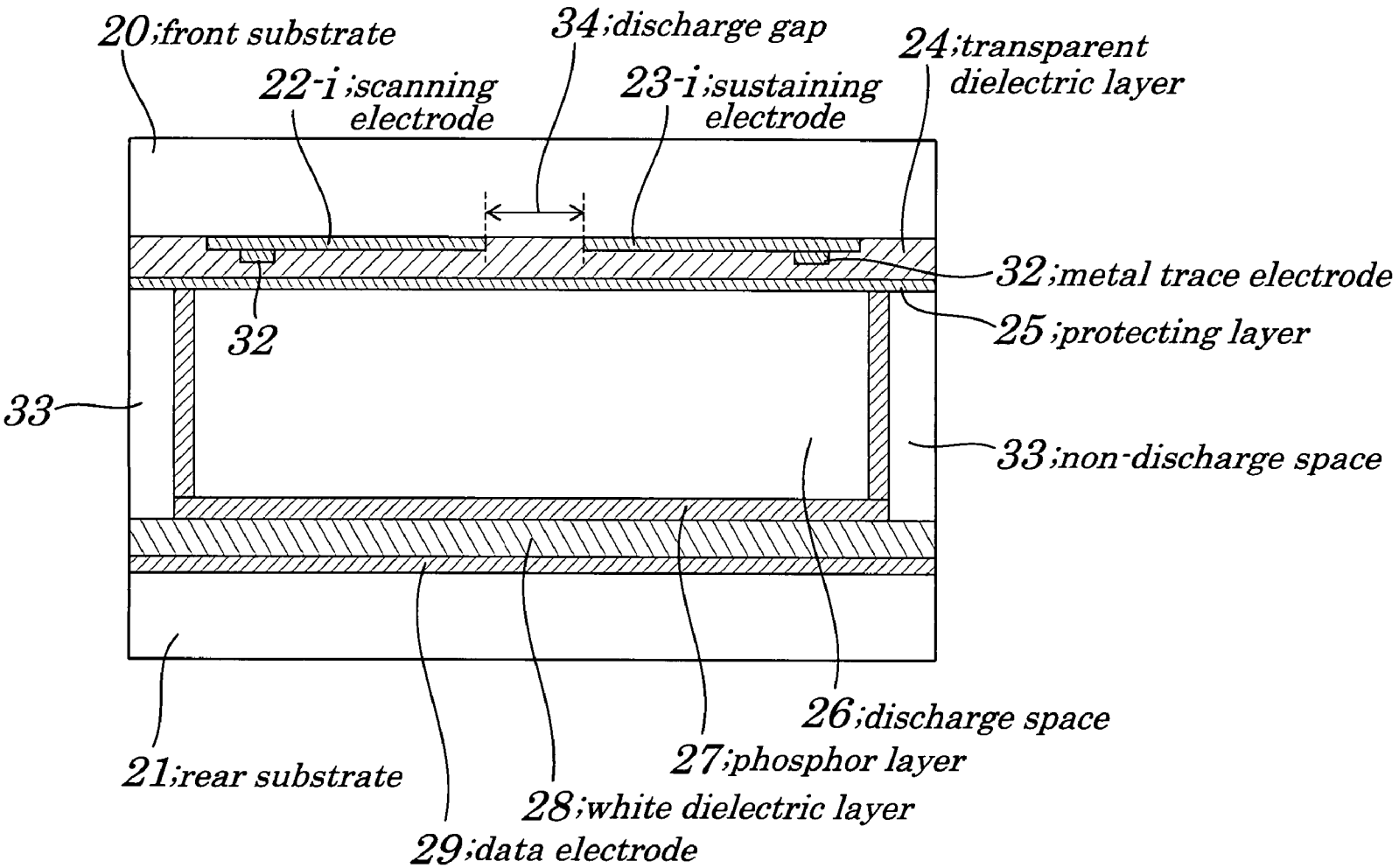
FIG. 2 is a cross-sectional view of one of display cells making up the thee-electrode AC-type PDP shown in FIG. 1.

FIG. 2 is a cross-sectional view of one of display cells making up the thee-electrode AC-type PDP shown in FIG. 1. The plasma display device, as shown in FIG. 2, further includes an upper insulating substrate (front substrate) 20, a lower insulating substrate (rear substrate) 21, a transparent dielectric layer 24, a protecting layer 25, a phosphor layer 27, a white dielectric layer 28, a display screen (not shown, see FIG. 1), metal trace electrodes 32. The front substrate 20 faces the rear substrate 21. The front substrate 20 and rear substrate 21 are made up of, for example, a glass substrate.

Between the front substrate 20 and rear substrate 21, that is, on the front substrate 20, the scanning electrode 22-i and the sustaining electrode 23-i are mounted, with a first interval between them, in parallel to each other. The first interval is the discharge gap 134. Among the scanning electrode 22-i, the sustaining electrode 23-i, and the rear substrate 21, that is, on the scanning electrode 22-i and the sustaining electrode 23-i, the metal trace electrodes 132 used to reduce wiring resistance are formed. Among the front substrate 20, the scanning electrode 22-i, the sustaining electrode 23-i, the metal trace electrode 32, that is, on the front substrate 20, the scanning electrode 22-i, the sustaining electrode 23-i, the metal trace electrode 32, the transparent dielectric layer 24 is formed. Between the transparent dielectric layer 24 and rear substrate 21, that is, on the transparent dielectric layer 24, the protecting layer 25 used to protect the transparent dielectric layer 24 from damages caused by discharge is formed. The protecting layer 25 is made up of, for example, MgO.

Between the protecting layer 25 and rear substrate 21, that is, on the rear substrate 21, a data electrode 29-j is formed in a manner so as to be orthogonal to both the scanning electrode 22-i and sustaining electrode 23-i. Between the protecting layer 25 and data electrode 29-j, that is, on the data electrode 29-j, the white dielectric layer 128 is formed. Between the protecting layer 25 and white dielectric layer 28, a first phosphor layer 27-1 and a second phosphor layer 27-2 are formed as the phosphor layer 27. That is, on the white phosphor layer 28 is formed the first phosphor layer 27-1. On the first phosphor layer 27-1, the second phosphor layer 27-2 extending from both sides of the first phosphor layer 27-1 to the protecting layer 25 is formed in a vertically upward direction of the first phosphor layer 27-1 so that a discharge space 26 is formed as the above display cell 31. Between the front substrate 20 and rear substrate 21, a non-discharge space 33 is formed in a manner that each display cell 31 is surrounded by end portions of the second phosphor layer 27-2 and first phosphor layer 27-1, the protecting layer 25, and the white dielectric layer 28. The second phosphor layer 27-2 serves as a rib (partition wall). The rib (second phosphor layer 27-2) plays a roll in securing the discharge space 26 and in partitioning a pixel (in detail, display cell 31). The discharge space 26 is filled with a mixed gas of He (helium), Ne (neon), Xe (xenon), or a like.

Next, as a method for driving the plasma display device of the present invention, a scanning and sustaining separating method, that is, a method called the "ADS method" is described in which a scanning period is separated from a sustaining period.

First Embodiment

Figure 3:
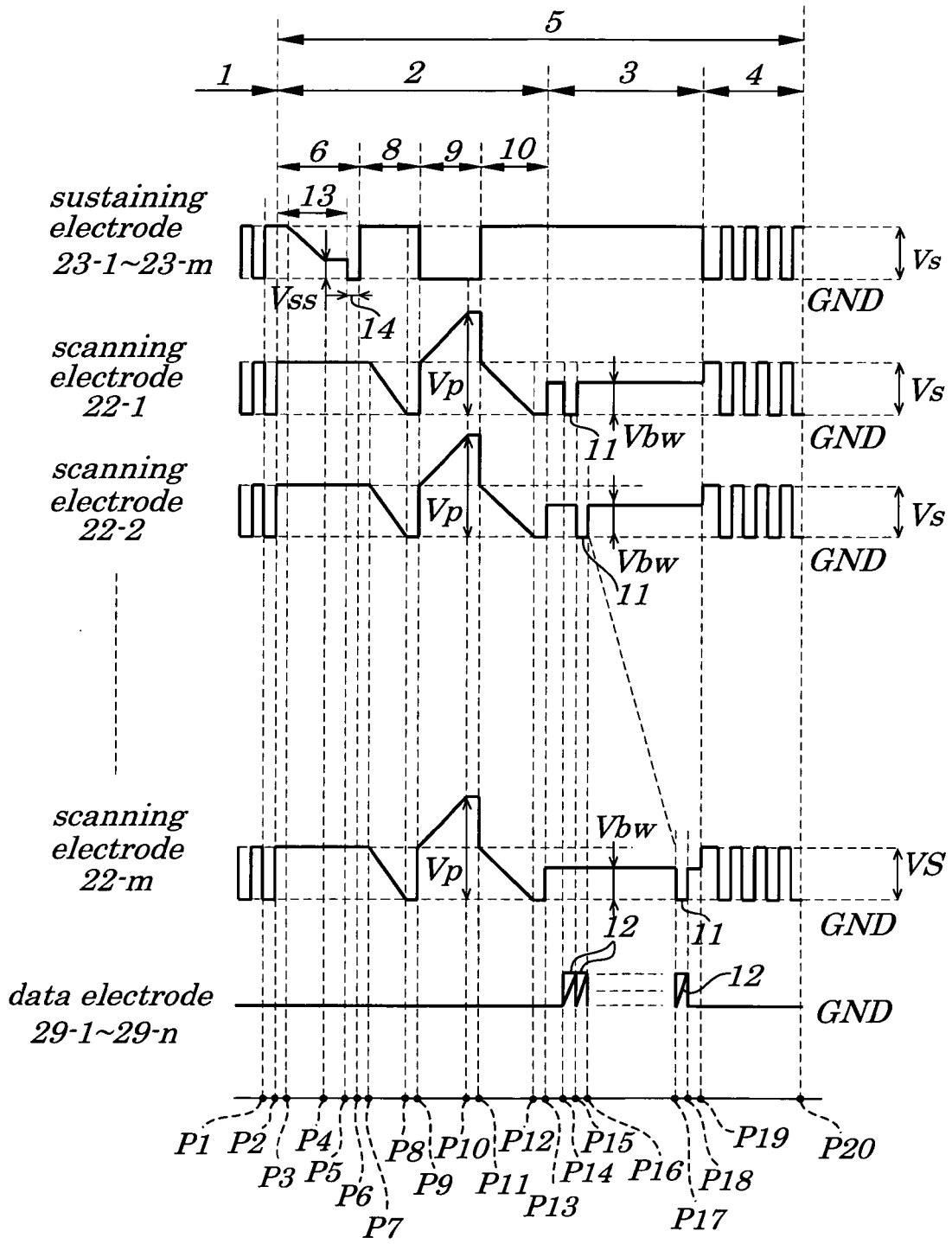
FIG. 3 is a timing chart showing voltages applied for driving a plasma display device according to a first embodiment of the present invention.

FIG. 3 is a timing chart showing waveforms of voltages used for driving a plasma display device according to a first embodiment of the present invention. As shown in FIG. 3, one sub-field 105 (hereinafter may be referred to as a "sub-field 105") is made up of three periods including an initializing period 2, a scanning period 3, and a sustaining period 4. When gray-level display is performed, one field during which one screen of image information is displayed is made up of a plurality of the sub-fields 5 (the initializing period 2, the scanning period 3, and the sustaining period 4). Operations in each of the fields are executed periodically by the driving control circuit 38. Operations in each of the plurality of sub-fields 5 are executed in order. The initializing period 2 is a period during which wall charges having been accumulated between the scanning electrode 22-i and the sustaining electrode 23-i when sustaining discharge occurred during the sustaining period 4 are erased (initialized or reset), to which timing P2, P3, P4, P5, P6, P7, P8, P9, P10, P11, P12, and P13 following timing P1 corresponds. The scanning period 3 is a period during which video data to display a video is written in an address (display cell 31) by causing writing discharge to occur between the scanning electrode 22-i and the data electrode 29-j, to which the timing P13, 14, 15, 16, . . . ,P17, P18, and P19 corresponds. The sustaining period 4 is a period during which sustaining discharge to cause the display cell 31 for which writing discharge was made to occur to emit light in a manner to correspond to video data is made to occur between the scanning electrode 22-i and the sustaining electrode 23-i, to which timing P19 and P20 corresponds.

The initializing period 2 includes a wall charge adjusting period 6, a sustaining erasing period 8, a priming period 9, and a priming erasing period 10. The wall charge adjusting period 6 is a period during which wall charges accumulated when sustaining discharge was made to occur during the sustaining period 4 are adjusted, to which the timing P2, P3, P4, P5 and P6 corresponds. The sustaining erasing period 8 is a period during which wall charges accumulated between the scanning electrode 22-i and sustaining electrode 23-i when sustaining discharge was made to occur during the sustaining period 4 are erased (initialized or reset), to which the timing P6, P7, P8 and P9 corresponds. The priming period 9 is a period during which a priming effect is made to be produced, to which the timing P9, P10 and P11 corresponds. The priming erasing period 10 is a period during which wall charges accumulated on the dielectric layer in each of the display cells 31 as a result of the priming effect are erased, to which the timing P11, P12 and P13 corresponds.

The wall charge adjusting period 6 is made up of a first wall charge adjusting period 13 and a second wall charge adjusting period 14. The first wall charge adjusting period 13 is a period from the timing P2 to the timing P5 and the second wall charge adjusting period 14 is a period from the timing P5 to the timing P6.

Driving waveforms applied during the sustaining period 4 in a pre-subfield 1 existing before the sub-field 5 are described by referring to FIG. 3. A sustaining voltage Vs and a ground voltage GND being lower than the sustaining voltage Vs are alternately applied as a sustaining pulse potential to the scanning electrodes 22-1 to 22-m by the driving control circuit 38 and a ground voltage GND and the sustaining voltage Vs are alternately applied to the sustaining electrodes 23-1 to 23-m. A ground voltage GND is applied, by the driving control circuit 38, to the data electrodes 29-1 to 29-n. At the timing P1 existing immediately before the initiating period 2, the sustaining voltage Vs is applied to the scanning electrode 22-1 to 22-m and a ground voltage GND is applied to the sustaining electrodes 23-1 to 23-m by the driving control circuit 38.

During the wall charge adjusting period 6 in the initializing period 2, during a period from the timing P2 to the timing P6, by the driving control circuit 38, wall charge adjusting discharge occurs between the scanning electrodes 22-1 to 22-m and the sustaining electrodes 23-1 to 23-m, whose intensity is lower than intensity of sustaining discharge used to adjust charges accumulated between the scanning electrodes 22-1 to 22-m and the sustaining electrode 23-1 to 23-m when the sustaining discharge was made to occur. The intensity of the wall charge adjusting discharge is lower than the intensity of the sustaining discharge.

Driving waveforms applied during the first wall charge adjusting period 13 in the wall charge adjusting period 6 are described by referring to FIG. 3. During a period from the timing P2 to the timing P5 in the first wall charge adjusting period 13, by the driving control circuit 38, an adjusting potential gradually increasing to the first wall charge adjusting period potential difference having a polarity opposite to the sustaining period potential difference produced when a sustaining pulse potential (final sustaining pulse) was applied as a last sustaining pulse to be applied during the sustaining period 4 between the scanning electrodes 22-1 to 22-m and the sustaining electrodes 23-1 to 23-m, is applied between the scanning electrodes 22-1 to 22-m and the sustaining electrodes 23-1 to 23-m. Specifically, at the timing P2, a sustaining voltage Vs is applied, as an adjusting potential, to the scanning electrodes 22-1 to 22-m by the driving control circuit 38. Next, for a period from the timing P2 to the timing P5, the sustaining voltage Vs having been accumulated to the scanning electrodes 22-1 to 22-m is held by the driving control circuit 38. Moreover, for a period from the timing P2 to the timing P3, the sustaining voltage Vs having been applied to the sustaining electrodes 23-1 to 23-m is held as an adjusting potential by the driving control circuit 38. Next, during a period from the timing P3 to the timing P4, the voltage to be applied to the sustaining electrode 23-1 to 23-m by the driving control circuit 38 is gradually lowered from the sustaining voltage Vs to a wall charge adjusting voltage Vss. The wall charge adjusting voltage Vss is lower than the sustaining voltage Vs and higher than a ground voltage GND. Then, for a period from the timing P4 to the timing P5, the wall charge adjusting voltage Vss having been applied to the sustaining electrodes 23-1 to 23-m is held by the driving control circuit 38. For a period from the timing P2 to the timing P5, the ground voltage GND having been applied to the data electrodes 29-1 to 29-n is held by the driving control circuit 38.

Driving waveforms applied during the second wall charge adjusting period 14 in the wall charge adjusting period 6 are described by referring to FIG. 3. For a period from the timing P5 to the timing P6 in the second wall charge adjusting period 14, a wall charge adjusting pulse potential which changes rapidly to a second wall charge adjusting period potential difference being larger than the first wall charge adjusting period potential difference is applied by the driving control circuit 38 between the scanning electrodes 22-1 to 22-m and the sustaining electrodes 23-1 to 23-m and the wall charge adjusting pulse potential is held for a period being equivalent to a wall charge adjusting pulse width. The wall charge adjusting pulse width represents time (period from the timing P5 to the timing P6) during which the wall charge adjusting pulse potential is being applied between the scanning electrodes 22-1 to 22-m and the sustaining electrodes 23-1 to 23-m. Specifically, for a period from the timing P5 to the timing P6, by the driving control circuit 38, a sustaining pulse Vs is held, as a wall charge adjusting pulse potential, for a period being equivalent to the wall charge adjusting pulse width. Also, at the timing P5, the voltage to be applied to the sustaining electrodes 23-1 to 23-m by the driving control circuit 38 as the wall charge adjusting pulse potential is lowered from the wall charge adjusting voltage Vss to a ground voltage GND. Next, for a period from the timing P5 to the timing P6, a ground voltage GND applied to the sustaining electrodes 23-1 to 23-m is held for a period being equivalent to the wall charge pulse width by the driving control circuit 38. For a period from the timing P5 to the timing P6, the ground voltage GND applied to the data electrodes 29-1 to 29-n is held by the driving control circuit 38.

Driving waveforms (ramp waveforms of voltages being applied to electrodes during the sustaining erasing period 8) applied during the sustaining erasing period 8 in the initializing period 2 are described by referring to FIG. 3. During a period from the timing P6 to the timing P9, an erasing voltage gradually increasing to an erasing period potential difference having a polarity opposite to a wall charge adjusting period potential difference occurring when wall charge adjusting discharge occurs between the scanning electrodes 22-1 to 22-m and the sustaining electrodes 23-1 to 23-m, is applied between the scanning electrodes 22-1 to 22-m and the sustaining electrodes 23-1 to 23-m by the driving control circuit 38. Specifically, for a period from the timing P6 to the timing P7, the sustaining voltage Vs applied to the scanning electrodes 22-1 to 22-m is held as an erasing potential by the driving control circuit 38. Next, during a period from the timing P7 to the timing P8, the voltage to be applied to the scanning electrodes 22-1 to 22-m by the driving control circuit 38 is gradually lowered from the sustaining voltage Vs to a ground voltage GND. Next, for a period from the timing P8 to the timing P9, the ground voltage GND applied to the scanning electrodes 22-1 to 22-m is held by the driving control circuit 38. Moreover, at the timing P6, a sustaining voltage Vs is applied, as an erasing potential, to the sustaining electrodes 23-1 to 23-m by the driving control circuit 38. Next, for a period from the timing P6 to the timing P9, the sustaining voltage Vs applied to the sustaining electrodes 23-1 to 23-m is held by the driving control circuit 38. For a period from the timing P6 to the timing P9, the ground voltage GND applied to the data electrodes 29-1 to 29-n is held by the driving control circuit 38.

Driving waveforms (ramp waveforms of voltages being applied to electrodes during the priming period 9, as also called priming waveforms) applied during the priming period 9 in the initializing period 2 are described by referring to FIG. 3. At the timing P9, a sustaining voltage Vs is applied to the scanning electrodes 22-1 to 22-m by the driving control circuit 38. Next, during a period from the timing P9 to the timing P10, the voltage to be applied to the scanning electrodes 22-1 to 22-m by the driving control circuit 38 is gradually boosted from the sustaining voltage Vs to a priming voltage Vp. The priming voltage Vp is higher than the sustaining voltage Vs. For a period from the timing P10 to the timing P11, the priming voltage Vp applied to the scanning electrodes 22-1 to 22-m is held by the driving control circuit 38. During a period from the timing P9 to the timing P11, a ground voltage GND is applied to the sustaining electrodes 23-1 to 23-m by the driving control circuit 38. For a period from the timing P9 to the timing P11, the ground voltage GND applied to the data electrodes 29-1 to 29-n is held by the driving control circuit 38.

Driving waveforms (ramp waveforms of voltages to be applied to electrodes during the priming erasing period 10) applied during the priming erasing period 10 in the initializing period 2 are described by referring to FIG. 3. For a period from the timing P11 to the timing P13, an erasing potential which is gradually boosted to an erasing period potential difference (same erasing period potential difference as used during the sustaining erasing period 8) having a polarity opposite to the wall charge adjusting period potential difference is applied between the scanning electrodes 22-1 to 22-m and the sustaining electrodes 23-1 to 23-m by the driving control circuit 38. Specifically, at the timing P11, the voltage to be applied to the scanning electrodes 22-1 to 22-m as an erasing potential, by the driving control circuit 38 is lowered from a priming voltage Vp to the sustaining voltage Vs. Next, during a period from the timing P11 to the timing P12, the voltage to be applied to the scanning electrodes 22-1 to 22-m by the driving control circuit 38 is lowered from the sustaining voltage Vs to a ground voltage GND. Then, for a period from the timing P12 to the timing P13, the ground potential GND applied to the scanning electrodes 22-1 to 22-m is held by the driving control circuit 38. Moreover, at the timing P11, a sustaining voltage Vs is applied, as an erasing potential, to the sustaining electrodes 23-1 to 23-m by the driving control circuit 38. Next, for a time from the timing P11 to the timing P13, the sustaining voltage Vs applied to the sustaining electrodes 23-1 to 23-m is held by the driving control circuit 38. For a period from the timing P11 to the timing P13, the ground voltage GND applied to the data electrodes 29-1 to 29-n is held by the driving control circuit 38.

Driving waveforms applied during the scanning period 3 are described by referring to FIG. 3. For a period from the timing P13 to the timing P19, the sustaining voltage Vs applied to the sustaining electrodes 23-1 to 23-m is held by the driving control circuit 38. At the timing P13, a scanning base voltage Vbw is applied to the scanning electrodes 22-1 to 22-m by the driving control circuit 38. Next, for a period from the timing P13 to the timing P19, the scanning base voltage Vbw applied to the scanning electrodes 22-1 to 22-m is held by the driving control circuit 38. A lowest value of the scanning base voltage Vbw is set to be a ground voltage GND being an reference voltage and its peak value is set to be a set value (Vbw−GND) being lower than the sustaining voltage Vs. Next, while the scanning base voltage Vbw is being applied to the scanning electrodes 22-1 to 22-m, a scanning pulse potential 11 used to counter the scanning base voltage Vbw is applied sequentially to the scanning electrodes 22-1 to 22-m at the timing P14, P15, P16, and P17 by the driving control circuit 38. The scanning pulse potential 11 is a pulse potential having a negative polarity which lowers from the set value (Vbw−GND) being the peak value of the scanning base voltage Vbw to the ground voltage GND being the lowest value of the scanning base voltage Vbw. That is, when the scanning pulse potential 11 is applied to the scanning electrode 22-1 for a period from the timing P14 to the timing P15, and is applied to the scanning electrode 22-2 for a period from the timing P15 to the timing P16 and is applied to the scanning electrode 22-m for a period from the timing P17 to the timing P18, the scanning base voltage Vbw is not applied to the scanning electrode 22-1 for a period from the timing P14 to the timing P15 and is not applied to the scanning electrode 22-2 from a period from the timing P15 to the timing P16 and is not applied to the scanning electrode 22-m for a period from the timing P17 to the timing P18. When the scanning pulse potential 11 is applied to the scanning electrodes 22-1 to 22-m, a data pulse potential 12 corresponding to video data (display pattern) is applied to the data electrodes 29-1 to 29-n by the driving control circuit 38.

Driving waveforms applied during the scanning period 4 are described by referring to FIG. 3. By the driving control circuit 38, a ground voltage GND is applied, as a primary sustaining pulse potential being a sustaining pulse potential, to the scanning electrodes 22-1 to 22-m and a sustaining voltage Vs is applied, as a primary sustaining pulse potential being a sustaining pulse potential, to the sustaining electrodes 23-1 to 23-m. Thereafter, by the driving control circuit 38, up to the timing P20, the sustaining voltage Vs and ground voltage GND are alternately applied to the scanning electrodes 22-1 to 22-m and the ground voltage GND and sustaining voltage Vs are applied alternately to the sustaining electrodes 23-1 to 23-m. For a period from the timing P19 to the timing P20, the ground voltage GND is applied to the data electrode 29-1 to 29-n by the driving control circuit 38.

Figure 4A:
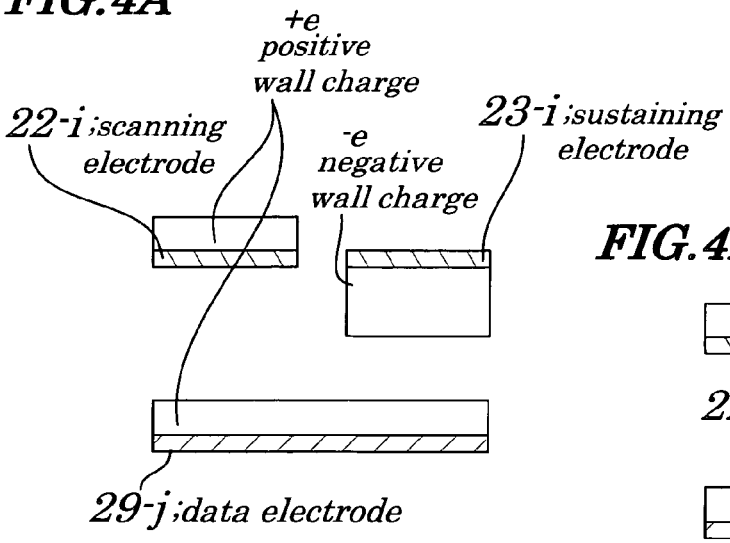
FIGS. 4A, 4B, 4C, 4D, 4E, 4F and 4G are diagrams illustrating arrangements of wall charges appearing at each timing shown in FIG. 3.

Next, roles of each of the periods in driving the plasma display device of the present invention are described by referring to FIG. 3. First, roles of the initializing period 2 are explained. Before the initializing period, a sustaining period in a pre-subfield 1 exists. Depending on whether or not sustaining discharge occurs in this pre-subfield 1, an amount of formation of wall charges that are accumulated on the dielectric layers (transparent dielectric layer 24 formed on the scanning electrode 22-i, transparent dielectric layer 24 formed on the sustaining electrode 23-i, and the white dielectric layer 28 formed on the data electrode 29-j) formed on each of the electrodes in the display cell 31 by discharge, varies. Despite the above state, if subsequent writing discharge is made to occur, due to influences exerted by different amounts of formation of wall charges, it is difficult to make writing discharge occur and/or writing discharge is caused to erroneously occur with timing with which writing discharge should not occur. During the sustaining period, discharge intensity is great. Because of this, if sustaining discharge occurs, a large amount of space charges are formed in the discharge space 26. The space charge are attracted by an electric field in the display cell 31 and is accumulated on the dielectric layer on each of the electrodes. Since an amount of the space charges is large, wall charges are accumulated on each of the electrodes in the display cell 31 so that the electric field in the display cell 31 becomes zero. At this point, wall charges accumulated on each of the electrodes, at the timing P1, is put into such a state (arrangement of charges) as shown in FIG. 4A, and positive wall charges (+e) are accumulated on all the scanning electrode 22-i and data electrode 29-j and negative wall charges (−e) are accumulated on all the sustaining electrode 23-i. By the formation of the above wall charges, wall voltages (voltages produced between the electrode and the dielectric layer by the wall charges) being almost equal to the sustaining voltage Vs have been formed on the scanning electrode 22-i and sustaining electrode 23-i.

Roles of the initializing period 2 are:

(1) to erase (initialize or reset) wall charges accumulated on the dielectric layer in each of the display cells 31 in a light emitting state during the sustaining period in the pre-subfield 1, and (2) to cause priming effects to be produced in order to achieve easy occurrence of writing discharge when video data is written in a pixel (display cell 31) during the scanning period 3.

(3) to cause writing discharge during the scanning electrode 3 to normally occur irrespective of display load at a data pulse potential being lower compared with the conventional case. In the above first role (1), by erasing (initializing or resetting) wall charges, a pixel (display cell 31) is forcedly discharged. During the initializing period 2, the above third role (3) is performed during the wall charge adjusting period 6 and the first role (1) is performed during the sustaining erasing period 8 and the above second role (2) is performed during both the priming period 9 and the priming erasing period 10.

During the wall charge adjusting period 6 and sustaining erasing period 8, discharge occurs only when sustaining discharge had occurred in the pre-subfield 1. During the priming period 9 and the priming erasing period 10, discharge occurs irrespective of whether or not the sustaining discharge had occurred in the pre-subfield 1.

Figure 4B:
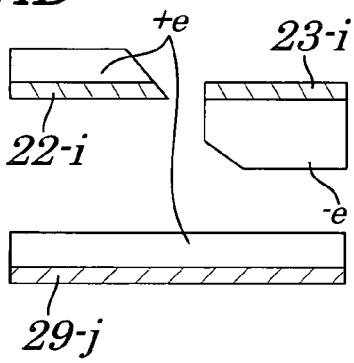

Next, roles of the wall charge adjusting period 6 are described by referring to FIG. 3. When the period is shifted from its sustaining period in the pre-subfield 1 to its first wall charge adjusting period 13 in the wall charge adjusting period 6, the sustaining voltage Vs having been applied to the sustaining electrode 23-i is lowered to a wall charge adjusting voltage Vss. At this time, a potential difference (first wall charge adjusting period potential difference) to be applied to the discharge space 26 between the scanning electrode 22-i and the sustaining electrode 23-i gradually increases, causing feeble discharge (wall charge adjusting discharge) to occur in a sustained manner. Since intensity of the feeble discharge (wall charge adjusting discharge) is low than that of the sustaining discharge, the wall charge adjusting discharge occurs only in the vicinity of the discharge gap 34. At this time, wall charges accumulated in a portion being in the vicinity of the discharge gap 34 on the scanning electrode 22-i and the sustaining electrode 23-i decrease and wall charges accumulated on each electrode are put, at the timing P4, in such a state (arrangements of charges) as shown in FIG. 4B. That is, positive wall charges (+e) accumulated in the portion being in the vicinity of the discharge gap 34 on the scanning electrode 22-i and negative wall charges (−e) accumulated in the portion being in the vicinity of the discharge gap 34 on the sustaining electrode 23-i decrease. When the period is shifted from its first wall charge adjusting period 13 in the wall charge adjusting period 6 to its second wall charge adjusting period 14, the sustaining electrode 23-i is connected to a GND (that is, the voltage applied to the sustaining electrode 23-i becomes a ground voltage GND). At this time, a potential difference (second wall charge adjusting period potential difference) to be applied to the discharge space 26 between the scanning electrode 22-i and the sustaining electrode 23-i rapidly changes and discharge (wall charge adjusting discharge) whose intensity of discharge is slightly higher than that of the wall charge adjusting discharge occurred during the first wall charge adjusting period 13 and whose intensity of the discharge is lower than that of the sustaining discharge occurs between the scanning electrode 22-i and the sustaining electrode 23-i.

Here, the discharge occurring during the second wall charge adjusting period 14 is described by referring to the sustaining discharge occurring during the sustaining period 4. Intensity of the sustaining discharge is great during the sustaining period 4. Due to this, when a sustaining pulse potential (sustaining voltage Vs) is applied to the sustaining electrode 23-i, the sustaining discharge occurs. At this time, in the discharge gap 34 between the scanning electrode 22-i and the sustaining electrode 23-i, wall charges (voltages produced by the wall charges between the electrode and the dielectric layer) being almost equal to the sustaining voltage Vs is formed. When a subsequent sustaining pulse potential having reversed polarity is applied to the sustaining electrode 23-i (at this time, the sustaining voltage Vs being a sustaining pulse potential is applied to the scanning electrode 22-i), the wall voltage (sustaining voltage) Vs is superimposed on the sustaining pulse potential (sustaining voltage) Vs and a voltage being about 2 Vs is applied between the scanning electrode 22-i and the sustaining electrode 23-i (that is, in the discharge gap 34). On the other hand, during the first wall charge adjusting period 13, wall charges applied in the discharge gap 34 between the scanning electrode 22-i and the sustaining electrode 23-i during the sustaining period have decreased by feeble discharge (wall charge adjusting discharge) and have become smaller than the sustaining voltage Vs. Therefore, in the second wall charge adjusting period 14, when the sustaining electrode 23-i is connected to a GND (at this time, the sustaining voltage Vs has been applied to the scanning electrode 22-i), even if the wall charges are superimposed on the sustaining voltage Vs, a voltage being applied in the discharge gap 34 becomes smaller than 2 Vs. As a result, intensity of the discharge (wall charge adjusting discharge) occurring during the second wall charge adjusting period 14 is lower than that of the sustaining discharge.

Figure 4C:
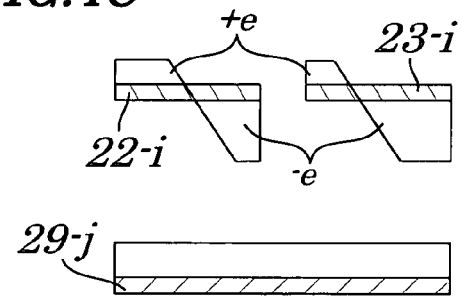

Due to this, wall charges accumulated on the scanning electrode 22-i and the sustaining electrode 23-i are not replaced completely with new wall charges at the timing P1, and put into such a state (charge displacement) as shown in FIG. 4C. That is, only polarities of the positive wall charges (+e) and negative wall charges (−e) accumulated in the vicinity of the discharge gap 34 on the scanning electrode 22-i and the sustaining electrode 23-i are reversed and positive wall charges (+e) and negative wall charges (−e), which are wall charges having polarities occurring before the discharge during the second wall charge adjusting period 14, are left on the scanning electrode 22-i and the sustaining electrode 23-i being positioned far from the discharge gap 34. Intensity of the discharge during the second wall charge adjusting period 14 depends on the wall charge adjusting voltage Vss and the lower the wall charge adjusting voltage Vss is, the more wall charges existing in the vicinity of the discharge gap 34 during the first wall charge adjusting period 13 decrease and therefore discharge thereafter occurring during the second wall charge adjusting period 14 becomes feeble. The more feeble the discharge becomes, the more negative wall charges (−e) on the sustaining electrode 23-i are left.

Figure 4D:
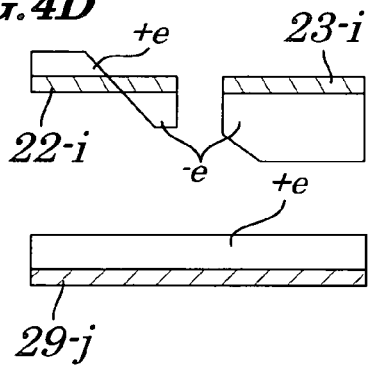

Next, roles of the sustaining erasing period 8, the priming period 9, and the priming erasing period 10 are described. When the period is shifted from its wall charge adjusting period 6 (being made up of a first wall charge adjusting period 13 and a second wall charge adjusting period 14) to its sustaining erasing period 8, a potential difference (sustaining erasing period potential difference) being applied in the discharge space 26 between the scanning electrode 22-i and the sustaining electrode 23-i gradually increases, thus causing feeble discharge to occur in a sustained manner. Since intensity of the feeble discharge is low, the feeble discharge occurs only in the vicinity of the discharge gap 34. At this time, a voltage having the ramp waveform described above is being applied to the scanning electrode 22-i, wall charges accumulated in a portion being in the vicinity of the discharge gap 34 on the scanning electrode 22-i and the sustaining electrode 23-i decrease and wall charges being accumulated on each electrode, at the timing P8, are put in such a state (arrangements of charges) as shown in FIG. 4D. That is, when negative wall charges (−e) accumulated in a portion being in the vicinity of the discharge gap 34 on the scanning electrode 22-i and positive wall charges (+e) accumulated in a portion being in the vicinity of the discharge gap 34 on the sustaining electrode 23-i decrease, negative wall charges (−e) have been accumulated in a portion being in the vicinity of the discharge gap 34 on the scanning electrode 22-i, positive wall charges (+) have been accumulated on the scanning electrode 22-i in a portion being far from the discharge gap 34, and negative wall charges have been accumulated in the portion being in the vicinity of the discharge gap 34 on the sustaining electrode 23-i.

Figure 4E:
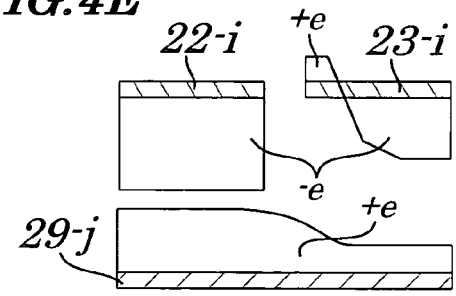

When the period is shifted from its sustaining erasing period 8 to its priming period 9, since a voltage having the ramp waveform (priming waveform) described above is being applied to the scanning electrode 22-i, in addition to feeble discharge occurring between the scanning electrode 22-i and the sustaining electrode 23-i, feeble discharge occurs between the scanning electrode 22-i and the data electrode 29-j. At this time, priming particles are formed by the feeble discharge in the discharge space 26 and the display cell 31 is activated and put into a state where discharge occurs easily. At the same time, wall charges are accumulated in a portion being in the vicinity of the discharge gap 34 on the scanning electrode 22-i, the sustaining electrode 23-i, and the data electrode 29-j and wall charges to be accumulated on each electrode, at timing P10, are put into such a state (arrangements of charges) as shown in FIG. 4E. That is, positive wall charges accumulated in a portion being far from the discharge gap 34 on the scanning electrode 22-i and negative wall charges accumulated in the portion being in the vicinity of the discharge gap 34 on the sustaining electrode 23-i decrease, negative wall charges (−e) are accumulated in all portions on the scanning electrode 22-i and positive wall charges (+e) are accumulated in a portion being in the vicinity of the discharge gap 34 on the sustaining electrode 23-i and positive wall charges (+e) are further accumulated both in portions being in the vicinity of the discharge gap 34 on the data electrode 29-j and on a face being opposite to the scanning electrode 22-i. Thus, in the priming period 9, insufficient negative wall charges (−e) on the scanning electrode 22-i are compensated for.

Figure 4F:
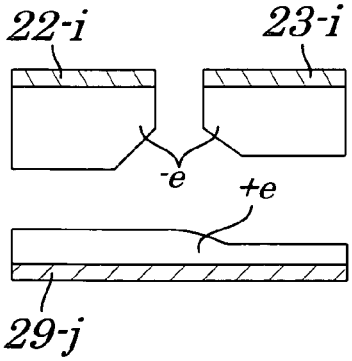

When the period is shifted from its priming period 9 to its priming erasing period 10, since a voltage having the ramp waveform as described above is being applied to the scanning electrode 22-i, feeble discharge occurs in the vicinity of the discharge gap 34. At this time, wall charges accumulated in a portion being in the vicinity of the discharge gap 34 on the scanning electrode 22-i, sustaining electrode 23-i, and data electrode 29-j decrease and wall charges to be accumulated on each electrode, at the timing P12, is put into such a state (arrangements of charges) as shown in FIG. 4F. That is, negative wall charges (−e) accumulated in a portion being in the vicinity of the discharge gap 34 on the scanning electrode 22-i, positive wall charges (+e) accumulated in a portion being in the vicinity of the discharge gap 34 on the sustaining electrode 23-i, and positive wall charges (+e) accumulated in a portion being in the vicinity of the discharge gap 34 on the data electrode 29-j decrease and negative wall charges (−e) are accumulated in a portion being in the vicinity of the discharge gap 34 on the sustaining electrode 23-i. Due to this state, wall voltages in the vicinity of the discharge gap 34 between the scanning electrode 22-i and the sustaining electrode 23-i are almost at the same level. Therefore, according to the plasma display device of the present invention, when a sustaining pulse potential is applied while the display cell is not in a light-emitting state, no erroneous discharge (erroneous light emitting) occurs. Thus, during the priming erasing period 10, wall charges accumulated, during the priming period 9, in a portion being in the vicinity of the discharge gap 34 on the scanning electrode 22-i and the sustaining electrode 23-i are erased and wall charges being accumulated between facing electrodes existing between the scanning electrode 22-i and the data electrode 29-j are adjusted by feeble discharge occurring in the vicinity of the discharge gap 34.

Thus, in the plasma display device of the present invention, as shown in FIG. 4F, before occurrence of writing discharge, negative wall charges (−e) have been accumulated in advance on the scanning electrode 22-i and sustaining electrode 23-i. Therefore, according to the plasma display device of the present invention, unlike in the case of the conventional plasma display device, no current to be used for reverse the positive wall charges (+e) accumulated on the sustaining electrode 123-i to be changed to negative wall charges (−e) by writing discharge is required and thus an amount of the current (writing current) required for causing the writing discharge to occur can be reduced.

Figure 4G:
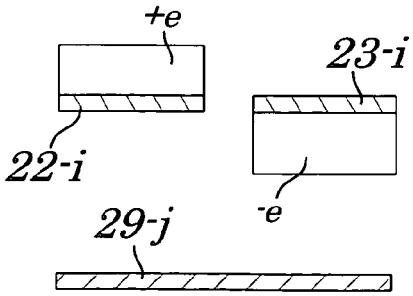

Next, roles of the scanning period 3 are described. The driving control circuit 38, in order to write video data in an address (display cell 31) by causing writing discharge to occur between the scanning electrode 22-i and the data electrode 29-j during the scanning period 3, applies a data pulse potential 12 corresponding to video data (display pattern) to the data electrodes 29-1 to 29-n when applying a scanning pulse potential 11 to the scanning electrode 22-1 to 22-m. Wall charges being accumulated at this time on each electrode is in such a state (arrangements of charges) as shown in FIG. 4G. That is, negative wall charges (−e) accumulated on the scanning electrode 22-i and positive wall charges (+e) accumulated on the data electrode 29-j decrease and positive wall charges (+e) are accumulated on all portions on the scanning electrode 22-i and negative wall charges (−e) are further accumulated in a portion being in the vicinity of the discharge gap 34 on the sustaining electrode 23-i.

In a cell (made up of display cells 31) in which the data pulse potential 12 is applied to the data electrodes 29-1 to 29-n, wall charges are superimposed on voltages in the discharge space 26 between the scanning electrode 22-i and the data electrode 29-j, which causes a voltage exceeding a discharge initiating voltage to be applied to the scanning electrode 22-i and the data electrode 29-j. As a result, writing discharge occurs between the scanning electrode 22-i and the data electrode 29-j. A difference in potential between the scanning electrode 22-i and the sustaining electrode 23-i occurring when the writing discharge occurred is "Vs". When such the difference in potential exists, when the writing discharge occurs between the scanning electrode 22-i and the data electrode 29-j, surface discharge is induced between the scanning electrode 22-i and the sustaining electrode 23-i. At this time, negative wall charges (−e) are accumulated on the sustaining electrode 23-i and positive wall charges (+e) are accumulated on the scanning electrode 22-i and arrangements of the wall charges being accumulated on each electrode are changed, at the timing P19, from the state shown in FIG. 4F to the state shown in FIG. 4G. On the other hand, in a cell (made up of display cells 31) in which the data pulse potential 12 is not applied to the data electrodes 29-1 to 29-n, since a discharge initiating voltage is not exceeded, no writing discharge occurs and wall discharges accumulated on each electrode remain in the state (arrangements of charges) as shown in FIG. 4F. Thus, depending on existence or absence of the data pulse potential 12 to be applied to the data electrodes 29-1 to 20-n, it is possible to produce two kinds of states (arrangements of charges) of wall charges.

Next, roles of the sustaining period 4 are described. The driving control circuit 38, after having completed application of the scanning pulse potential 11 to all lines (scanning electrodes 22-1 to 22-m), in order to cause sustaining discharge which makes the display cell 31 in which writing discharge has occurred emit light so as to correspond to video data to occur between the scanning electrode 22-i and the sustaining electrode 23-i, shifts the period from its scanning period 3 to its sustaining period 4. The sustaining voltage Vs is alternately applied, as the sustaining pulse potential, to the scanning electrodes 22-1 to 22-m and the sustaining electrodes 23-1 to 23-m. In a display cell 31 in which no writing discharge occurs, the sustaining voltage Vs (sustaining pulse potential) is set to be a voltage at which no discharge (surface discharge) starts to occur between the scanning electrode 22-i and the sustaining electrode 23-i.

In a display cell 31 in which writing discharge occurred, positive wall charges (+e) have been accumulated on the scanning electrode 22-i and negative wall charges (−e) have been accumulated on the sustaining electrode 23-i. Therefore, this positive and negative wall charges are superimposed on a first positive sustaining pulse potential (first sustaining pulse potential) being applied to the scanning electrode 22-i. At this time, a voltage exceeding a discharge initiating voltage is applied to the discharge space 26, causing sustaining discharge to occur. By this sustaining discharge, negative wall charges are accumulated on the scanning electrode 22-i and positive wall charges are accumulated on the sustaining electrode 23-i. The wall voltage is superimposed on a subsequent sustaining pulse potential (second sustaining pulse potential) to be applied to the sustaining electrode 23-i. At this time, a voltage exceeding a discharge initiating voltage is applied to the discharge space 26, causing sustaining discharge to occur. By this sustaining discharge, wall charges having a polarity opposite to that of the first sustaining pulse potential is accumulated on the scanning electrode 22-i and the sustaining electrode 23-i. That is, positive wall charges are accumulated on the scanning electrode 22-i and negative wall charges are accumulated on the sustaining electrode 23-i. By alternate application of the sustaining voltage Vs (sustaining pulse potential) to the scanning electrodes 22-1 to 22-m and the sustaining electrodes 23-1 to 23-m until the sustaining period terminates, the sustaining discharge is made to occur in a sustained manner. During the sustaining period 4, a potential difference caused by the wall charge occurred by x-th (x=1, 2, 3, . . . ) time sustaining discharge is superimposed on the (x+1)-th time sustaining pulse potential, which causes the sustaining discharge to occur in a sustained manner. According to the number of times of the sustaining discharge, light emitting luminance is determined.

When gray-level display is performed, one field during which one screen of image information is displayed is made up of a plurality of the sub-fields 5 (each including the initializing period 2, scanning period 3, and the sustaining period 4). The gray-level display is made possible by changing the number of potentials of the sustaining pulse in each of the sub-fields 5 and by causing a display cell to emit light or not in each of the sub-fields 5.

Next, driving waveforms applied for driving the plasma display device of the first embodiment of the present invention are described by using specified values. A voltage of 170 V is used as the sustaining voltage Vs. First, operations during the initializing period 2 are described.

Figure 5:
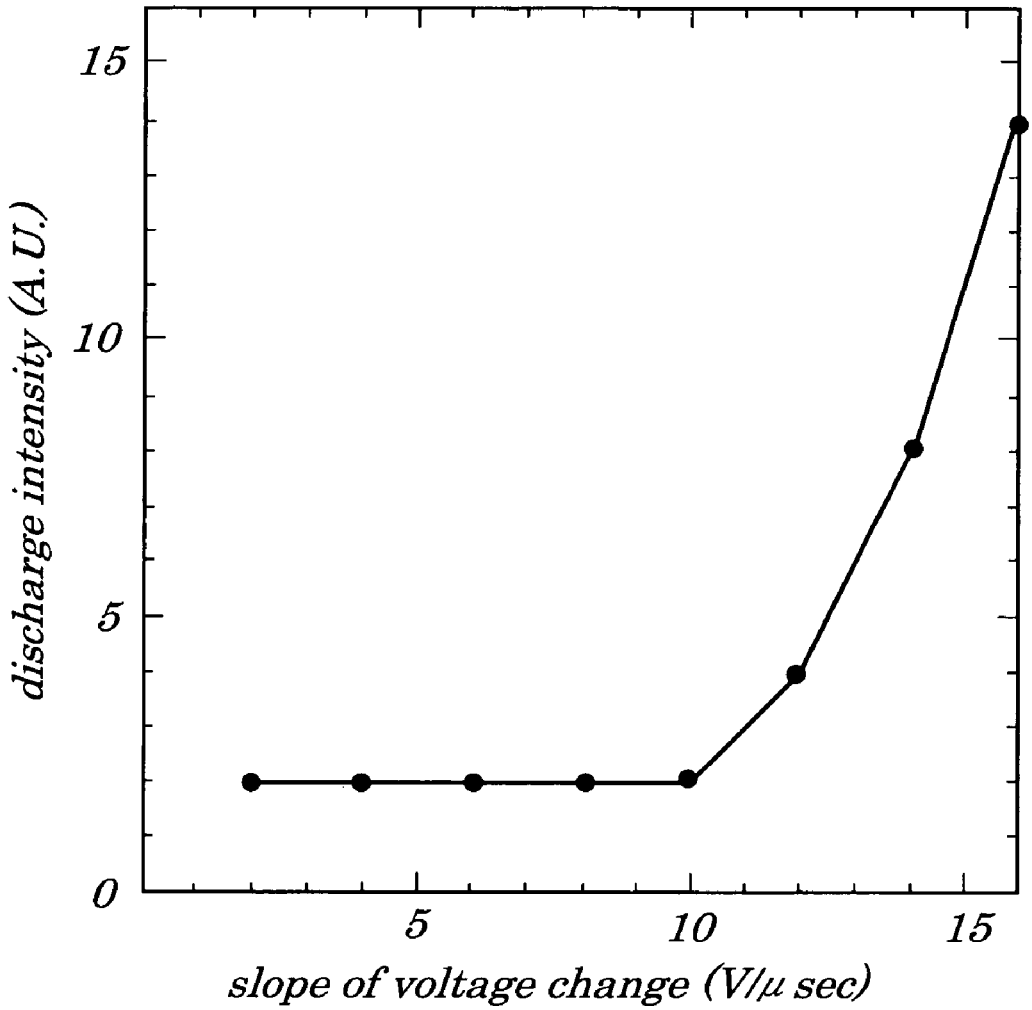
FIG. 5 is a diagram showing a relation between a change ratio indicating an average rate of change in a sustaining voltage to be applied to a sustaining electrode during a first wall charge adjusting period in a wall charge adjusting period that occurs from time at which the sustaining voltage begins to lower to time at which it lowers fully to a wall charge adjusting voltage and discharge intensity obtained by observation of light emitting waveform.

FIG. 5 is a diagram showing a relation between a change ratio indicating an average rate of change in a voltage to be applied to the sustaining electrode 23-i during a first wall charge adjusting period 13 in the wall charge adjusting period 6 that occurs from time (timing P3) at which the sustaining voltage Vs begins to lower to time (timing P4) at which it lowers fully to a wall charge adjusting voltage Vss and discharge intensity obtained by observation of light emitting waveforms. During the first wall charge adjusting period 13, when the change ratio becomes high than 10 [V/μsec], discharge intensity rapidly becomes great. In the case of occurrence of such the discharge, the discharge occurs intermittently or in a one-shot manner and no discharge occurs during the second wall charge adjusting period 14 (that is, no continuous feeble discharge occurs). Moreover, occurrence of the discharge varies depending on a state of a surface of the scanning electrode 22-i and the sustaining electrode 23-i and the discharge occurs in some display cells 31 and does not occur in some display cells 31. Therefore, in the present invention, the change ratio during the first wall charge adjusting period 13 is set to be 10 [V/μsec] or less, specifically, about 3 [V/μsec] to 6 [V/μsec]. Moreover, if the wall charge adjusting voltage Vss becomes less than 17 V, even when the sustaining electrode 23-1 is connected to a GND, no discharge occurs any more. If no discharge occurs, wall charges being accumulated on each electrode remain in the state as shown in FIG. 4B and many positive wall charges (+e) remain left on the scanning electrode 22-i. In such the state, if such a voltage as the priming voltage Vp having a positive polarity and being higher than the sustaining voltage Vs is applied to the scanning electrode 22-i and the data electrode 29-i, intense discharge occurs in an unstable state, causing erroneous light emitting. Therefore, in the present invention, the wall charge adjusting voltage Vss is set to be about 25 V to 50 V.

Figure 6:
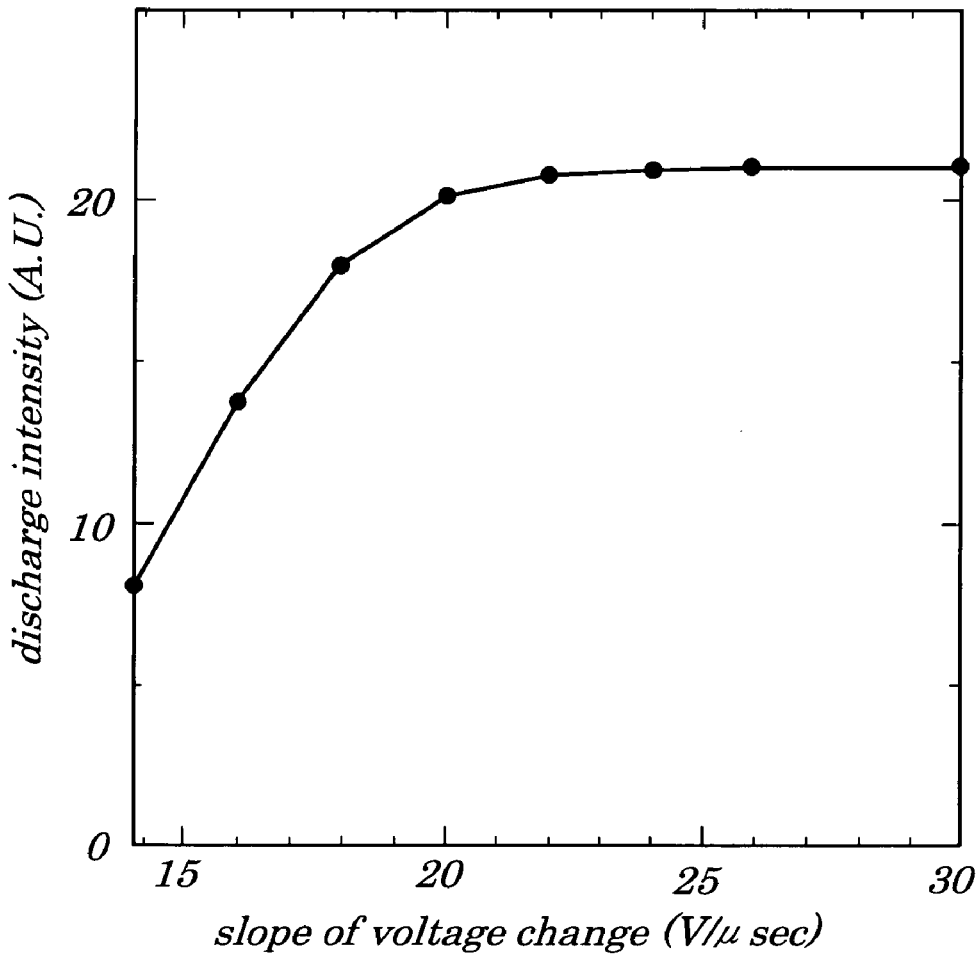
FIG. 6 is a diagram showing a relation between a change ratio indicating an average rate of change in a wall charge adjusting voltage to be applied to a sustaining electrode during a second wall charge adjusting period in a wall charge adjusting period that occurs from time at which the wall charge adjusting voltage begins to lower to time at which it lowers fully to a ground voltage and discharge intensity obtained by observation of light emitting waveform.

FIG. 6 is a diagram showing a relation between a change ratio indicating an average rate of change in a voltage to be applied to the sustaining electrode 23-i during the second wall charge adjusting period 14 in the wall charge adjusting period 6 which occurs from time (timing P5) at which the wall charge adjusting voltage Vss begins to lower to time (timing P5) at which it lowers fully to a ground voltage GND and discharge intensity obtained by observation of light emitting waveform. During the second wall charge adjusting period 14, if the change ratio becomes less than 20 [V/μsec], discharge rapidly becomes feeble and occurrence of the discharge becomes unstable on the scanning electrode 22-i and the sustaining electrode 23-I, as not desirable. Therefore, in the present invention, the change ratio during the second wall charge adjusting period 14 is set to be 20 [V/μsec] or more and, specifically, about 40 [V/μsec] to 80 [V/μsec].

Figure 7:
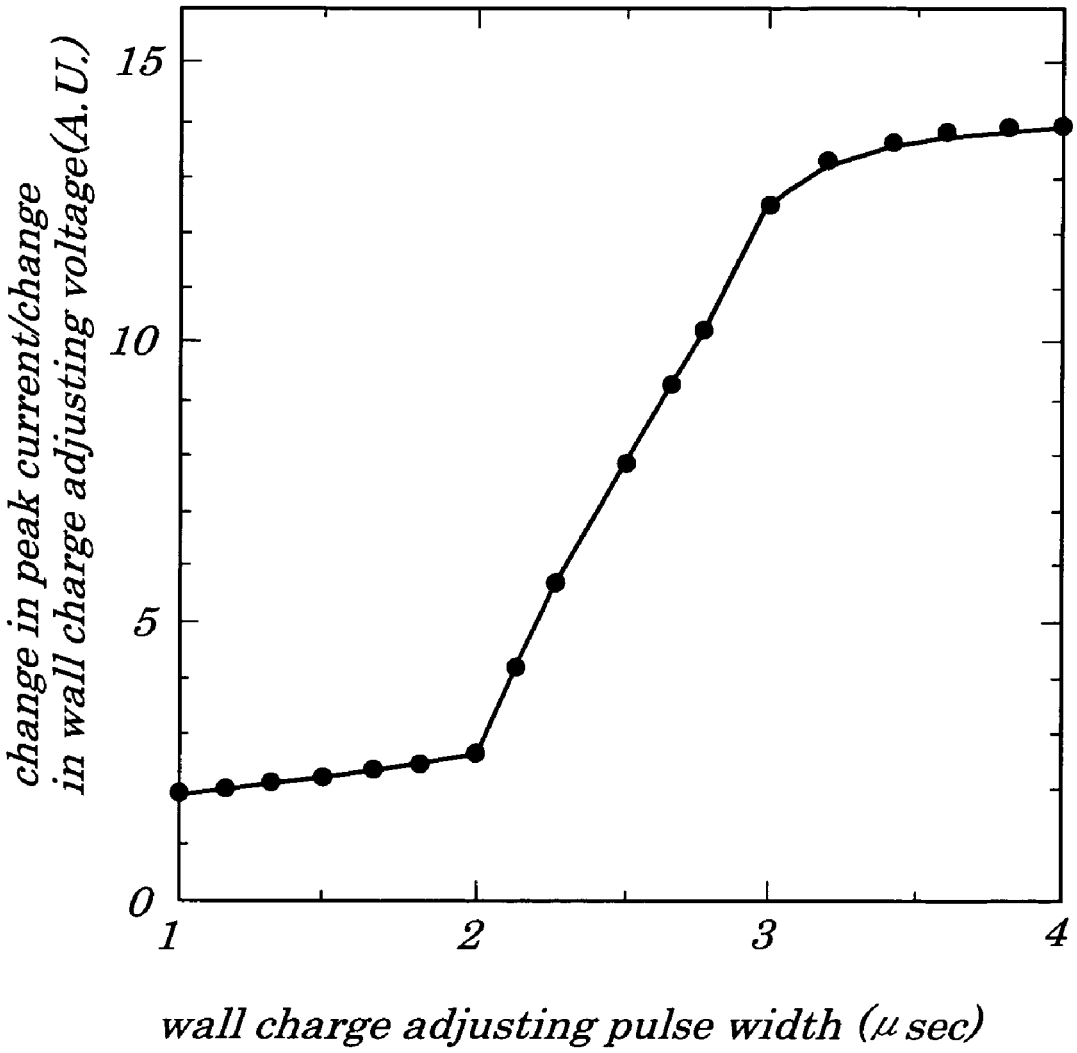
FIG. 7 is a diagram showing a relation between a ratio of change in a peak value of a writing current to a wall charge adjusting voltage and a wall charge adjusting pulse width.

FIG. 7 is a diagram showing a relation between a ratio of change in peak value of a writing current to the wall charge adjusting voltage Vss and the wall charge adjusting pulse width. When the wall charge adjusting pulse width is 2 [μsec] or more, as shown in FIG. 7, a peak value of a writing current comes to depend greatly upon the wall charge adjusting voltage Vss. Due to this, a region in which peak values of a writing current are small is put within a narrow range to the wall charge adjusting voltage_Vss, which causes a driving margin to become narrow. Therefore, it is preferable that the wall charge adjusting pulse width is less_than 2 [μsec]. Thus, according to the present invention, the wall charge adjusting pulse width during the second wall charge adjusting period 14 is set to be less than 2 [μsec], specifically, about 1 [μsec].

If a change ratio indicating an average rate of change (slope of voltage change) in a voltage to be applied to the scanning electrode 22-i for a period from the timing P7 to the timing P8 during the sustaining erasing period 8 which occurs from time (timing P7) at which the sustaining voltage Vs begins to lower to time (timing P8) at which it lowers fully to a ground voltage GND, becomes larger than 10 [V/μsec], discharge intensity rapidly becomes great, as in the case of the first wall charge adjusting period 13. In the case of occurrence of such the discharge, the discharge occurs intermittently or in a one-shot manner and no discharge occurs any more, as in the case of the first wall charge adjusting period 13. Thus, in the present invention, the change ratio during the sustaining erasing period 8 is set to be 10 [μsec] or less, specifically, about 3 [V/μsec] to 6 [V/μsec].

In the present invention, a crest value of a priming voltage Vp to be applied to the scanning electrode 22-i during the priming period 9 is set to be about 380 V to 450 V. According to the present invention, a change ratio, which indicates an average rate of change (slope of voltage change) in a voltage to applied to the scanning electrode 22-i for a period from the timing P9 to the timing P10 during the priming period 9 that occurs from time (timing P9) at which the sustaining voltage Vs begins to rise to time (timing P10) at which it rises fully to a priming voltage Vp, is set to be 10 [μsec] or less, specifically, about 3 [V/μsec] to 6 [V/μsec].

According to the present invention, a change ratio, which indicates an average rate of change (slope of voltage change) in a sustaining voltage Vs to be applied to the scanning electrode 22-i for a period from the timing P11 to the timing P12 during the priming erasing period 10 that occurs from time (timing P11) at which the sustaining voltage Vs begins to lower to time (timing P12) at which it lowers fully to a ground voltage GND, is set to be 10 [V/μsec] or less, specifically, about 3 [V/μsec] to 6 [V/μsec], as in the case of the sustaining erasing period 8.

Next, operations during the scanning period 3 are described. In the present invention, a scanning base voltage Vbw to be applied to the scanning electrodes 22-1 to 22-m is set to be about 80 V to 120 V. While the scanning base voltage Vbw is being applied to the scanning electrodes 22-1 to 22-m, the scanning pulse potential 11 is sequentially applied to the scanning electrodes 22-1 to 22-m. In the present invention, a scanning pulse width during which the scanning pulse potential 11 is applied to the scanning electrode 22-i is set to be about 2 [μsec]. That is, while the scanning pulse potential 11 is applied to the scanning electrode 22-i for a period of 2 [μsec], the scanning base potential Vbw is not applied to the scanning electrode 22-i for the period of 2 [μsec]. In the present invention, a data pulse potential 12 to be applied to the data electrode 29-j is set to be 60 V or so.

Next, operations during the sustaining period 4 are described. Occurrence of sustaining discharge is delayed, at application of a potential of a first sustaining pulse which is a first sustaining pulse potential being applied to the scanning electrode 22-i out of sustaining voltages Vs (sustaining pulse potentials) being applied alternately to the scanning electrodes 22-1 to 22-m and the sustaining electrodes 23-1 to 23-m during the sustaining period 4. Therefore, a sustaining pulse potential width being a period during which the first sustaining pulse potential is applied to the scanning electrode 22-i is set to be 7 [μsec] and is also set to be wider (longer) than other sustaining pulse potential width. Sustaining pulse potential widths of a second sustaining pulse potential being a subsequent sustaining pulse potential to be applied to the sustaining electrode 23-i and of other succeeding sustaining pulse potential thereafter are set to be 2 [μsec].

By applying the above driving waveforms (voltage), a writing current flowing into the scanning electrodes 22-1 to 22-m (one line) at time of causing writing discharge to occur in the plasma display device of the present invention and a writing current flowing into the scanning electrodes 22-1 to 22-m (one line) at time of causing writing discharge to occur in the conventional plasma display device were actually measured. According to the actual measurement carried out in the prevent invention, a peak value of the writing current is lowered to 50% or less of the peak value of the writing current in the conventional plasma display device. Therefore, according to the present invention, it is possible to reduce a voltage drop occurring when a resistance (scanning electrode wiring resistance: display load) produced by wiring on the scanning electrodes 22-1 to 22-m is high and when current supplying capability of a scanning driver is small. As a result, it is possible to make writing discharge occur at a potential of a data pulse 12 which is lowered by about 5 V than the data pulse potential 112 used in the conventional plasma display device. Thus, according to the plasma display device of the present invention, writing discharge is made to occur stably and normally irrespective of display load and at a data pulse potential being lower than that employed in the conventional plasma display device.

In the present invention, it is not necessary to set a data pulse potential to be higher than the data pulse potential 112 used in the conventional plasma display device or not necessary to set current supplying capability of a scanning driver to be higher than that employed in the conventional plasma display device. Therefore, in the present invention, costs caused by driving (operating) the plasma display device can be reduced more compared with the case of the conventional plasma display device. In the plasma display device of the present invention, it is not necessary to make a scanning electrode wiring resistance lower than that employed in the conventional plasma display device. Therefore, to increase a film thickness of the scanning electrode 22-i is not required, which enables reduction of costs for manufacturing the plasma display device of the present invention.

Second Embodiment

Figure 8:
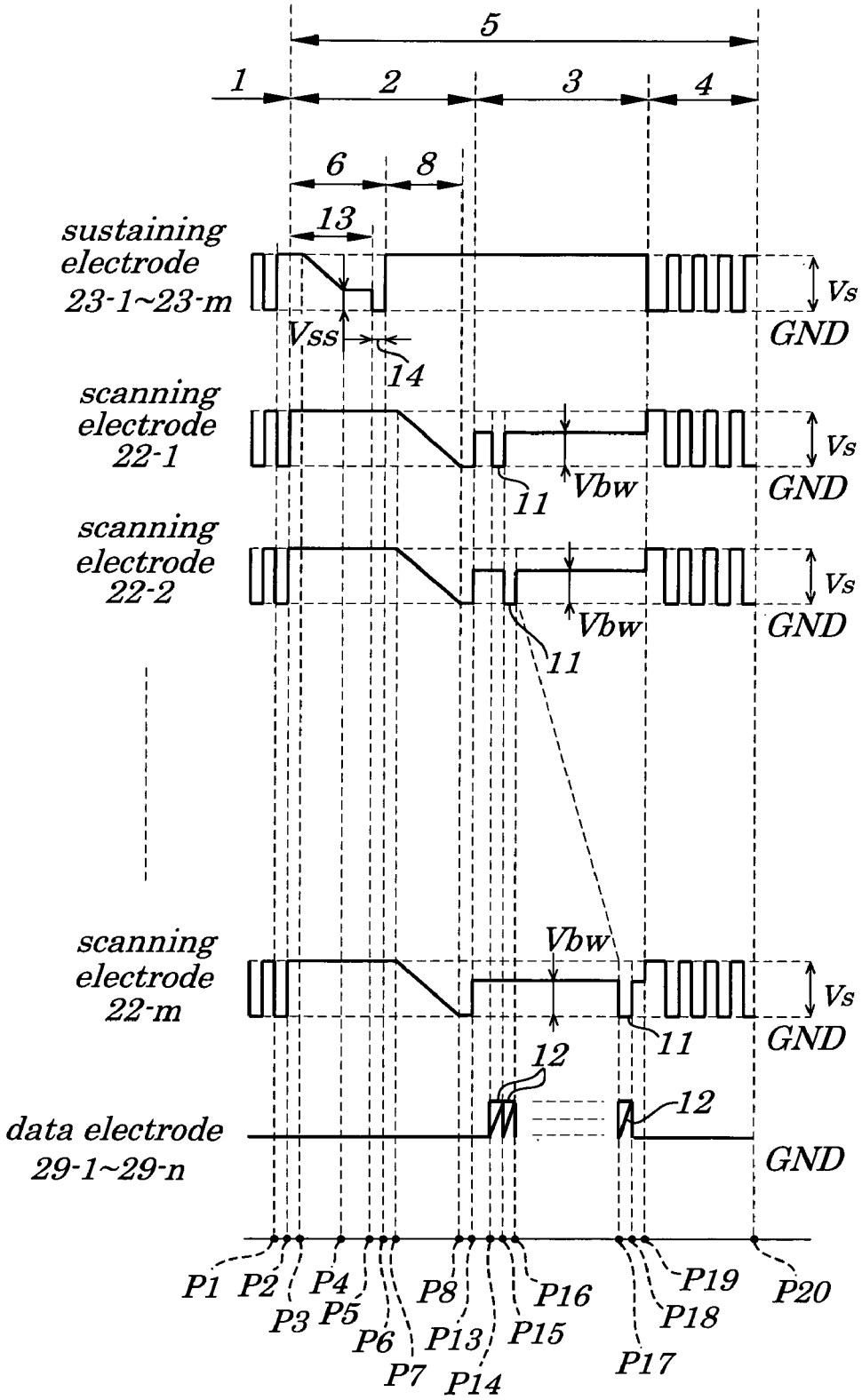
FIG. 8 is a timing chart showing modified waveforms of voltages applied for driving a plasma display device according to a second embodiment of the present invention.

FIG. 8 is a timing chart showing waveforms of voltages applied for driving a plasma display device according to a second embodiment of the present invention. As shown in FIG. 8, a driving method for the plasma display device (driving method for a PDP) of the second embodiment is a modified example of the first embodiment and, in the second embodiment, descriptions that duplicate contents described in the first embodiment are omitted accordingly. An initializing period 2 in at least one sub-field 5 making up a plurality of the sub-fields 5 during which operations are performed in order by the driving control circuit 38 does not includes the priming period 9 and the priming erasing period 10 included in the conventional method.

In the second embodiment, the initializing period 2 includes timing P2, P3, P4, P5, P6, P7, P8, and P13 following timing P1. Also, the initializing period 2 includes a wall charge adjusting period 6 (being made up of a first wall charge adjusting period 13 and a second wall charge adjusting period 14) and a sustaining erasing period 8. The wall charge adjusting period 6 includes a period from the timing P2 to the timing P6. The sustaining erasing period 8 includes a period from the timing P6, P7, P8, and P13.

Driving waveforms (ramp waveforms applied to electrodes during the sustaining erasing period 8) applied during the sustaining erasing period 8 in the initializing period 2 are described by referring to FIG. 8. For a period from the timing P6 to the timing P7, a sustaining voltage Vs having been applied to scanning electrodes 22-1 to 22-m is held, as an erasing voltage, by a driving control circuit 38. During a period from the timing P7 to the timing P9, the sustaining voltage Vs to be applied to the scanning electrodes 22-1 to 22-m is gradually lowered to a ground voltage GND by the driving control circuit 38. Then, for a period from the timing P8 to the timing P13, the ground voltage GND applied to the scanning electrodes 22-1 to 22-m is held by the driving control circuit 38. Also, after a sustaining voltage Vs has been applied as an erasing potential to sustaining electrodes 23-1 to 23-m at the timing P6 by the driving control circuit 38, for a period from the timing P6 to the timing P13, the sustaining voltage Vs applied to the sustaining electrodes 23-1 to 23-m is held by the driving control circuit 38. A ground voltage GND applied to data electrodes 29-1 to 29-n is held for a period from the timing P6 to the timing P13 by the driving control circuit 38.

Next, roles of each period used for the plasma display device of the second embodiment are described.

The sub-field 5 of the first embodiment is made up of the initializing period 2 including the wall charge adjusting period 6, sustaining erasing period 8, priming period 9, and priming erasing period 10, the scanning period 3, and the sustaining period 4. However, the sub-field 5 of the second embodiment is made up of the initializing period 2 not including the priming period 9 and priming erasing period 10 included in the initializing period employed in the first embodiment, the scanning period 3, and the sustaining period 4 (being called a "priming thinning-out period").

During the priming period 9 of the first embodiment, since a voltage exceeding a discharge initiating voltage is applied to scanning electrodes 22-i and sustaining electrode 23-i, discharge occurs irrespective of whether sustaining discharge occurred in a pre-subfield 1. When discharge occurs during the priming period 9, discharge also occurs by wall charges produced by the discharge during the priming erasing period 10. When black display is performed, its luminance of the black display is determined depending on the discharge occurring during the priming period 9 and priming erasing period 10. Therefore, in the second embodiment, the luminance of black display can be lowered by thinning-out of the priming period 9 and priming erasing period 10. If the luminance of the black display can be lowered, contrast for display can be improved. By the improvement of the display contrast, display quality is improved.

In the first embodiment, during the priming period 9, as shown in FIG. 4E, more negative wall charges (−e) are accumulated on the scanning electrode 22-i. When the priming thinning-out is carried out, no negative wall charges (−e) are accumulated on all portions on the scanning electrode 22-i. Therefore, in the second embodiment, wall charges being accumulated on each electrode immediately before writing discharge are put into such a state (arrangements of charges) as shown in FIG. 4D. According to the plasma display device of the second embodiment, since, immediately before the writing discharge, negative wall charges (−e) have been accumulated in a portion being in the vicinity of the discharge gap 34 on the sustaining electrode 23-i and negative wall charges (−e) have been accumulated in a portion being in the vicinity of the discharge gap 34 on the sustaining electrodes 23-i, unlike in the case of the conventional plasma display device, a current to be used for reversing positive wall charges (+) accumulated on the sustaining electrode 23-i to be negative wall charges (−e) by writing discharge is not required, which enables reduction of the current (writing current) required for causing writing discharge to occur more compared with the case of the conventional plasma display device. As a result, an experiment shows that, in the second embodiment, writing discharge is made to normally occur even at the data pulse potential 12 being lower by about 3 V than the data pulse potential 112 applied in the conventional plasma display device.

Third Embodiment

Figure 9:
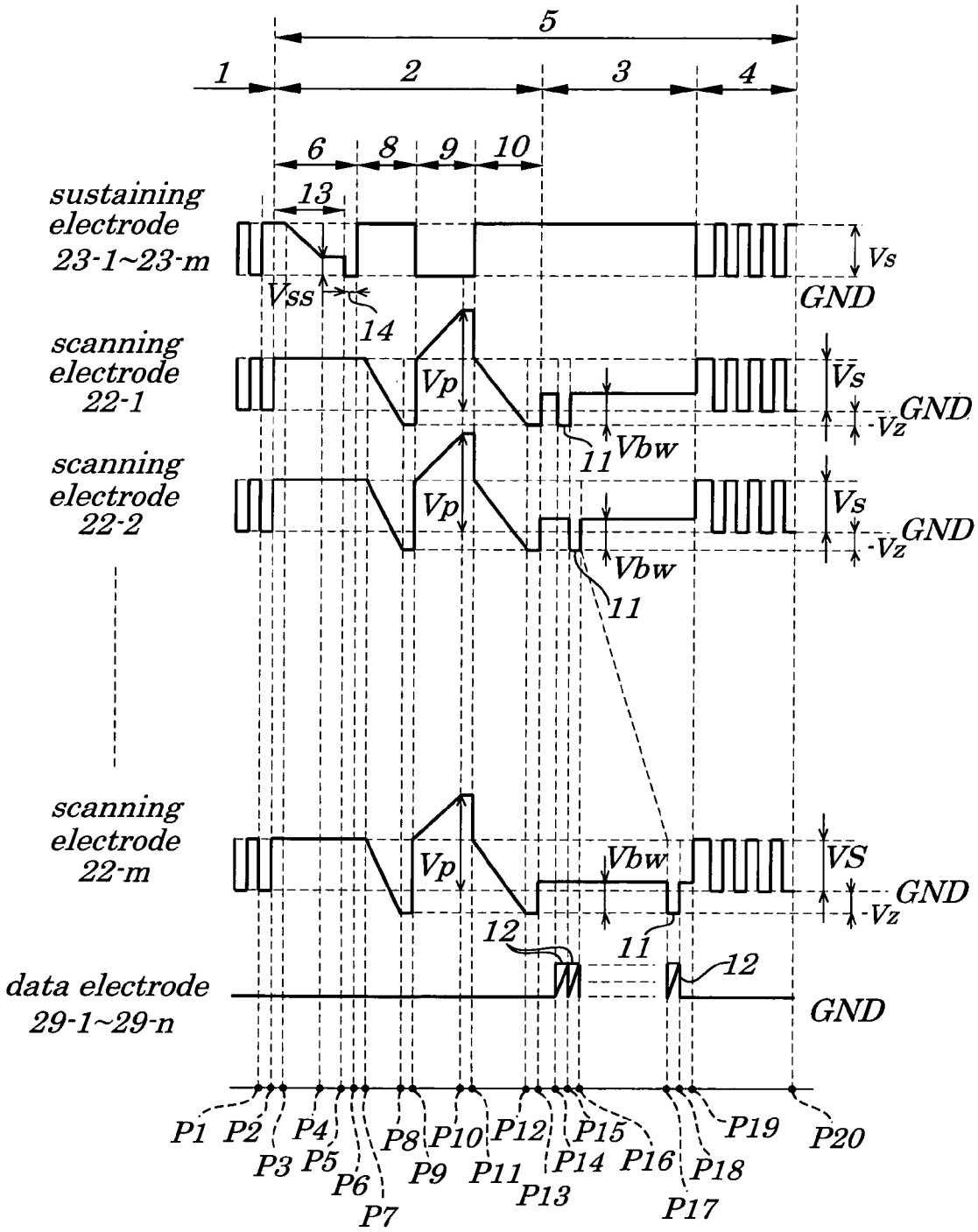
FIG. 9 is a timing chart showing waveforms of voltages applied for driving a plasma display device according to a third embodiment of the present invention.

FIG. 9 is a timing chart showing waveforms of voltages applied for driving a plasma display device according to a third embodiment of the present invention. As shown in FIG. 9, a driving method for the plasma display device (driving method for a PDP) of the third embodiment is a modified example of the first embodiment and, in the third embodiment, descriptions that duplicate contents described in the first embodiment are omitted accordingly.

Driving waveforms (ramp waveforms to be applied to electrodes during the sustaining erasing period 8) applied during a sustaining erasing period 8 in an initializing period 2 used in the third embodiment are described by referring to FIG. 9. A sustaining voltage Vs supplied to the scanning electrodes 221 to 22-m is held for a period from the timing P6 to the timing P7, as an erasing potential, by the driving control circuit 38. Next, during a period from the timing P7 to the timing P8, a sustaining voltage Vs to be applied to the scanning electrodes 22-1 to 22-m is lowered to a negative voltage −Vz by the driving control circuit 38. The negative voltage −Vz is lower than a ground voltage GND. Next, for a period from the timing P8 to the timing P9, the negative voltage −Vz applied to the scanning electrodes 22-1 to 22-m is held by the driving control circuit 38.

Driving waveforms (ramp waveforms) applied during the priming 9 in an initializing period 2 used in the third embodiment are described by referring to FIG. 9. At the timing 9, a voltage (Vs+Vz) obtained by adding the sustaining voltage Vs to an absolute value of the negative voltage −Vz is applied to the scanning electrodes 22-1 to 22-m by the driving control circuit 38. Then, the sustaining voltage Vs to be applied to the scanning electrodes 22-1 to 22-m is gradually boosted to a priming voltage Vp during a period from the timing P9 to the timing P10 by the driving control circuit 38. Next, the priming voltage Vp applied to the scanning electrodes 22-1 to 22-m is held by the driving control circuit 38 for a period from the timing P10 to the timing P11.

Driving waveforms (ramp waveforms to be applied to an electrode during the priming erasing period 10) applied during the priming erasing period 10 in an initializing period 2 used in the third embodiment are described by referring to FIG. 9. At the timing P11, the priming voltage Vp to be applied to the scanning electrodes 22-1 to 22-m is lowered to the sustaining voltage Vs as an erasing potential. Next, during a period from the timing P11 to the timing P12, a sustaining voltage Vs to be applied to the scanning electrodes 22-1 to 22-m is lowered to a negative voltage −Vz by the driving control circuit 38. Then, for a period from the timing P12 to the timing P13, the negative voltage Vz applied to the scanning electrodes 22-1 to 22-m is held by the driving control circuit 38.

Next, driving waveforms applied during the scanning period 3 are described by referring to FIG. 3. At the timing P13, a scanning base voltage Vbw is applied to the scanning electrodes 22-1 to 22-m by the driving control circuit 38. A reference voltage for the scanning base voltage Vbw is shifted from the ground voltage GND to the negative voltage −Vz. Then, for a period from the timing P13 to the timing P19, the scanning base voltage Vbw applied to the scanning electrodes 22-1 to 22-m is held by the driving control circuit 38. Next, while the scanning base voltage Vbw is being applied to the scanning electrodes 22-1 to 22-m, a scanning pulse potential 11 which counters the scanning base voltage Vbw is sequentially applied to the scanning electrodes 22-1 to 22-m by the driving control circuit 38 at the timing P14, P15, P16, . . . , P17. In the third embodiment shown in FIG. 9, the scanning pulse potential 11 is a potential of a pulse having a negative polarity which lowers from a set voltage (Vbw−Vz) having been shifted by an amount of the negative voltage −Vz to the negative voltage −Vz to be used as a reference voltage. When the scanning pulse potential 11 is applied to the scanning electrodes 22-1 to 22-m, a data pulse potential 12 corresponding to video data (display pattern) is applied to the data electrodes 29-1 to 29-n by the driving control circuit 38.

Figure 10:
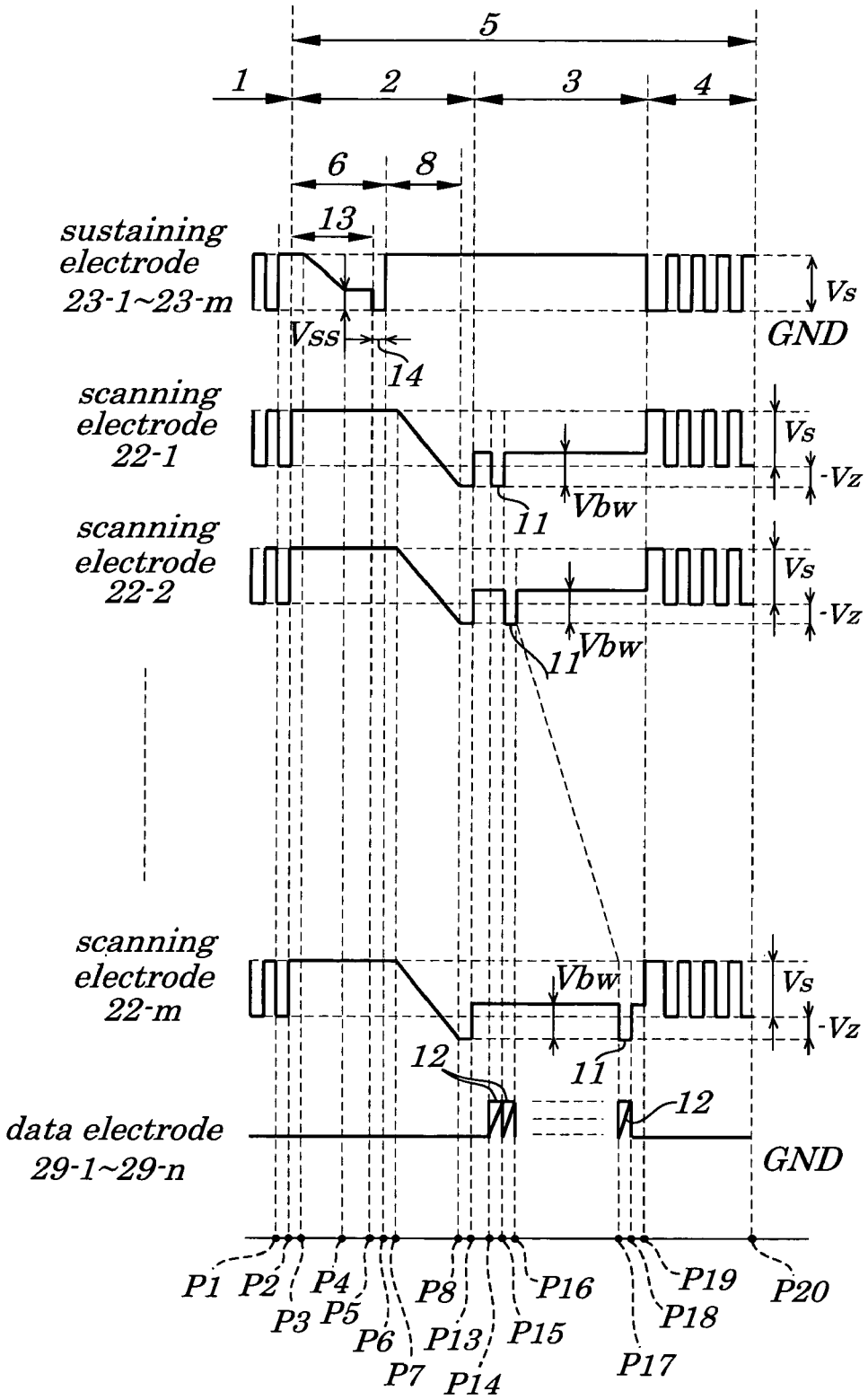
FIG. 10 is another timing chart showing modified waveforms of voltages applied for driving a plasma display device according to the third embodiment of the present invention.

FIG. 10 is a timing chart showing modified waveforms of voltages applied for driving the plasma display device according to the third embodiment. The waveforms for driving method for the plasma display device (driving method for a PDP) shown in FIG. 10 is the modified example of the third embodiment and, in the modified example, descriptions that duplicate contents described in the third embodiment are omitted accordingly. An initializing period 2 in at least one sub-field 5 making up a plurality of the sub-fields 5 during which operations are performed in order by a driving control circuit 38 does not include the priming period 9 and the priming erasing period 10 (being also called the "priming thinning-out period" described above) that are included in the conventional method.

In the case of the modified example of the third embodiment, as in the case of the second embodiment, the initializing period 2 includes timing P2, P3, P4, P5, P6, P7, P8, and P13 following timing P1. Also, the initializing period 2 includes a wall charge adjusting period 6 (being made up of a first wall charge adjusting period 13 and a second wall charge adjusting period 14) and a sustaining erasing period 8. The wall charge adjusting period 6 includes a period from the timing P2 to the timing P6. The sustaining erasing period 8 includes a period from the timing P6, P7, P8, and P13.

Driving waveforms (ramp waveforms to be applied to an electrode during the sustaining erasing period 8) applied during the sustaining erasing period 8 in the initializing period 2 used in the modified example are described by referring to FIG. 10. After a sustaining voltage Vs has been applied, as an erasing potential, to the sustaining electrodes 23-1 to 23-m by the driving control circuit 38, for a period from the timing P6 to the timing P13, the sustaining voltage Vs applied to the sustaining electrodes 23-1 to 23-m is held by the driving control circuit 38. Moreover, for a period from the timing P6 to the timing P7, the sustaining voltage Vs applied to the scanning electrodes 22-1 to 22-m is held, as an erasing potential, by the driving control circuit 38 and, after the sustaining voltage Vs to be applied to the scanning electrodes 22-1 to 22-m has been gradually lowered to the negative voltage −Vz during a period from the timing P7 to the timing P8 by the driving control circuit 38, the negative voltage −Vz applied to the scanning electrodes 22-1 to 22-m is held for a period from the timing P8 to the timing P13 by the driving control circuit 38. For a period from the timing P6 to the timing P13, the ground voltage GND applied to the data electrodes 29-1 to 29-n is held by the driving control circuit 38.

Next, roles of each period used for the plasma display device of the third embodiment and of its modified example are described by referring to FIGS. 9 and 10. Roles of the periods of the third embodiment and of the modified example of the third embodiment differ from those in the first and second embodiments in that both a final reaching potential of the ramp waveform described above to be applied to the scanning electrode 22-i during the sustaining erasing period 8 and priming erasing period 10 and a potential of the scanning pulse 11 to be applied to the scanning electrode 22-i during the scanning period 3 are negative potential−Vz. In the modified example of the third embodiment, as in the case of the second embodiment, the priming thinning-out is executed, that is, the priming period 9 and priming erasing period 10 included in the third embodiment are thinned out (excluded). As described above, during the priming period 9 in the third embodiment, insufficient negative wall charges (−e) on the scanning electrode 22-i are compensated for. Therefore, if the priming period 9 is thinned out, that is, excluded from the initializing period 2, since negative charges (−e) on the scanning electrode 22-i become insufficient and the data pulse potential 12 has to be set so as to be higher than the data pulse potential 12 employed in the first and second embodiments. If the data pulse potential 12 is not made higher, no writing discharge occurs, that is, a writing failure occurs. To solve this problem, in the third embodiment and in its modified example, the scanning pulse potential 11 is made to be a negative voltage, that is, a reference voltage used when the scanning pulse potential 11 is lowered from the scanning base voltage Vbw (set voltage) is made to be the negative voltage −Vz.

In the third embodiment and in its modified example, a change ratio, which indicates an average rate of change (slope of voltage change) in a sustaining voltage Vs to be applied to the scanning electrode 22-i during the sustaining erasing period 8 that occurs from time (timing P7) at which the sustaining voltage Vs begins to lower to time (timing P8) at which it lowers fully to a negative voltage −Vz, is set to be 10 [V/μsec] or less, specifically, about 3 [V/μsec] to 6 [V/μsec]. In the third embodiment, a change ratio, which indicates an average rate of change (slope of voltage change) in a sustaining voltage Vs to be applied to the scanning electrode 22-i during the priming erasing period 10 that occurs from time (timing P11) at which the sustaining voltage Vs begins to lower to time (timing P12) at which it lowers fully to a negative voltage −Vz, is set to be 10 [V/μsec] or less, specifically, about 3 [V/μsec] to 6 [V/μsec], as in the case of the sustaining erasing period 8.

In the third embodiment and in its modified example, a potential of the scanning pulse which is applied to the scanning electrode 22-i during the scanning period 3 (for example, for a period from the timing P14 to the timing P15) and which is lowered from a set voltage (Vbw−Vz) to the negative voltage −Vz is about −60 V.

In the third embodiment, when the scanning pulse potential 11 is made to be a negative voltage, a reference voltage to be used when the sustaining voltage Vs applied to the scanning electrode 22-i is lowered during the priming erasing period 10 has to be also a negative voltage −Vz, as described above. During the priming erasing period 10, not only wall charges accumulated in a portion being in the vicinity of the discharge gap 34 on the scanning electrode 22-i and sustaining electrode 23-i during the priming period 9 are erased but also wall charges to be accumulated between facing electrodes between the scanning electrode 22-i and data electrode 29-j are adjusted by using feeble discharge occurring in the vicinity of the discharge gap 34. Therefore, to prevent occurrence of erroneous discharge at time of writing discharge, reference voltages to be used when the scanning pulse potential 11 is made to be a negative voltage have to be the same in the priming erasing period 10 and in the scanning period 3. In the third embodiment, a final reaching potential being a negative voltage −Vz to be applied to the scanning electrode 22-i at the timing P12 during the priming erasing period 10 is set to be higher than a scanning pulse potential (−60 V) and a potential difference between the final reaching potential and scanning pulse potential is set to be 20 V or less.

As a result, in the third embodiment and in its modified example, as in the case of the first embodiment, writing discharge can be made to normally occur even at the data pulse potential 12 being lower by about 5 V than the data pulse potential 112 used in the conventional plasma display device. Though use of the negative voltage −Vz as a reference voltage during the sustaining erasing period 8 is not always required, in the third embodiment and in its modified example, by commonly using the same negative voltage −Vz as the reference voltage during all the sustaining erasing period 8, priming erasing period 10, and scanning period 3, a circuit to apply the negative voltage −Vz can be commonly employed, which serves to scale down the circuit.

Fourth Embodiment

Figure 11:
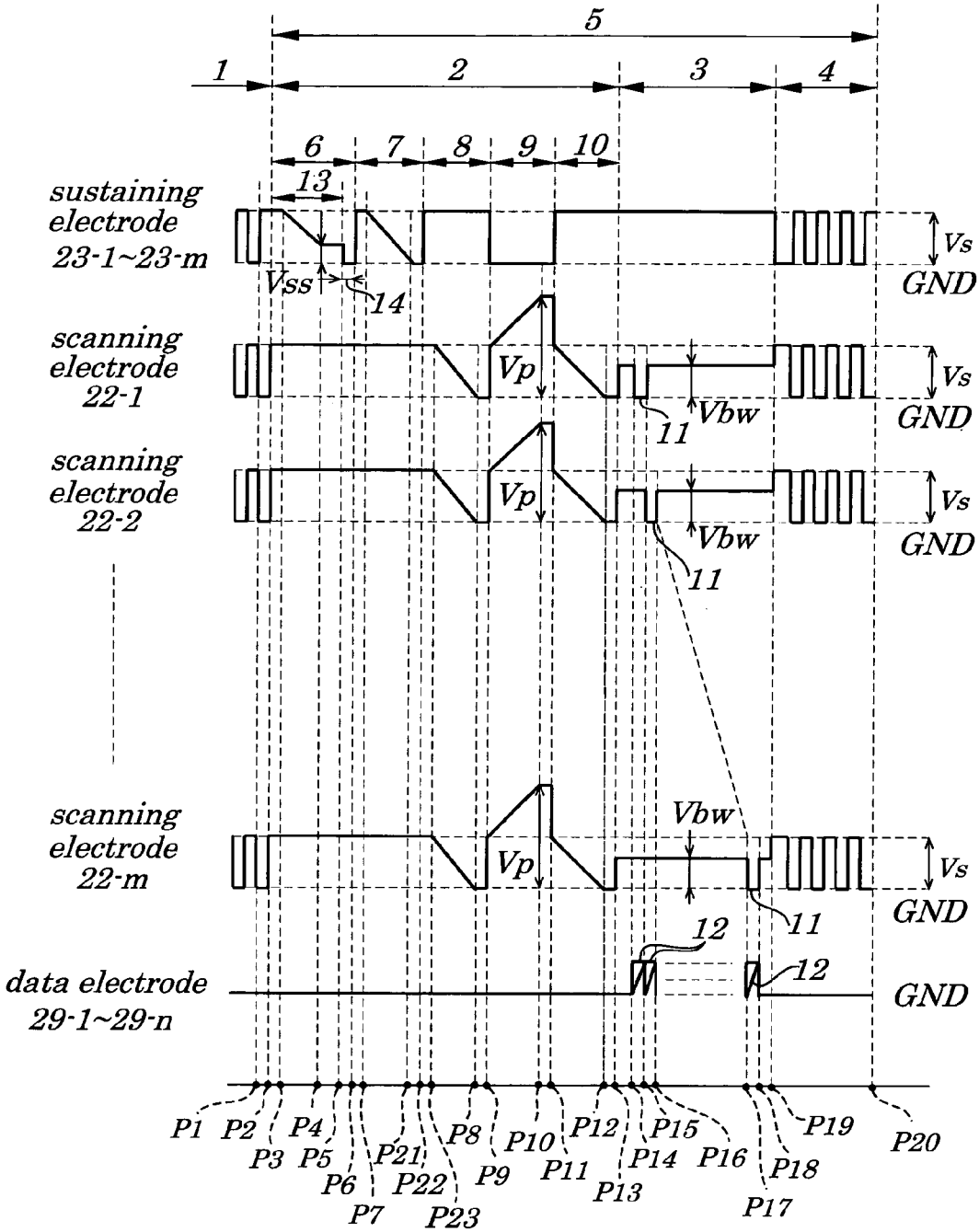
FIG. 11 is a timing chart showing waveforms of voltages applied for driving a plasma display device according to a fourth embodiment of the present invention.

FIG. 11 is a timing chart showing waveforms of voltages applied for driving a plasma display device according to a fourth embodiment of the present invention. As shown in FIG. 11, a driving method for the plasma display device (driving method for a PDP) of the fourth embodiment is a modified example of the first embodiment and, in the fourth embodiment, descriptions that duplicate contents described in the first embodiment are omitted accordingly.

In the fourth embodiment, the initializing period 2 includes timing P2, P3, P4, P5, P6, P7, P21, P22, P23, P8, P9, P10, P11, P12, and P13 following timing P1. The initializing period 2 includes a wall charge adjusting period 6, auxiliary sustaining erasing period 7, sustaining erasing period 8, priming period 9, and priming erasing period 10. The wall charge adjusting period 6 (being made up of a first wall charge adjusting period 13 and a second wall charge adjusting period 14) includes the timing P2, P3, P4, P5, and P6. The auxiliary sustaining erasing period 7 is a period during which wall charges accumulated between the scanning electrode 22-i and sustaining electrode 23-i when sustaining discharge was made to occur during the sustaining period 4 are erased (initialized or reset), to which the timing P6, P7, P21, and P22 corresponds. The sustaining erasing period 8 includes the timing P22, P23, P8, and P9, as in the case of the first embodiment. The priming period 9 includes the timing P9, P10, and P11, as in the case of the first embodiment. The priming erasing period 10 includes a period from the timing P11 to the timing P13, as in the case of the first embodiment.

Driving waveforms applied during the second wall charge adjusting period 14 in the wall charge adjusting period 6 in the initializing period 2 are described by referring to FIG. 11. A sustaining voltage Vs applied to the scanning electrodes 22-1 to 22-m is held, as a wall charge adjusting pulse potential, for a period being equivalent to a wall charge adjusting pulse width, that is, for a period from the timing P5 to the timing P6, by the driving control circuit 38. Moreover, after a voltage applied, as a wall charge adjusting pulse potential, to the sustaining electrodes 23-1 to 23-m at the timing P5 by the driving control circuit 38 has been lowered to a ground voltage GND, the ground voltage GND is held by the sustaining control circuit 38 for a period being equivalent to the wall charge adjusting pulse width, that is, for a period from the timing P5 to the timing P6. A ground voltage GND applied to the data electrode 29-1 to 29-n is held for a period from the timing P5 to the timing P6 by the driving control circuit 38.

Driving waveforms (ramp waveforms to be applied to electrodes during the auxiliary sustaining erasing period 7) applied during the auxiliary sustaining erasing period 7 in the initializing period 2 are described by referring to FIG. 11. At the timing P6, a sustaining voltage Vs is applied to the sustaining electrodes 23-1 to 23-m by the driving control circuit 38. Next, the sustaining voltage Vs applied to the sustaining electrodes 23-1 to 23-m is held for a period from the timing P6 to the timing P7 by the driving control circuit 38. Then, during a period from the timing 7 to the timing P21, the sustaining voltage Vs to be applied to the sustaining electrodes 23-1 to 23-m is gradually lowered to a ground voltage GND. The ground voltage GND applied to the sustaining electrodes 23-1 to 23-m is held for a period from the timing P21 to the timing P22 by the driving control circuit 38. A sustaining voltage Vs applied to the scanning electrodes 22-1 to 22-m is held for a period from the timing P6 to the timing P21 by the driving control circuit 38. The ground voltage GND applied to the data electrodes 29-1 to 29-n is held for a period from the timing P6 to the timing P21 by the driving control circuit 38.

In a modified example (not shown) of the fourth embodiment, an initializing period 2 in at least one sub-field 5 making up a plurality of the sub-fields 5 during which operations are performed in order by the driving control circuit 38 does not include the priming period 9 and the priming erasing period 10 included in the conventional plasma display device (that is, the priming thinning-out is executed).

Next, roles of each period used for the plasma display device of the fourth embodiment are described.

The plasma display device of the fourth embodiment differs from that of the first embodiment in that the auxiliary sustaining erasing period 7 is further included in the initializing period 2. Reasons for employing the auxiliary sustaining erasing period 7 in the fourth embodiment are as follows. That is, in the first embodiment, if a value of the wall charge adjusting voltage Vss is made small in order to lower a peak value of a writing current, intensity of discharge (wall charge adjusting discharge) occurring during the second wall charge adjusting period 14 becomes low, which causes negative charges (−e) to be left also in a portion being in the vicinity of the discharge gap 34 on the sustaining electrode 23-i. Due to the small value of the wall charge adjusting voltage Vss, discharge during the second wall charge adjusting period 14 is delayed, which causes the discharge to occur immediately before termination of the second wall charge adjusting period 14. In this case, the voltage to be applied to the sustaining electrode 23-i is boosted to the sustaining voltage Vs immediately after the termination of the second wall charge adjusting period 14 during the sustaining erasing period 8. Since a potential of the sustaining electrode 23-i is boosted to a potential having a positive polarity immediately after occurrence of discharge while the negative voltage is still being applied to the data electrode 29-j, negative wall charges (−e) are accumulated more on the sustaining electrode 23-i. As a result, negative wall voltages in a portion being in the vicinity of the discharge gap 34 on the scanning electrode 22-i become higher than those in a portion being in the vicinity of the discharge gap 34 on the scanning electrode 22-i. If no writing discharge occurs during the scanning period 3 in the sub-field 5 and a first sustaining pulse potential is applied to the scanning electrode 22-i during the sustaining period 4 and a potential of the scanning electrode 22-i becomes as high as the sustaining voltage Vs (sustaining pulse potential), the difference in potentials between the two electrodes is superimposed on the sustaining pulse potential Vs, causing occurrence of erroneous discharge. To prevent such the erroneous discharge, the auxiliary sustaining erasing period 7 is provided in the fourth embodiment.

During the auxiliary sustaining erasing period 7, the sustaining voltage Vs to be applied to the scanning electrode 22-i is held and the sustaining voltage Vs to be applied to the sustaining electrode 23-i is gradually lowered to a ground voltage GND. During the auxiliary sustaining erasing period 7, feeble discharge occurs between the scanning electrode 22-i and sustaining electrode 23-i and, since negative wall charges (−e) accumulated in a portion being in the vicinity of the discharge gap 34 on the sustaining electrode 23-i decrease and negative wall charges (−e) to be accumulated on the scanning electrode 22-i increase, wall voltages in the portion being in the vicinity of the discharge gap 34 on the scanning electrode 22-i become almost equal to those in the portion being in the vicinity of the discharge gap 34 on the sustaining electrode 23-i. Therefore, in the fourth embodiment, though the wall charge adjusting voltage Vss is made as small as about 20 V, no erroneous discharge occurs. In the fourth embodiment, a change ratio, which indicates an average rate of change (slope of voltage change) in a sustaining voltage Vs to be applied to the sustaining electrode 23-i for a period from the timing P7 to the timing P21 during the auxiliary sustaining erasing period 7 that occurs from time (timing P7) at which the sustaining voltage Vs begins to lower to time (timing P21) at which it lowers fully to a ground voltage GND, is set to be 10 [V/μsec] or less, specifically, about 3 [V/μsec] to 6 [V/μsec]. In the fourth embodiment, by making small a value of the wall charge adjusting voltage Vss, a required writing current can be more reduced (that is, a peak value of the writing current is made small) compared with the case of the first embodiment. As a result, it is possible to cause writing discharge to normally occur even at a data pulse potential being lower by about 7 V than the data pulse potential 112 employed in the conventional method.

Fifth Embodiment

Figure 12:
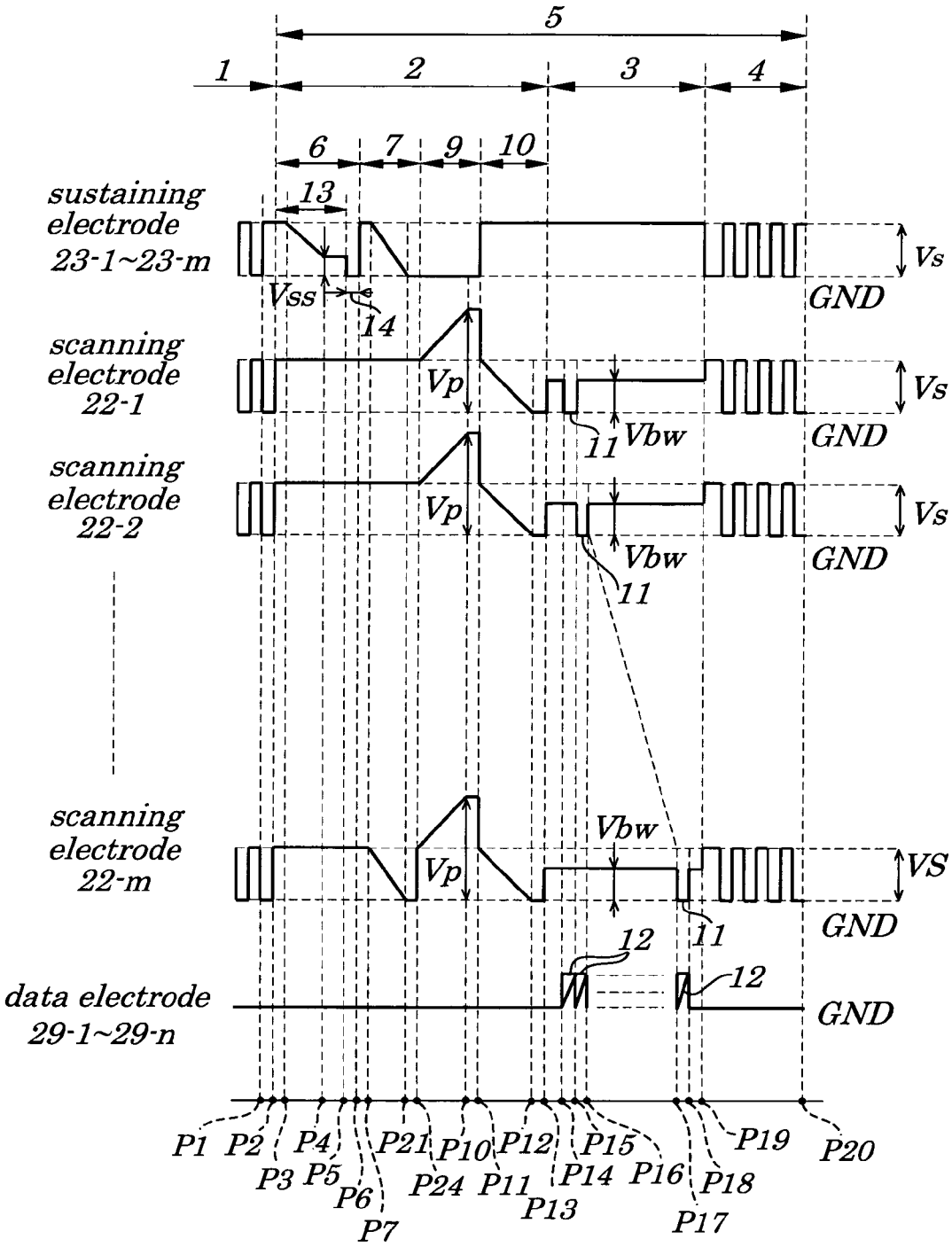
FIG. 12 is a timing chart showing waveforms of voltages applied for driving a plasma display device according to a fifth embodiment of the present invention.

FIG. 12 is a timing chart showing waveforms of voltages applied for driving a plasma display device according to a fifth embodiment of the present invention. As shown in FIG. 12, a driving method for the plasma display device (driving method for a PDP) of the fifth embodiment is a modified example of the fourth embodiment and, in the fifth embodiment, descriptions that duplicate contents described in the fourth embodiment are omitted accordingly. In the fifth embodiment, no priming thinning-out is executed.

In the fifth embodiment, as shown in FIG. 12, an initializing period 2 includes timing P2, P3, P4, P5, P6, P21, P24, P10, P11, P12, and P13 following timing P1. The initializing period 2 includes a wall charge adjusting period 6, an auxiliary sustaining erasing period 7, a priming period 9, and a priming erasing period 10. The wall charge adjusting period 6 (being made up of a first wall charge adjusting period 13 and a second wall charge adjusting period 14) includes the timing P2, P3, P4, P5, and P6 following the timing P1, as in the case of the first embodiment. The auxiliary sustaining erasing period 7 includes a period of the timing P6 to the timing P24. The priming period 9 includes the timing P24, P10, and P11. The priming erasing period 10 includes the timing P11, P12 and P13, as in the case of the first embodiment.

Driving waveforms (ramp waveforms to be applied to electrodes during the auxiliary sustaining erasing period 7) applied during the auxiliary sustaining erasing period 7 in the initializing period 2 are described by referring to FIG. 12. After the sustaining voltage Vs has been applied to the sustaining electrodes 23-1 to 23-m at the timing P6 by the driving control circuit 38, the sustaining voltage Vs applied to the sustaining electrodes 23-1 to 23-m is held for a period from the timing P6 to the timing P7 by the driving control circuit 38. Next, after the sustaining voltage Vs to be applied to the sustaining electrodes 23-1 to 23-m from the timing P7 to the timing P21 by the driving control circuit 38 has been gradually lowered to a ground voltage GND, the ground voltage GND applied to the sustaining electrodes 23-1 to 23-m is held for a period from the timing P21 to the timing P24 by the driving control circuit 38. From the timing P21 to the timing P24, the sustaining voltage Vs applied to the scanning electrodes 22-1 to 22-m are held by the driving control circuit 38. For a period from the timing P21 to the timing P24, a ground voltage GND applied to the data electrodes 29-1 to 29-n is held by the driving control circuit 38.

Driving waveforms (ramp waveforms to be applied to electrodes during the priming period 9) applied during the priming period 9 in the initializing period 2 are described by referring to FIG. 12. A sustaining voltage Vs to be applied to the scanning electrodes 22-1 to 22-m is gradually boosted to a priming voltage Vp from the timing P24 to the timing P10 by the driving control circuit 38. Next, the priming voltage Vp applied to the scanning electrodes 22-1 to 22-m is held for a period from the timing P10 to the timing P11 by the driving control circuit 38. For a period from the timing P24 to the timing P11, a ground voltage GND applied to the sustaining electrodes 23-1 to 23-m is held by the driving control circuit 38. For a period from the timing P24 to the timing P11, the ground voltage GND applied to the data electrodes 29-1 to 29-n is held by the driving control circuit 38.

Next, roles of each period used for the plasma display device of the fifth embodiment are described.

The sub-field in the fifth embodiment differs from that in the fourth embodiment in that it includes the initializing period having no a sustaining erasing period 8 included in the fourth embodiment, a scanning period, and a sustaining period. A time length of the initializing period 2 in the fourth embodiment is longer, by time lengths for the wall charge adjusting period 6 and auxiliary wall charge adjusting period 7, than the initializing period 102 in the conventional method and is about 60 μsec to 120 μsec in total. Since specified time for the scanning period 3 is required depending on the number of scanning lines, if the time length of the initializing period 2 is made longer, the sustaining period 4 has to be made shorter. Reduction in the time length of the sustaining period causes lowering of luminance.

To solve this problem, in the fifth embodiment, by omitting the sustaining period 8 employed in the fourth embodiment, the time length of the initializing period 2 is made short. Even when the sustaining period 8 is omitted, since the priming erasing period 10 exists, arrangements of wall charges at time of shifting to the scanning period becomes same as those in the fourth embodiment in the end. Even if the initializing period 2 in the fifth embodiment is made shorter than that in the fourth embodiment, as in the case of the fourth embodiment, a writing current can be more reduced (that is, a peak value of the writing current is made small) compared with the case of the first embodiment. As a result, according to the fifth embodiment, as in the case of the fourth embodiment, it is possible to cause writing discharge to normally occur even at a data pulse potential 12 being lower by about 7 V than the data pulse potential 112 employed in the conventional method.

Sixth Embodiment

Figure 13:
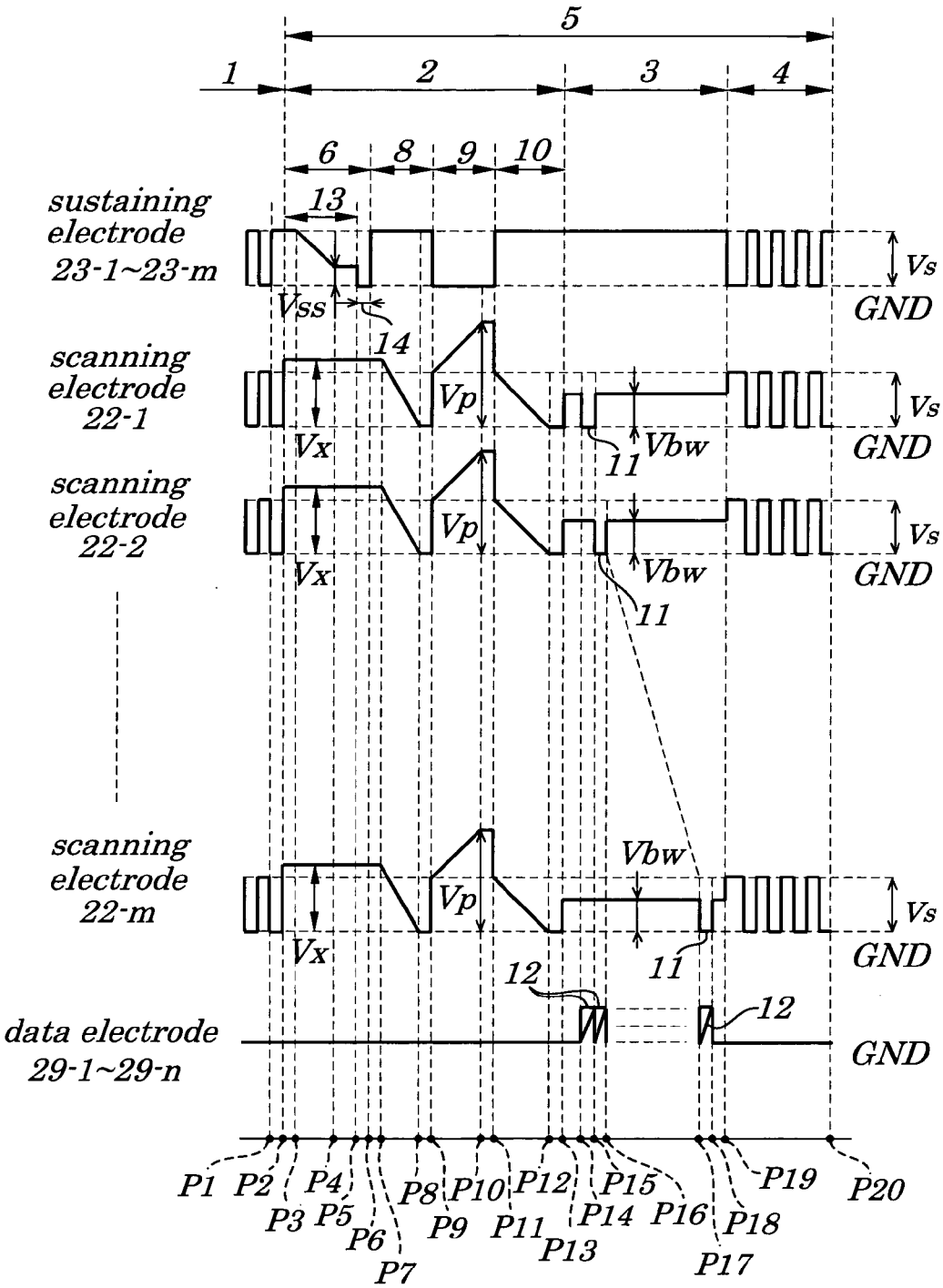
FIG. 13 is a timing chart showing waveforms of voltages applied for driving a plasma display device according to a sixth embodiment of the present invention.

FIG. 13 is a timing chart showing waveforms of voltages applied for driving a plasma display device according to a sixth embodiment of the present invention. As shown in FIG. 13, a driving method for the plasma display device (driving method for a PDP) of the sixth embodiment is a modified example of the first embodiment and, in the sixth embodiment, descriptions that duplicate contents described in the first embodiment are omitted accordingly.

Driving waveforms applied during the first wall charge adjusting period 13 contained in the wall charge adjusting period 6 in the initializing period 2 are described by referring to FIG. 13. At timing P2, a voltage Vx is applied to the scanning electrodes 22-1 to 22-m by the driving control circuit 38. The voltage Vx is higher than a sustaining voltage Vs and is the voltage at which wall charge adjusting discharge does not occur between the scanning electrodes 22-1 to 22-m and the sustaining electrodes 23-1 to 23-m during the second wall charge adjusting period 14 while no sustaining discharge occurs during the sustaining period 4. Next, for a period from the timing P2 to the timing P5, the voltage Vx applied to the scanning electrodes 22-1 to 22-m is held by the driving control circuit 38.

Driving waveforms applied during the second wall charge adjusting period 14 contained in the wall charge adjusting period 6 in the initializing period 2 are described by referring to FIG. 13. The voltage Vx applied to the scanning electrode 22-1 to 22-m for a period from the timing P5 to the timing P6 is held, as a wall charge adjusting pulse potential, for a period being equivalent to a wall charge adjusting pulse width, by the driving control circuit 38.

Driving waveforms (ramp waveforms to be applied to electrodes during the sustaining erasing period 8) applied during the sustaining erasing period 8 in the initializing period 2 are described by referring to FIG. 13. A voltage Vx applied to the scanning electrodes 22-1 to 22-m is held as an erasing potential for a period from the timing P6 to the timing P7 by the driving control circuit 38. Next, the voltage Vx applied to the scanning electrodes 22-1 to 22-m is gradually lowered to a ground voltage GND from the timing P7 to the timing P8 by the driving control circuit 38. Then, the ground voltage GND applied to the scanning electrodes 22-1 to 22-m is held for a period from the timing P8 to the timing P9 by the driving control circuit 38.

In a modified example (not shown) of the sixth embodiment, the initializing period 2 in at least one sub-field 5 making up a plurality of the sub-fields 5 during which operations are performed in order by the driving control circuit 38 does not include the priming period 9 and the priming erasing period 10 included in the conventional method (that is, priming thinning-out is executed).

Next, roles of each period used for the plasma display device of the sixth embodiment are described.

The roles of the period in the sixth embodiment differ from those in the first embodiment in that a voltage Vx being higher than a sustaining voltage Vs is applied to the scanning electrode 22-1 during the wall charge adjusting period 6. By making a voltage to be applied to the scanning electrode 22-i be higher than the sustaining voltage Vs during the wall charge adjusting period 6, when a voltage to be applied to the sustaining electrode 23-i becomes a ground voltage GND during the second wall charge adjusting period 14 in the wall charge adjusting period 6, negative wall charges (−e) are easily accumulated on the scanning electrode 22-i by surface discharge between the scanning electrode 22-i and sustaining electrode 23-i. By much accumulation of negative wall charges (−e) on the scanning electrode 22-i, such a writing failure as no writing discharge occurs can be prevented. Even when the priming thinning-out is executed (that is, even when the priming period 9 and priming erasing period 10 are excluded from the initializing period 2), a writing failure does not occur. However, if the voltage Vx to be applied to the scanning electrode 22-i is boosted excessively, erroneous discharge occurs when the voltage Vs to be applied to the sustaining electrode 23-i is lowered to the ground voltage GND.

In the sixth embodiment, the voltage Vx is made higher by about 40 V to 60 V than the sustaining voltage Vs. In the third embodiment, when the priming thinning-out is executed, a scanning pulse potential 11 is set to be a negative value (that is, a reference voltage used when the scanning pulse potential 11 is lowered from the scanning base voltage Vbw is made to be the negative voltage −Vz). However, in the sixth embodiment, even if the priming thinning-out is executed, it is not necessary to make the scanning pulse potential 11 be a negative voltage. In the sixth embodiment, by making the voltage Vx to be applied to the scanning electrode 22-i higher than by about 40 V to 60 V than the sustaining voltage Vs during the wall charge adjusting period, as in the case of the first and third embodiment, it is possible to cause writing discharge to normally occur even at the data pulse potential 12 being lower by about 5 V than the data pulse potential 112 used in the conventional plasma display device.

Seventh Embodiment

Figure 14:
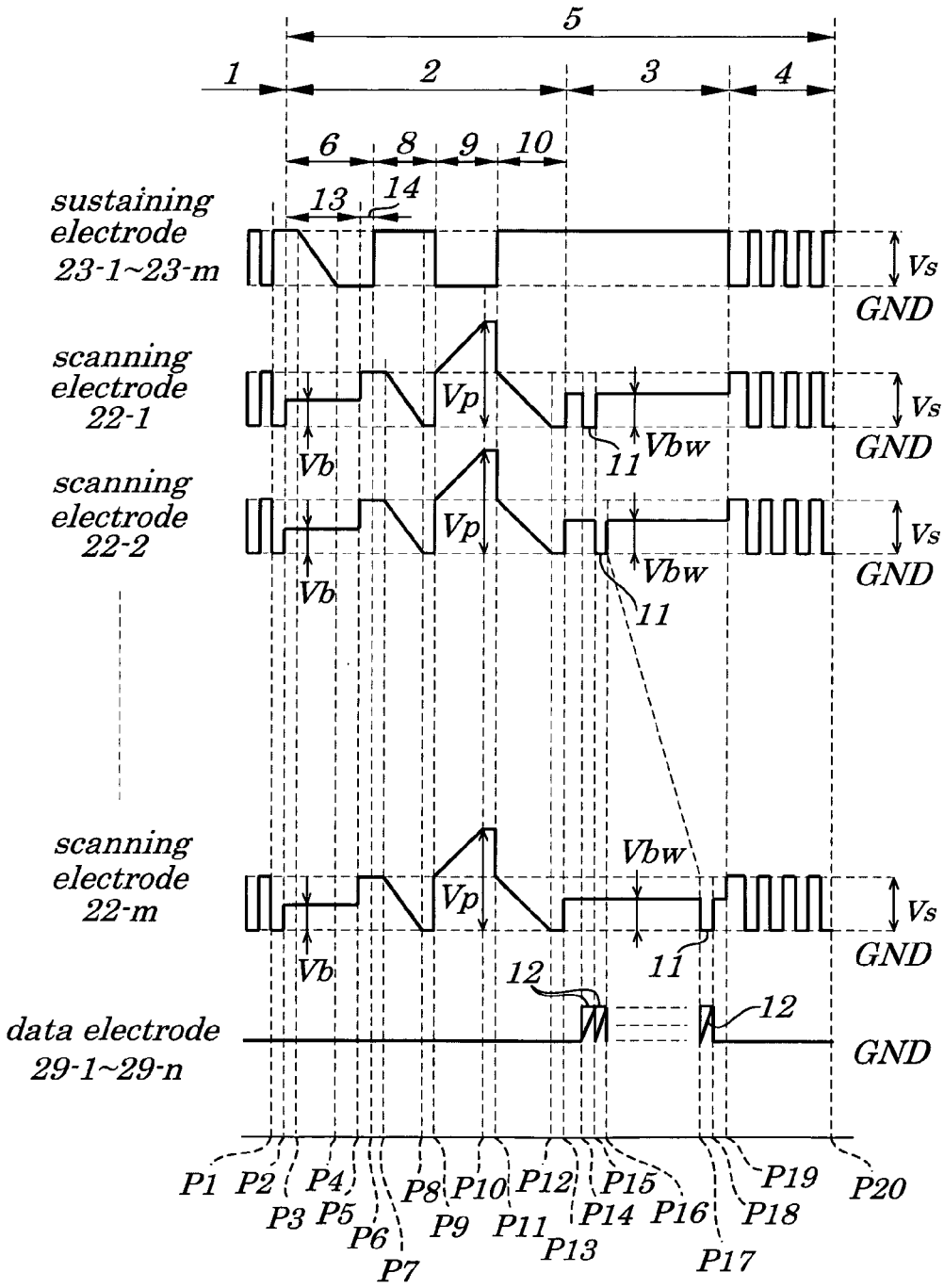
FIG. 14 is a timing chart showing waveforms of voltages applied for driving a plasma display device according to a seventh embodiment of the present invention.

FIG. 14 is a timing chart showing waveforms of voltages applied for driving a plasma display device according to a seventh embodiment of the present invention. As shown in FIG. 14, a driving method for the plasma display device (driving method for a PDP) of the seventh embodiment is a modified example of the first embodiment and, in the seventh embodiment, descriptions that duplicate contents described in the first embodiment are omitted accordingly.

Driving waveforms applied during the first wall charge adjusting period 13 included in the wall charge adjusting period 6 in the initializing period 2 in the seventh embodiment are described by referring to FIG. 14. At timing P2, a voltage Vb is applied, as an adjusting potential, to the scanning electrodes 22-1 to 22-m by the driving control circuit 38. The voltage Vb is lower than a sustaining voltage Vs and higher than a ground voltage GND. Next, for a period from the timing P2 to the timing P5, the voltage Vb applied to the scanning electrodes 22-1 to 22-m is held by the driving control circuit 38. For a period from the timing P2 to the timing P3, the sustaining voltage Vs applied to the sustaining electrodes 23-1 to 23-m is held as an adjusting potential by the driving control circuit 38. Next, from the timing P3 to the timing P4, the sustaining voltage Vs to be applied to the sustaining electrodes 23-1 to 23-m is lowered to a ground voltage GND by the driving control circuit 38. Then, for a period from the timing P4 to the timing P5, the ground voltage GND applied to the sustaining electrodes 23-1 to 23-m is held by the driving control circuit 38.

Driving waveforms applied during the second wall charge adjusting period 14 contained in the wall charge adjusting period 6 in the initializing period 2 in the seventh embodiment are described by referring to FIG. 14. A voltage Vb to be applied to the scanning electrodes 22-1 to 22-m is boosted to a sustaining voltage Vs serving as a wall charge adjusting pulse potential. Next, the sustaining voltage Vs applied to the scanning electrodes 22-1 to 22-m is held for a period from the timing P5 to the timing P6, that is, for a period being equivalent to a wall charge adjusting pulse width. Moreover, the ground voltage GND applied to the sustaining electrodes 23-1 to 23-m is held as a wall charge adjusting pulse potential for a period from the timing P5 to the timing P6, that is, for a period being equivalent to a wall charge adjusting pulse width, by the driving control circuit 38.

In a modified example (not shown) of the seventh embodiment, an initializing period 2 in at least one sub-field 5 making up a plurality of the sub-fields 5 during which operations are performed in order by the driving control circuit 38 does not include the priming period 9 and the priming erasing period 10 included in the conventional method (that is, the priming thinning-out is executed).

Next, roles of each period used for the plasma display device of the seventh embodiment are described.

The roles of the period in the seventh embodiment differ from those in the first embodiment in that, during the wall charge adjusting period 6, the sustaining voltage Vs applied to the sustaining electrodes 23-1 to 23-m changes gradually to be a ground voltage GND and the voltage Vb being lower than the sustaining voltage Vs is applied to the scanning electrode 22-i. During the first wall charge adjusting period 13 in the wall charge adjusting period 6, as in the case of the first embodiment, negative wall charges accumulated in a portion being in the vicinity of the discharge gap 34 on the sustaining electrode 23-i is reduced.

In the first embodiment, while the sustaining voltage Vs is being applied to the sustaining electrode 22-i during the second wall charge adjusting period 14, by lowering a wall charge adjusting voltage Vss applied to the sustaining electrode 23-i to the ground voltage GND, discharge whose intensity is slightly higher than that of wall charge adjusting discharge made to occur during the first wall charge adjusting period 13 and is slightly lower than sustaining discharge is made to occur between the scanning electrode 22-i and the sustaining electrode 23-i. However, in the seventh embodiment, when a voltage Vb is applied to the scanning electrode 22-i during the first wall charge adjusting period 13 and when a voltage applied to the sustaining electrode 23-i during the second wall charge adjusting period 14 is a ground voltage GND, by boosting the voltage Vb to be applied to the scanning electrode 22-i to the sustaining voltage Vs, discharge (wall charge adjusting discharge) whose intensity is slightly higher than that of wall charge adjusting discharge made to occur during the first wall charge adjusting period 13 and is slightly lower than that of sustaining discharge is made to occur. In the seventh embodiment, the voltage Vb is set to be 110 V to 140 V. In the seventh embodiment, a change ratio, which indicates an average rate of change (slope of voltage change) in a sustaining voltage Vs to be applied to the sustaining electrode 23-i for a period from the timing P3 to the timing P4 during the first wall charge adjusting period 13 in the wall charge adjusting period 6 which occurs from time (timing P3) at which the sustaining voltage Vs begins to lower to time (timing P4) at which it lowers fully to the ground voltage GND, is set to be 10 [V/μsec] or less, specifically, about 3 [V/μsec] to 6 [V/μsec]. As a result, in the seventh embodiment, as in the case of the first and third embodiment, it is possible to cause writing discharge to normally occur even at the data pulse potential 12 being lower by about 5 V than the data pulse potential 112 used in the conventional plasma display device.

Eighth Embodiment

Figure 15:
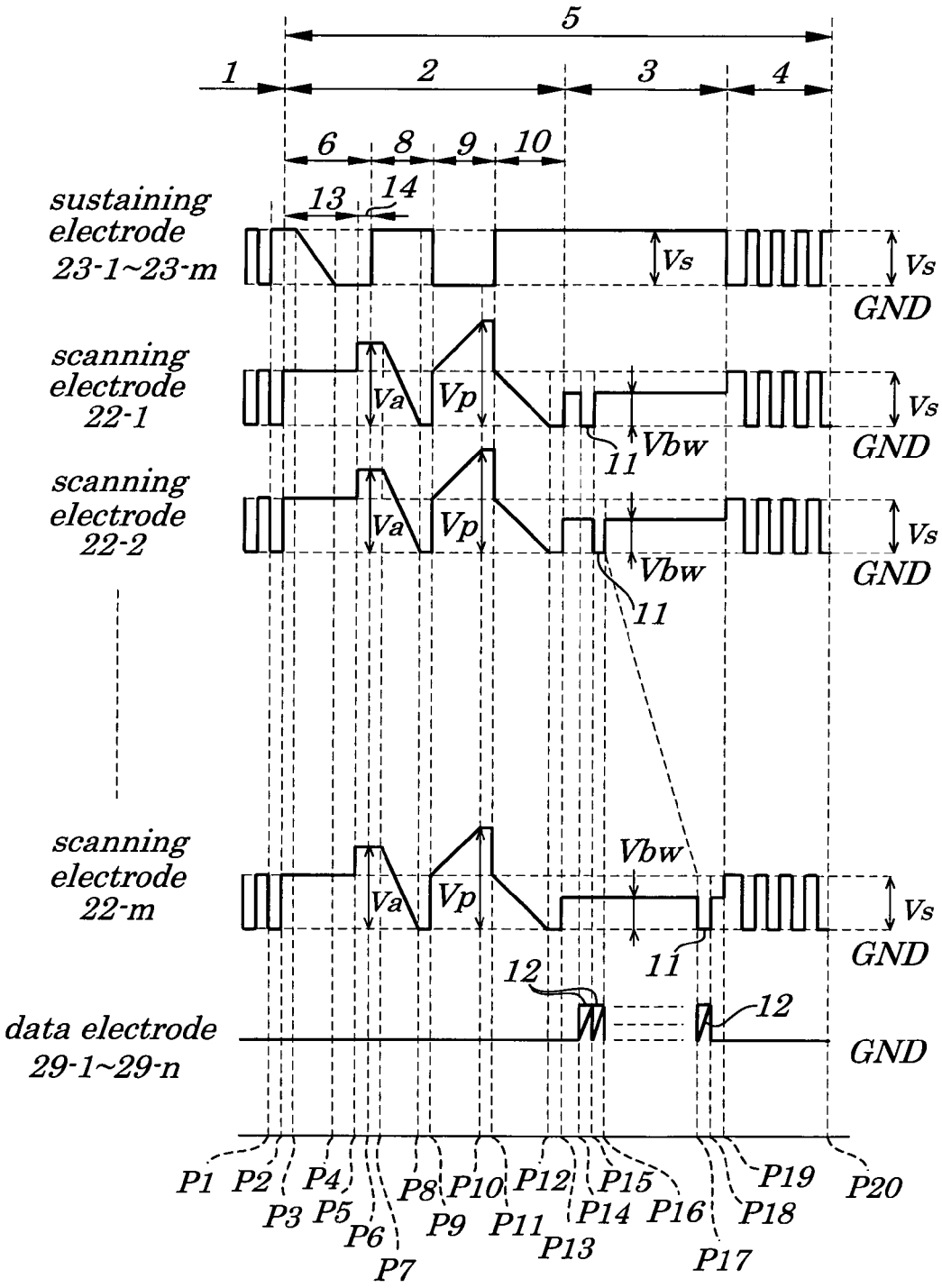
FIG. 15 is a timing chart showing waveforms of voltages applied for driving a plasma display device according to an eighth embodiment of the present invention.

FIG. 15 is a timing chart showing waveforms of voltages applied for driving a plasma display device according to an eighth embodiment of the present invention. As shown in FIG. 15, a driving method for the plasma display device (driving method for a PDP) of the eighth embodiment is a modified example of the first embodiment and, in the eighth embodiment, descriptions that duplicate contents described in the first embodiment are omitted accordingly.

Driving waveforms applied during the first wall charge adjusting period 13 included in the wall charge adjusting period 6 in the initializing period 2 in the eighth embodiment are described by referring to FIG. 14. At timing P2, a sustaining voltage Vs is applied as an adjusting potential to the scanning electrodes 22-1 to 23-m by the driving control circuit 38. Next, for a period from the timing P2 to the timing P5, the sustaining voltage Vs applied to the scanning electrodes 22-1 to 22-m is held by the driving control circuit 38. Moreover, the sustaining voltage Vs applied to the sustaining electrodes 23-1 to 23-m is held for a period from the timing P2 to the timing P3 by the driving control circuit 38. Next, the sustaining voltage Vs to be applied to the sustaining electrodes 23-1 to 23-m is gradually lowered to a ground voltage GND during the timing P3 to the timing P4 by the driving control circuit 38. Then, the ground voltage GND applied to the sustaining electrodes 23-1 to 23-m is held for a period from the timing P4 to the timing P5 by the driving control circuit 38.

Driving waveforms applied during the second wall charge adjusting period 14 included in the wall charge adjusting period 6 in the initializing period 2 in the eighth embodiment are described by referring to FIG. 15. The sustaining voltage Vs to be applied to the scanning electrodes 22-1 to 22-m is boosted at the timing P5 to a voltage Va serving as a wall charge adjusting pulse potential. The voltage Va is higher than the sustaining voltage Vs and is a voltage at which wall charge adjusting discharge does not occur between the scanning electrodes 22-1 to 22-m during the second wall charge adjusting period 14 while sustaining discharge is not occurring during the sustaining period 4. Next, the voltage Va applied to the scanning electrodes 22-1 to 22-m is held by the driving control circuit 38 for a period from the timing P5 to the timing P6, that is, for a period being equivalent to a wall charge adjusting pulse width. The ground voltage GND applied to the sustaining electrodes 23-1 to 23-m is held, as a wall charge adjusting pulse potential, by the driving control circuit 38 for a period from the timing P5 to the timing P6, that is, for a period being equivalent to the wall charge adjusting pulse width.

Driving waveforms (ramp waveforms to be applied to electrodes during the sustaining erasing period 8) to be applied during the sustaining erasing period 8 in the initializing period 2 are described. The voltage Va applied to the scanning electrodes 22-1 to 22-m is held as an erasing potential for a period from the timing P6 to the timing P7 by the driving control circuit 38. Next, the voltage Va to be applied to the scanning electrodes 22-1 to 22-m is gradually lowered to a ground voltage GND during a period from the timing P7 to the timing P8 by the driving control circuit 38. Then, the ground voltage GND applied to the scanning electrodes 22-1 to 22-m is held for a period from the timing P8 to the timing P9 by the driving control circuit 38.

In a modified example (not shown) of the eighth embodiment, an initializing period 2 in at least one sub-field 5 making up a plurality of the sub-fields 5 to be operated in order by the driving control circuit 38 does not include the priming period 9 and the priming erasing period 10 included in the conventional method (that is, the priming thinning-out is executed).

Next, roles of each period used for the plasma display device of the eighth embodiment are described.

The roles of the period in the eighth embodiment differ from those in the first embodiment in that the sustaining voltage Vs applied to the sustaining electrodes 23-1 to 23-m gradually changes to a ground voltage GND and differ from those in the seventh embodiment that the sustaining voltage Vs applied to the scanning electrode 22-i is boosted to the voltage Va.

In the eighth embodiment, since, during the wall charge adjusting period 6 (second wall charge adjusting period 14), a potential difference (second wall charge adjusting period potential difference) between the scanning electrode 22-i and data electrode 29-j is made larger compared with the case of the seventh embodiment, negative wall charges are easily accumulated. Due to this potential difference, when discharge occurs between the scanning electrode 22-i and sustaining electrode 23-i during the wall charge adjusting period 6, the voltage to be applied to the scanning electrode 22-i is higher than the sustaining voltage Vs. By much accumulation of negative wall charges (−e) on the scanning electrode 22-i during the wall charge adjusting period 6, such a writing failure as no writing discharge occurs can be prevented. Even when the priming thinning-out is executed (that is, even when the priming period 9 and priming erasing period 10 are excluded from the initializing period 2), a writing failure does not occur. However, if the second high voltage Vx applied to the scanning electrode 22-i is boosted excessively, erroneous discharge occurs when the voltage Vs applied to the sustaining electrode 23-i is boosted to the voltage Va.

Therefore, in the eighth embodiment, the voltage Va is set to be about 200 V to 230 V. Thus, as in the case of the first and third embodiment, it is made possible to cause writing discharge to normally occur even at the data pulse potential 12 being lower by about 5 V than the data pulse potential 112 used in the conventional plasma display device.

Ninth Embodiment

Figure 16:
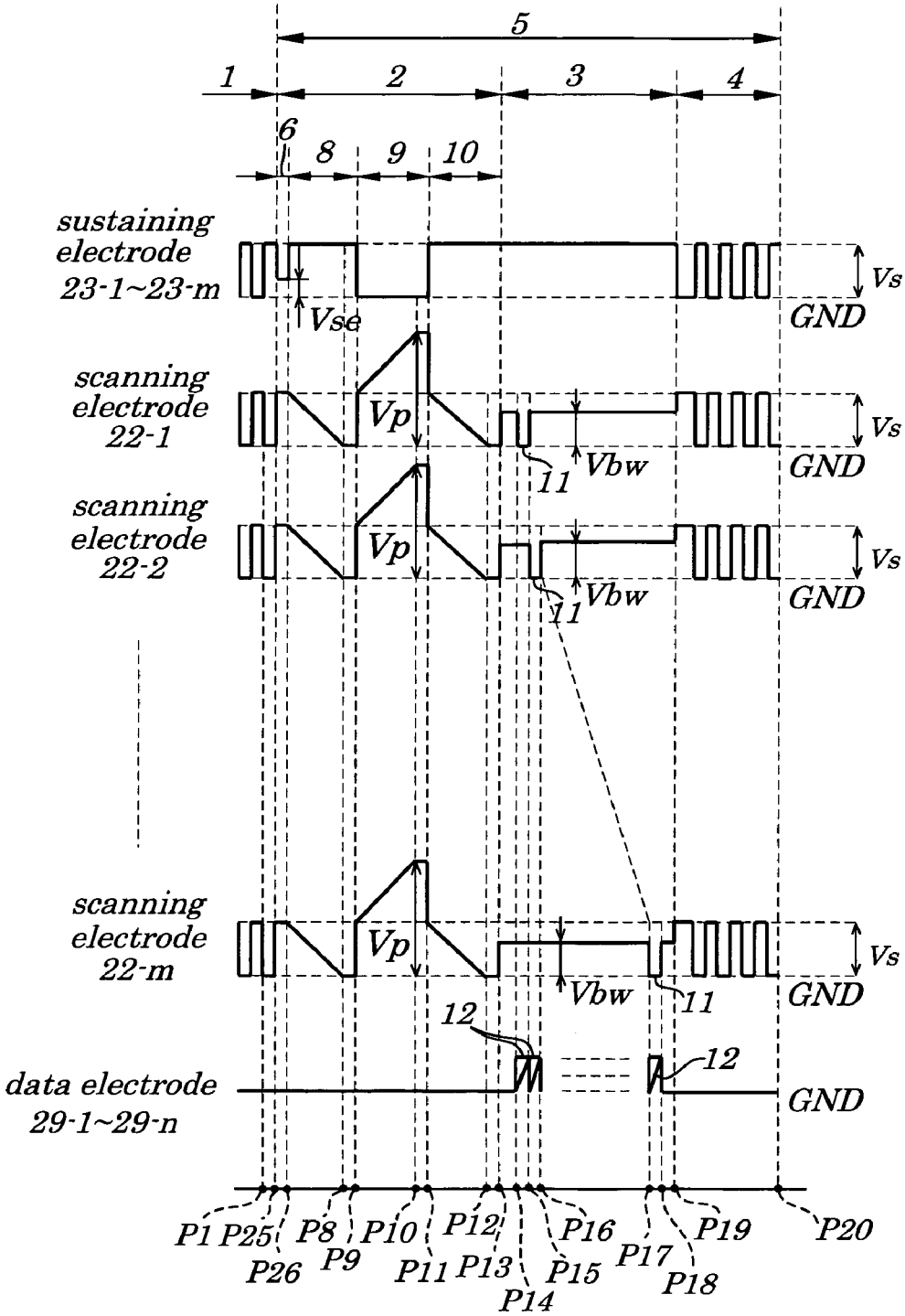
FIG. 16 is a timing chart showing waveforms of voltages applied for driving a plasma display device according to a ninth embodiment of the present invention.

FIG. 16 is a timing chart showing waveforms of voltages applied for driving a plasma display device according to a ninth embodiment of the present invention. As shown in FIG. 16, a driving method for the plasma display device (driving method for a PDP) of the ninth embodiment is a modified example of the first embodiment and, in the ninth embodiment, descriptions that duplicate contents described in the first embodiment are omitted accordingly.

In the ninth embodiment, an initializing period 2 includes timing P2, P26, P8, P9, P10, P11, P12, and P13 following the timing P1. The initializing period 2 includes a wall charge adjusting period 6, a sustaining erasing period 8, a priming period 9 and a priming erasing period 10. The wall charge adjusting period 6 includes the timing P25 and P26. The sustaining erasing period 8 includes the timing P26, P8, and P9. The priming period 9 includes the timing P9 to the timing P11, as in the case of the first embodiment. The priming erasing period 10 includes the timing P11 to the timing P13, as in the case of the first embodiment.

Driving waveforms to be applied during the wall charge adjusting period 6 in the initializing period 2 are described by referring to FIG. 16. During a period from the timing P25 to the timing P26 in the wall charge adjusting period 6, a potential difference having a polarity opposite to that of a potential difference produced during the sustaining period occurring when a last sustaining pulse potential (final sustaining pulse potential Vc) to be applied during the sustaining period was applied between the scanning electrodes 22-1 to 22-m and the sustaining electrodes 23-1 to 23-m is applied, as an adjusting potential being smaller the sustaining pulse potential, between the scanning electrodes 22-1 to 22-m and the sustaining electrodes 23-1 to 23-m by the driving control circuit 38. Specifically, a sustaining voltage Vs is applied, as an adjusting potential, at the timing P25 to the scanning electrodes 22-1 to 22-m by the driving control circuit 38. Next, the sustaining voltage Vs applied to the scanning electrodes 22-1 to 22-m is held for a period from the timing P25 to the timing P26 by the driving control circuit 38. Moreover, the sustaining voltage Vs to be applied to the sustaining electrodes 23-1 to 23-m is lowered at the timing P25 to a voltage Vse to be used as an adjusting potential. The voltage Vse is lower than the sustaining voltage Vs and is higher than the ground voltage GND. The voltage Vse applied to the sustaining electrodes 23-1 to 23-m is held for a period from the timing P25 to the timing P26 by the driving control circuit 38. A ground voltage GND applied to the data electrodes 29-1 to 29-n is held for a period from the timing P25 to the timing P26 by the driving control circuit 38.

Driving waveforms (ramp waveforms to be applied to electrodes during the sustaining erasing period 8) to be applied during the sustaining erasing period 8 in the initializing period 2 are described. The sustaining voltage Vs applied to the scanning electrodes 22-1 to 22-m is held for a period from the timing P25 to the timing P26 as an erasing potential by the driving control circuit 38. Next, the sustaining voltage Vs to be applied to the scanning electrodes 22-1 to 22-m is gradually lowered during the timing P26 to the timing P8 to a ground voltage GND by the driving control circuit. Then, the ground voltage GND applied to the scanning electrodes 22-1 to 22-m is held for a period from the timing P8 to the timing P9 by the driving control circuit 38. Moreover, the voltage Vse to be applied to the sustaining electrodes 23-1 to 23-m is boosted at the timing P26 to the sustaining voltage Vs to be used as an erasing potential. Next, the sustaining voltage Vs applied to the sustaining electrodes 23-1 to 23-m is held for a period from the timing P26 to the timing P9 by the driving control circuit 38. The ground voltage GND applied to the data electrodes 29-1 to 29-n is held for a period from the timing P26 to the timing P9 by the driving control circuit 38.

In a modified example (not shown) of the ninth embodiment, an initializing period 2 in at least one sub-field 5 making up a plurality of the sub-fields 5 during which operations are performed in order by the driving control circuit 38 does not include the priming period 9 and the priming erasing period 10 included in the conventional method (that is, the priming thinning-out is executed).

Next, roles of each period used for the plasma display device of the ninth embodiment are described.

Figure 17:
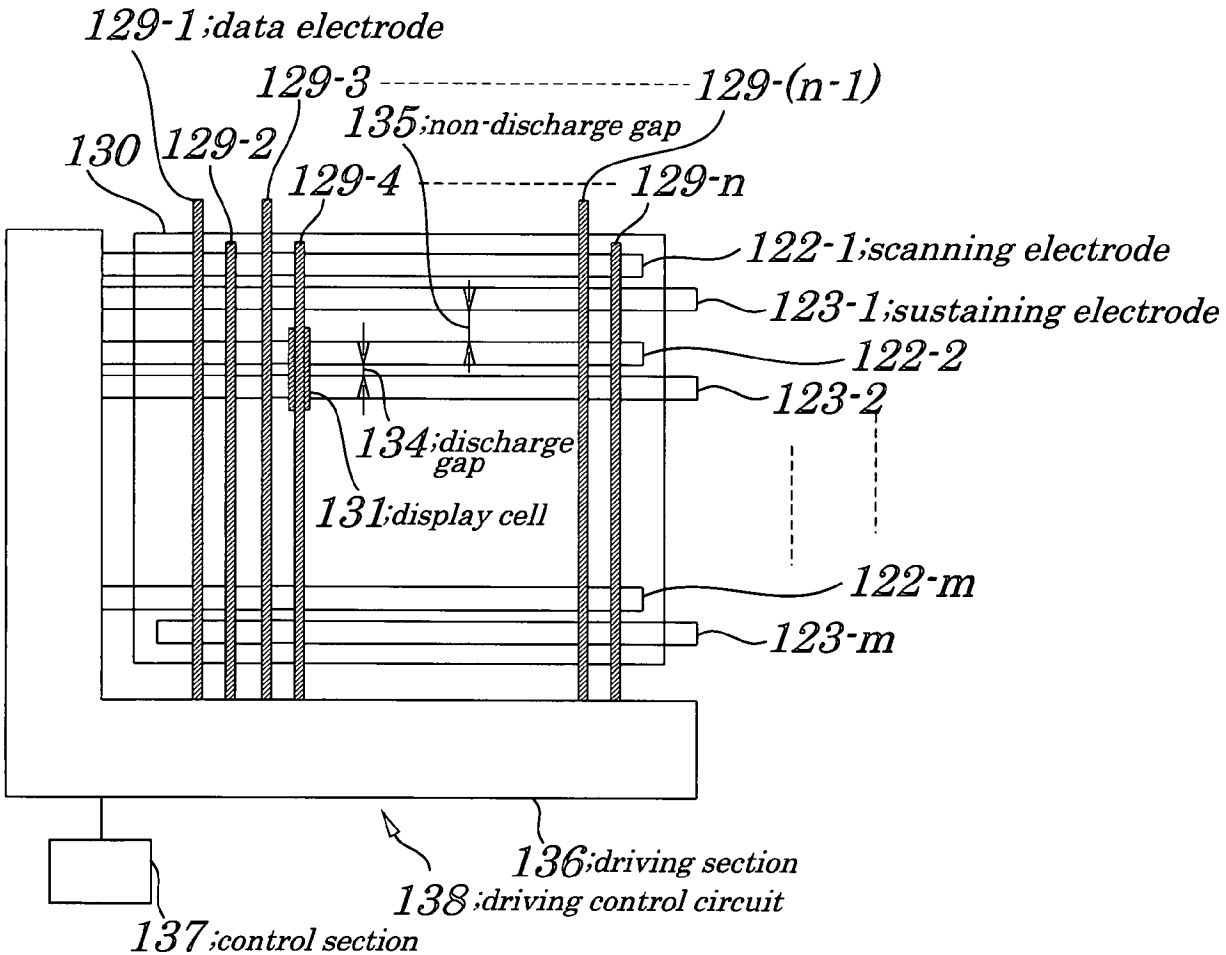
FIG. 17 (PRIOR ART)
FIG. 17 is a diagram showing configurations of a conventional plasma display device (plan view of a conventional three-electrode AC-type PDP)
Figure 18:
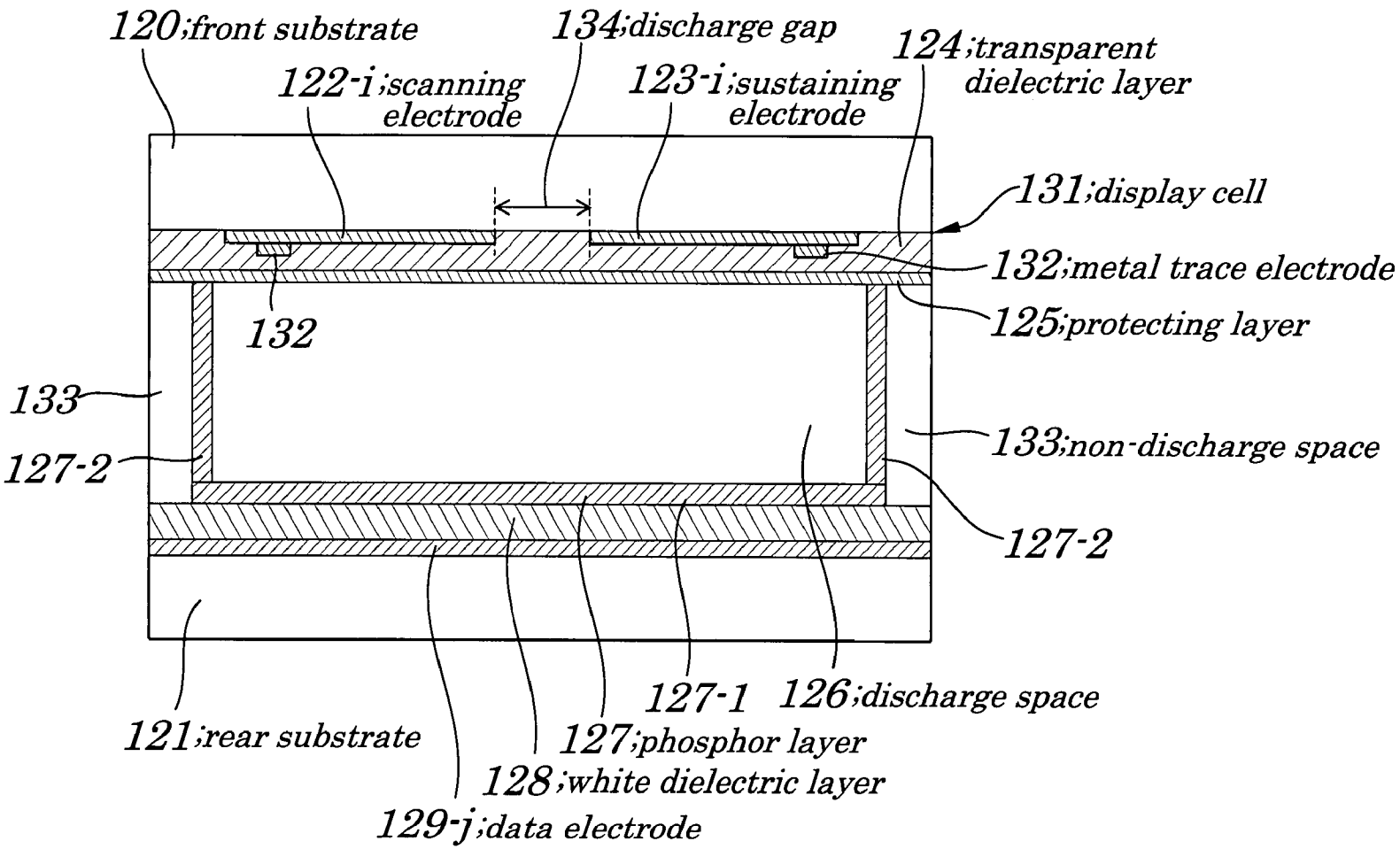
FIG.18(PRIOR ART)
FIG. 18 is a cross-sectional view of one of display cells making up the conventional thee-electrode AC-type PDP.
Figure 19:
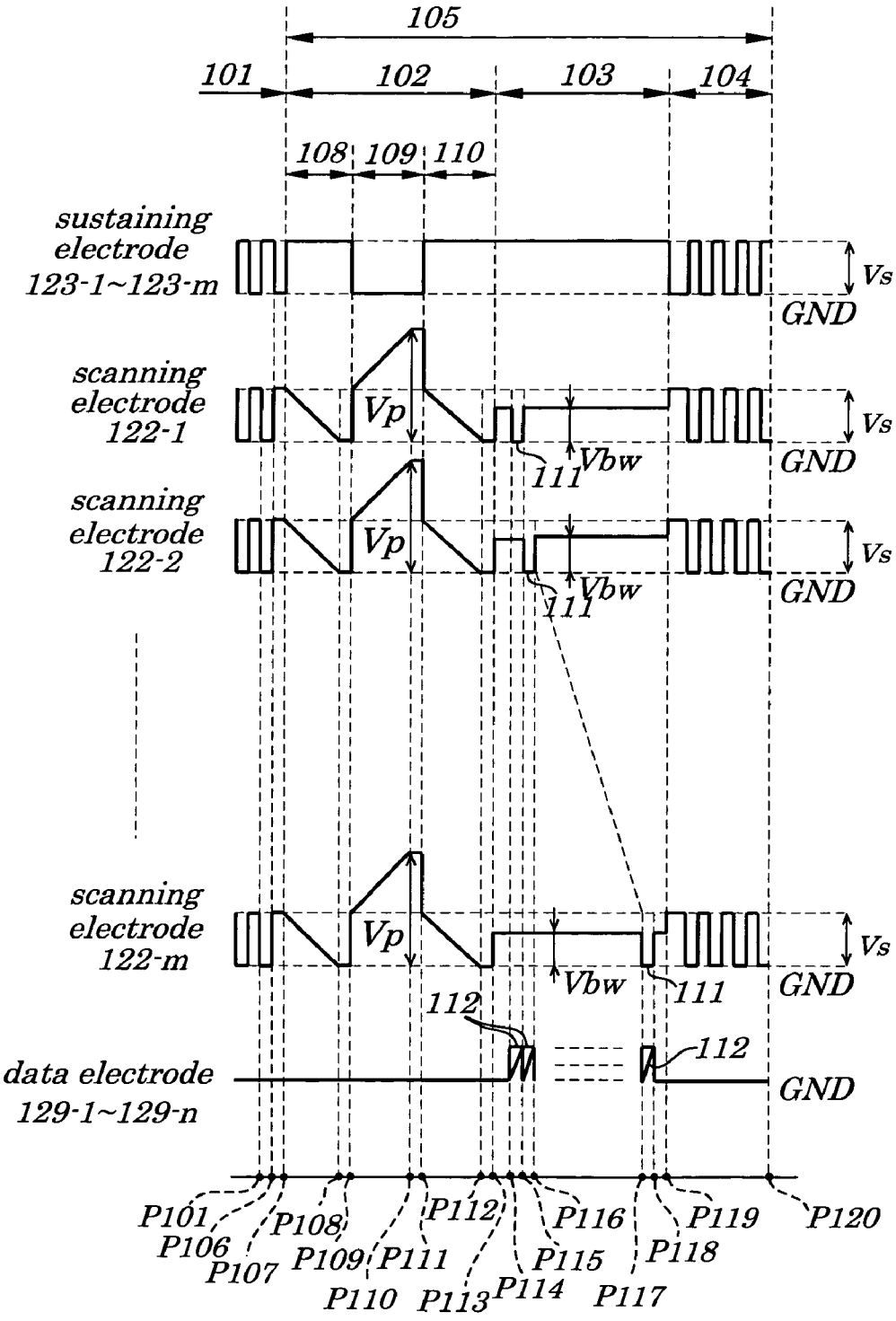
FIG.19 (PRIOR ART)
FIG. 19 is a timing chart showing waveforms of voltages used for driving the conventional plasma display device.
Figure 20A:
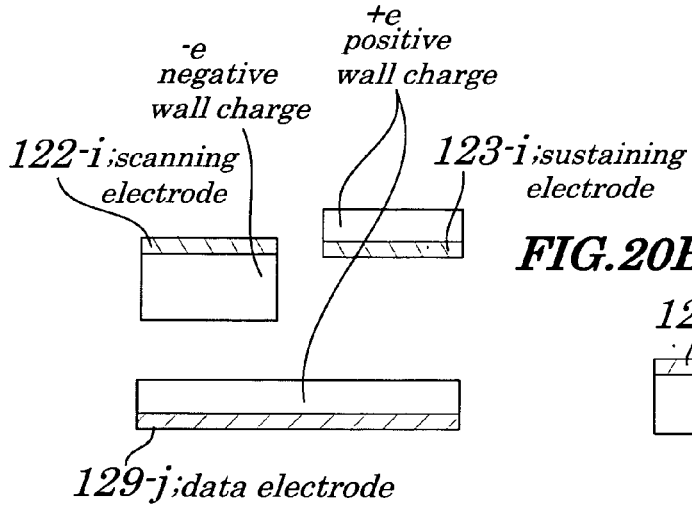
FIG.20A (PRIOR ART)
FIGS. 20A, 20B, 20C, 20D, and 20E are diagrams illustrating arrangements of wall charges appearing at each timing shown in FIG. 19.
Figure 20B:
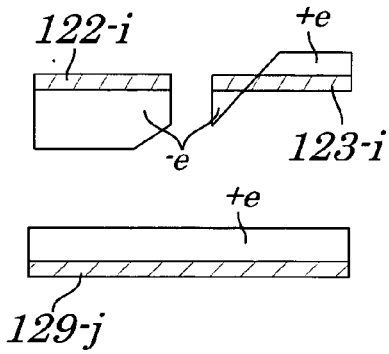
FIG.20B (PRIOR ART)
Figure 20C:
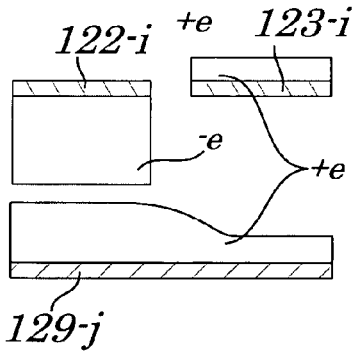
FIG.20C (PRIOR ART)
Figure 20D:
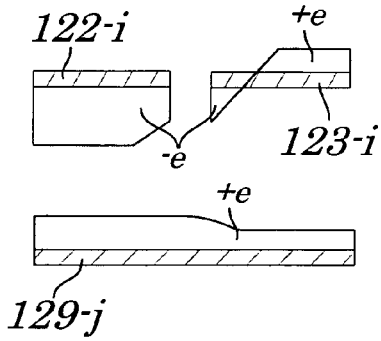
FIG.20D (PRIOR ART)
Figure 20E:
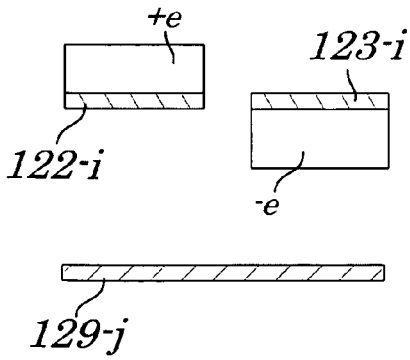
FIG.20E (PRIOR ART)

The roles of the period in the ninth embodiment differ from those in the first embodiment in that, in the ninth embodiment, the sustaining voltage Vs to be applied to the sustaining electrodes 23-1 to 23-m during a sustaining period in the pre-subfield 1 and during the sustaining erasing period 8 in the sub-field 5 is lowered to the voltage Vse only during the wall charge adjusting period 6 between the sustaining period and the sustaining erasing period 8. That is, in the conventional plasma display device, the sustaining pulse potential (final sustaining pulse potential) to be applied at the timing P101 (in FIG. 17) to the sustaining electrode 123-i in the pre-subfield 101 is the ground voltage GND (at this time, the voltage to be applied to the scanning electrode 122-i is the sustaining voltage Vs). However, in the ninth embodiment, during the wall charge adjusting period 6, the voltage Vse being lower than the sustaining voltage Vs is applied as a final sustaining pulse potential to the sustaining electrode 23-i (at this time, the voltage to be applied to the scanning electrode 22-i is the sustaining voltage Vs).

If a voltage to be applied to the sustaining electrode 23-i is a ground voltage as in the case of the conventional plasma display device, surface discharge whose intensity is the same as that of sustaining discharge that had occurred before that occurs between the scanning electrode 22-i and sustaining electrode 23-i. However, in the ninth embodiment, by boosting a voltage to be applied to the sustaining electrode 23-1, a voltage including wall voltage to be applied to the scanning electrode 22-i and sustaining electrode 23-i is lowered from 2 Vs to (2 Vs−Vse). As a result, intensity of surface discharge (wall charge adjusting discharge) is made lower than that of sustaining discharge and negative wall charges (−e) accumulated on the sustaining electrode 23-i is not easily reduced. In the ninth embodiment, since a potential of the data electrode 29-j is of a negative polarity while the potential Vse of the sustaining electrode 23-i is of a positive polarity, negative wall charges (−e) is easily accumulated on the sustaining electrode 23-i. Moreover, since, in the ninth embodiment, during the wall charge adjusting period 6, the potential of the scanning electrode 22-i is "Vs" having a positive polarity while a potential of the data electrode 29-j is of a negative polarity, negative wall charges (−e) is readily accumulated. Therefore, at the timing P26, wall charges accumulated on the sustaining electrode 23-i are put into such a state as shown in FIG. 4C.

In the ninth embodiment, a peak value of a writing current depends greatly upon the voltage Vse. Excessive boosting of the voltage Vse causes intensity of surface discharge (wall charge adjusting discharge) during the wall charge adjusting period 6 to be low and, as a result, many negative wall charges (−e) are left on the sustaining electrode 23-i. Due to this, a peak value of writing current is made small. If the voltage Vse is 80 V or more, discharge during the wall charge adjusting period 6 does not occur any more. Therefore, in the ninth embodiment, the voltage Vse is about 60 V. As a result, a peak value of a writing current can be reduced to about 60% of that in the conventional plasma display device. Thus, it is made possible to cause writing discharge to normally occur even at the data pulse potential 12 being lower by about 5 V than the data pulse potential 112 used in the conventional plasma display device.

It is apparent that the present invention is not limited to the above embodiments but may be changed and modified without departing from the scope and spirit of the invention.

What is claimed is:

1. A method for driving an AC (Alternating Current)-type plasma display panel having two pieces of insulating substrates including a first insulating substrate and a second insulating substrate both being faced each other, on said first insulating substrate of which a plurality of pairs of electrodes is mounted each pair being made up a scanning electrode and a sustaining electrode both being placed in parallel to each other and on said second insulating substrate of which a plurality of data electrodes is mounted each being placed so as to be orthogonal to both said scanning electrode and said sustaining electrode in which each of said scanning electrodes, said sustaining electrodes and said data electrodes is covered with a dielectric layer, said method including:

a step of repeatedly setting periods in order of a scanning period, a sustaining period and an initializing period, during said scanning period of which a potential of each of said data electrodes is changed in a manner to correspond to video data for each of said scanning electrodes and said video data is written according to occurrence or non-occurrence of writing discharge between each of said scanning electrodes and each of said data electrodes, during said sustaining period of which sustaining discharge is repeated by repeatedly applying a sustaining pulse to display an image corresponding to said video data written during said scanning period, and during said initializing period of which a state arisen during said sustaining period is reset and initialized, wherein said initializing period has a wall charge adjusting period during which, when said sustaining discharge occurs immediately before a start of said initializing period, wall charge adjusting discharge whose intensity is lower than that of said sustaining discharge is made to occur between each of said scanning electrodes and each of said sustaining electrodes and a sustaining erasing period during which, after termination of said wall charge adjusting period, a difference in potential between each of said scanning electrodes and each of said sustaining electrodes gradually increases in a direction of a voltage having a polarity opposite to a potential difference between each of said scanning electrodes and each of said sustaining electrodes occurring at time of said wall charge adjusting discharge.

2. The method for driving an AC-type plasma display panel according to claim 1, wherein said wall charge adjusting period has:

a first wall charge adjusting period during which a potential difference between each of said scanning electrodes and each of said sustaining electrodes is gradually increased in a direction of a voltage having a polarity opposite to that of said sustaining pulse having been applied last during said sustaining period, and a second wall charge adjusting period during which a potential difference between each of said scanning electrodes and each of said sustaining electrodes changes more rapidly than during said first wall charge adjusting period and a potential difference between each of said scanning electrodes and each of said sustaining electrodes is increased up to a wall charge adjusting pulse potential being higher, by a wall charge adjusting voltage being lower than a potential difference in said sustaining pulse between each of said scanning electrodes and each of said sustaining electrodes, than a final reaching potential difference between each of said scanning electrodes and each of said sustaining electrodes during said first wall charge adjusting period and said wall charge adjusting pulse voltage is held for a period being equivalent to a wall charge adjusting pulse width.

3. The method for driving an AC-type plasma display panel according to claim 2, wherein a change ratio of a potential difference during said first wall charge adjusting period is 10 [V/μsec] or less.

4. The method for driving an AC-type plasma display panel according to claim 2, wherein a change ratio of a potential difference during said second wall charge adjusting period is 20 [V/μsec] or more.

5. The method for driving an AC-type plasma display panel according to claim 1, wherein a change ratio of a potential difference during said sustaining erasing period is 10 [V/μsec] or less.

6. The method for driving an AC-type plasma display panel according to claim 2, wherein said sustaining pulse is applied repeatedly and alternately at a first potential and at a second potential being lower than said first potential to each of said scanning electrodes and each of said sustaining electrodes and wherein, during said first wall charge adjusting period, a potential of each of said scanning electrodes is made to be at said first potential and a potential of each of said sustaining electrodes is gradually changed from said first potential to a third potential being an intermediate potential between said first potential and said second potential and wherein, during said second wall charge adjusting period, said potential of each of said sustaining electrodes is changed from said third potential to said second potential, said second wall charge adjusting period following said first wall charge adjusting period.

7. The method for driving an AC-type plasma display panel according to claim 2, wherein said sustaining pulse is applied repeatedly and alternately at a first potential and at a second potential being lower than said first potential to each of said scanning electrodes and each of said sustaining electrodes and wherein, during said first wall charge adjusting period, a potential of each of said scanning electrodes is made to be at a fourth potential being an intermediate potential between said first potential and said second potential and said potential of each of said sustaining electrodes is gradually changed from said first potential to said second potential and wherein, during said second wall charge adjusting period, said potential of each of said scanning electrodes is changed from said fourth potential to said first potential.

8. The method for driving an AC-type plasma display panel according to claim 2, wherein said sustaining pulse is applied repeatedly and alternately at a first potential and at a second potential being lower than said first potential to each of said scanning electrodes and each of said sustaining electrodes and wherein, during said first wall charge adjusting period, said potential of each of said scanning electrodes is made to be at a fifth potential and said potential of each of said sustaining electrodes is gradually changed from said first potential to a third potential being an intermediate potential between said first potential and said second potential and wherein, during said second wall charge adjusting period, said potential of each of said scanning electrodes is held at said fifth potential and said potential of each of said sustaining electrodes is changed from said third potential to said second potential and said fifth potential, when no sustaining discharge has occurred during said sustaining period immediately before said initializing period, is a potential at which no discharge occurs between each of said scanning electrodes and each of said sustaining electrodes during said second wall charge adjusting period and being higher than said first potential.

9. The method for driving an AC-type plasma display panel according to claim 2, wherein said sustaining pulse is applied repeatedly and alternately at a first potential and at a second potential being lower than said first potential to each of said scanning electrodes and each of said sustaining electrodes and wherein, during said first wall charge adjusting period, said potential of each of said scanning electrodes is made to be at said first potential and said potential of each of said sustaining electrodes is gradually changed from said first potential to said second potential and wherein, during said second wall charge adjusting period, said potential of each of said scanning electrodes is changed from said first potential to a sixth potential and said sixth potential, when no sustaining discharge has occurred during said sustaining period immediately before said initializing period, is a potential at which no discharge occurs between each of said scanning electrodes and each of said sustaining electrodes and being higher than said first potential.

10. The method for driving an AC-type plasma display panel according to claim 5, wherein, after termination of said second wall charge adjusting period, immediately after said wall charge adjusting pulse voltage has been held for a period being equivalent to said wall charge adjusting pulse width, said potential of each of said sustaining electrodes is boosted to said first potential.

11. The method for driving an AC-type plasma display panel according to claim 5, wherein, after termination of said second wall charge adjusting period, immediately after said wall charge adjusting pulse voltage has been held for a period being equivalent to said wall charge adjusting pulse width, said potential of each of said sustaining electrodes is boosted to a seventh potential being equal to said sustaining potential occurring during said scanning period.

12. The method for driving an AC-type plasma display panel according to claim 10, wherein said wall charge adjusting pulse width is less than 2 [μsec].

13. The method for driving an AC-type plasma display panel according to claim 2, wherein, during said wall charge adjusting period, after termination of said second wall charge adjusting period, an auxiliary sustaining erasing period is provided during which, while said potential of each of said scanning electrodes is held at said first potential, a potential of each of said sustaining electrode is gradually lowered to said second potential.

14. The method for driving an AC-type plasma display panel according to claim 1, wherein, during said wall charge adjusting period, a wall charge adjusting pulse voltage having a polarity opposite to that of said sustaining pulse applied last during said sustaining period and being smaller than a potential difference of said sustaining pulse between each of said scanning electrodes and each of said sustaining electrodes is applied between each of said scanning electrodes and each of said sustaining electrodes.

15. The method for driving an AC-type plasma display panel according to claim 14, wherein said sustaining pulse is applied repeatedly and alternately at a first potential and at a second potential being lower than said first potential to each of said scanning electrodes and each of said sustaining electrodes and wherein, during said wall charge adjusting period, said potential of each of said scanning electrodes is made to be at said first potential and said potential of each of said sustaining electrodes is made to be at an eighth potential being an intermediate potential between said first potential and said second potential.

16. The method for driving an AC-type plasma display panel according to claim 2, wherein, during said sustaining erasing period, while a potential of each of said sustaining electrodes is held at a specified level, a potential of each of said scanning electrodes is gradually lowered from said first potential to said second potential.

17. The method for driving an AC-type plasma display panel according to claim 16, wherein a potential of each of said sustaining electrodes during said sustaining erasing period is said first potential or said seventh potential.

18. The method for driving an AC-type plasma display panel according to claim 1, wherein a priming period is provided between said wall charge adjusting period and said sustaining erasing period, during which a potential having a priming waveform is applied to each of said scanning electrodes to boost said potential of each of said scanning electrodes to a potential being higher than said first potential, and while said potential having said priming waveform is being applied, a potential of each of said data electrodes is made equal to a data electrode potential at which no writing discharge occurs during said scanning period.

19. The method for driving an AC-type plasma display panel according to claim 1, wherein a priming period is provided after said sustaining erasing period, during which a voltage having a priming waveform to boost said potential of each of said scanning electrodes to a potential being higher than said first potential and, while said voltage having said priming waveform is being applied, a potential of each of said data electrodes is made equal to a data electrode potential at which no writing discharge occurs during said scanning period and a priming erasing period is provided after said priming period, during which, while a potential of each of said sustaining electrodes is being held at a specified level, a potential of each of said scanning electrodes is gradually lowered from said first potential.

20. The method for driving an AC-type plasma display panel according to claim 19, wherein a final reaching potential of each of said scanning electrodes during said priming erasing period is equal to a ninth potential to be applied to each of said scanning electrodes when said writing discharge is made to occur during said scanning period.

21. The method for driving an AC-type plasma display panel according to claim 19, wherein a final reaching potential of each of said scanning electrodes during said priming erasing period is higher than said ninth potential to be applied to each of said scanning electrodes when said writing discharge is made to occur during said scanning period and a potential difference between said final reaching potential and said ninth potential is 20 V or less.

22. The method for driving an AC-type plasma display panel according to claim 20, wherein said ninth potential is a ground voltage.

23. The method for driving an AC-type plasma display panel according to claim 19, wherein a potential of each of said sustaining electrodes during said priming period is equal to said first potential or said seventh potential.

24. The method for driving an AC-type plasma display panel according to claim 19, wherein pulse waveforms of a voltage to be applied to each of said scanning electrodes, each of said sustaining electrodes, and each of said data electrodes during said sustaining erasing period are same as those of a voltage to be applied to each of said scanning electrodes, each of said sustaining electrodes, and each of said data electrodes during said priming erasing period.

25. The method for driving an AC-type plasma display panel according to claim 19, wherein said potential of each of said sustaining electrodes during said priming period is equal to said second potential.

26. The method for driving an AC-type plasma display panel according to claim 2, wherein said first potential is a positive potential and said second potential is a ground potential.

27. The method for driving an AC-type plasma display panel according to claim 18, wherein at least one said initializing period, out of a plurality of said initializing periods, exist during which said potential having said priming waveform during said priming period is not applied at least one time based on a regular cycle.

28. The method for driving an AC-type plasma display panel according to claim 19, wherein at least one said initializing period, out of a plurality of said initializing periods, exists during which both said potential having said priming waveform during said priming period and a potential having said priming erasing waveform during said priming erasing period is not applied at least one time based on a regular cycle.

29. The method for driving an AC-type plasma display panel according to claim 27, wherein a potential to be applied to each of said scanning electrodes when said writing discharge is made to occur is a negative potential.

30. A plasma display device comprising:

scanning electrodes and sustaining electrodes formed in a manner that each of said scanning electrodes and each of said sustaining electrodes are placed in parallel to each other;

data electrodes formed so as to face said scanning electrodes and said sustaining electrodes and placed in a manner to be orthogonal to said scanning electrodes and said sustaining electrodes; and a driving section to drive said scanning electrodes, said sustaining electrodes, and said data electrodes and a control section;

wherein a sub-field includes an initializing period, a scanning period during which video data to display a video is written in a cell by writing discharge made to occur between each of said scanning electrodes and each of said data electrodes, and a sustaining period during which sustaining discharge is made to occur between each of said scanning electrodes and each of said sustaining electrodes, which causes said cell in which said writing discharge has occurred to emit light in a manner to correspond to said video data;

wherein said initializing period includes a wall charge adjusting period during which wall charge adjusting discharge is made to occur to adjust charges accumulated between each of said scanning electrodes and each of said sustaining electrodes when said sustaining discharge was made to occur and an erasing period; and wherein, during said wall charge adjusting period, said control section drives said driving section so that said wall charge adjusting discharge whose intensity is lower than that of said sustaining discharge occurs between each of said scanning electrodes and each of said sustaining electrodes and so that, during said erasing period after termination of said wall charge adjusting period, an erasing potential, which is gradually boosted to an erasing period difference of a potential having a polarity opposite to that of a wall charge adjusting period difference of a potential occurring when said wall charge adjusting discharge occurs between each of said scanning electrodes and each of said sustaining electrodes, is applied between each of said scanning electrodes and each of said sustaining electrodes.

31. The plasma display device according to claim 30, wherein said wall charge adjusting period includes a first wall charge adjusting period and a second wall charge adjusting period and wherein said control section drives said driving section so that, during said sustaining period, a sustaining pulse potential is applied alternately to each of said scanning electrodes and each of said sustaining electrodes and so that, during said first wall charge adjusting period, an adjusting potential, which is gradually boosted to a first wall charge adjusting period difference of a potential having a polarity opposite to that of a sustaining period difference of a potential occurring when said sustaining pulse potential was applied between each of said scanning electrodes and each of said sustaining electrodes last during said sustaining period, is applied between each of said scanning electrodes and each of said sustaining electrodes and so that, during said second wall charge adjusting period, a wall charge adjusting pulse potential, which rapidly changes to be a second wall charge adjusting period potential difference being larger than said first wall charge adjusting period potential difference, is applied between each of said scanning electrodes and each of said sustaining electrodes and said wall charge adjusting pulse potential is held for a period being equivalent to a wall charge adjusting pulse width, and wherein said wall charge adjusting pulse width is time during which said wall charge adjusting pulse potential is being applied between each of said scanning electrodes and each of said sustaining electrodes.

32. The plasma display device according to claim 31, wherein said control section drives said driving section so that, during said sustaining period, a first potential and a second potential being lower than said first potential are alternately applied to each of said scanning electrodes as said sustaining pulse potential and said second potential and said first potential are alternately applied to each of said sustaining electrodes as said sustaining pulse potential and so that, during said first wall charge adjusting period, said first potential is applied to each of said scanning electrodes as said adjusting potential and a potential to be applied to each of said sustaining electrodes is gradually lowered from said first potential to a third potential being an intermediate potential between said first potential and said second potential and so that, during said second wall charge adjusting period, a potential to be applied to each of said scanning electrodes is set and held to be said first potential as said wall charge adjusting pulse potential for a period being equivalent to said wall charge adjusting pulse width and a potential to be applied to each of said sustaining electrodes is lowered from said third potential to said second potential, and thus set and held to be said second potential for a period being equivalent to said wall charge adjusting pulse width.

33. The plasma display device according to claim 31, wherein said control section drives said driving section so that, during said sustaining period, a first potential and a second potential being lower than said first potential are alternately applied to each of said scanning electrodes as said sustaining pulse potential and said second potential and said first potential are alternately applied to each of said sustaining electrodes as said sustaining pulse potential and so that, during said first wall charge adjusting period, a potential to be applied, as said adjusting potential, to each of said sustaining electrodes is gradually lowered from said first potential to a third potential being an intermediate potential between said first potential and said second potential and a fourth potential being higher than said first potential is applied to each of said scanning electrodes and so that, during said second wall charge adjusting period, a potential to be applied, as said wall charge adjusting pulse potential, to each of said scanning electrodes is held to be at said fourth potential for a period being equivalent to said wall charge adjusting pulse width and a potential to be applied to each of said sustaining electrodes is lowered from said third potential to said second potential and is held to be at said second potential for a period being equivalent to said wall charge adjusting pulse width and wherein said fourth potential is a potential at which said wall charge adjusting discharge does not occur between each of said scanning electrodes and each of said sustaining electrodes during said second wall charge adjusting period when said sustaining discharge does not occur during said sustaining period.

34. The plasma display device according to claim 31, wherein said control section drives said driving section so that, during said sustaining period, a first potential and a second potential being lower than said first potential are alternately applied to each of said scanning electrodes as said sustaining pulse potential and said second potential and said first potential are alternately applied to each of said sustaining electrodes as said sustaining pulse potential and so that, during said first wall charge adjusting period, a fifth potential being an intermediate potential between said first potential and said second potential is applied as said adjusting potential to each of said scanning electrodes and a potential to be applied to each of said sustaining electrodes is gradually lowered from said first potential to said second potential and so that, during said second wall charge adjusting period, a potential to be applied as said wall charge adjusting pulse potential to each of said sustaining electrodes is held to be at said second potential for a period being equivalent to said wall charge adjusting pulse width and a potential to be applied to each of said scanning electrodes is boosted from said fifth potential to said first potential and is held at said first potential for a period being equivalent to said wall charge adjusting pulse width.

35. The plasma display device according to claim 31, wherein said control section drives said driving section so that, during said sustaining period, a first potential and a second potential being lower than said first potential are alternately applied to each of said scanning electrodes as said sustaining pulse potential and said second potential and said first potential are alternately applied to each of said sustaining electrodes as said sustaining pulse potential and so that, during said first wall charge adjusting period, said first potential is applied as said adjusting potential to each of said scanning electrodes and a potential to be applied to each of said sustaining electrodes is gradually lowered from said first potential to said second potential and so that, during said second wall charge adjusting period, a potential to be applied, as said wall charge adjusting pulse potential, to each of said sustaining electrodes is held to be at said second potential for a period being equivalent to said wall charge adjusting pulse width and a potential to be applied to each of said scanning electrodes is boosted from said first potential to a sixth potential being higher than said first potential and is held to be at said sixth potential for a period being equivalent to said wall charge adjusting pulse width and wherein said sixth potential is a potential at which said wall charge adjusting discharge does not occur between each of said scanning electrodes and each of said sustaining electrodes during said second wall charge adjusting period when said sustaining discharge does not occur during said sustaining period.

36. The plasma display device according to claim 32, wherein a change ratio, which indicates an average rate of change that occurs, during said first wall charge adjusting period, from time at which said first potential begins to lower to time at which it lowers fully to said third potential, is set to be 10 [V/$\mu$sec] or less.

37. The plasma display device according to claim 32, wherein a change ratio, which indicates an average rate of change that occurs, during said second wall charge adjusting period, from time at which said third potential begins to lower to time at which it lowers fully to said second potential, is set to be 20 [V/$\mu$sec] or more.

38. The plasma display device according to claim 34, wherein a change ratio, which indicates an average rate of change that occurs, during said first wall charge adjusting period, from time at which said first potential begins to lower to time at which it lowers fully to said second potential, is set to be 10 [V/μsec] or less.

39. The plasma display device according to claim 32, wherein said wall charge adjusting pulse width is less than 2 μsec.

40. The plasma display device according to claim 30, wherein said control section drives said driving section so that, during said sustaining period, a sustaining pulse potential is applied alternately to each of said scanning electrodes and each of said sustaining electrodes and so that, during said wall charge adjusting period, said wall charge adjusting period difference of a potential having a polarity opposite to a sustaining period difference of a potential occurring when said sustaining pulse potential is applied between each of said scanning electrodes and each of said sustaining electrodes last during said sustaining period, is applied, as an adjusting potential being smaller than said sustaining pulse potential, to each of said scanning electrodes and each of said sustaining electrodes.

41. The plasma display device according to claim 40, wherein said control section drives said driving section so that, during said sustaining period, a first potential and a second potential being lower than said first potential are alternately applied to each of said scanning electrodes as said sustaining pulse potential and said second potential and said first potential are alternately applied as said sustaining pulse potential to each of said sustaining electrodes and so that, during said wall charge adjusting period, a potential to be applied to each of said scanning electrodes is held to be at said first potential as said adjusting potential and a seventh potential being an intermediate potential between said first potential and said second potential is applied to each of said sustaining electrodes.

42. The plasma display device according to claim 32, wherein said erasing period includes a sustaining erasing period, wherein said control section drives said driving section so that, during said sustaining erasing period, an eighth potential is applied to each of said sustaining electrodes and a potential to be applied to each of said scanning electrodes is gradually lowered from said first potential to said second potential, and wherein said eighth potential is a potential to be applied to each of said sustaining electrodes during said scanning period.

43. The plasma display device according to claim 33, wherein said erasing period includes a sustaining erasing period, wherein said control section drives said driving section so that, during said sustaining erasing period, an eighth potential is applied to each of said sustaining electrodes and a potential to be applied to each of said scanning electrodes is gradually lowered from said fourth potential to said second potential, and wherein said eighth potential is a potential to be applied to each of said sustaining electrodes during said scanning period.

44. The plasma display device according to claim 35, wherein said erasing period includes a sustaining erasing period, wherein said control section drives said driving section so that, during said sustaining erasing period, an eighth potential is applied to each of said sustaining electrodes and a potential to be applied to each of said scanning electrodes is gradually lowered from said sixth potential to said second potential, and wherein said eighth potential is a potential to be applied to each of said sustaining electrodes during said scanning period.

45. The plasma display device according to claim 32, wherein said initializing period includes an auxiliary sustaining erasing period and said erasing period includes a sustaining erasing period, wherein said control section drives said driving section so that, during said auxiliary sustaining erasing period, a potential to be applied to each of said scanning electrodes is held to be at said first potential and an eighth potential is applied to each of said sustaining electrodes and a potential to be applied to each of said sustaining electrodes is gradually lowered from said eighth potential to said second potential and so that, during said sustaining erasing period, an eighth potential is applied to each of said sustaining electrodes and a potential to be applied to each of said scanning electrodes is gradually lowered from said first potential to said second potential and wherein said eighth potential is a potential to be applied to each of said sustaining electrodes during said scanning period.

46. The plasma display device according to claim 32, wherein said initializing period includes an auxiliary sustaining erasing period and wherein said control section drives said driving section so that, during said auxiliary sustaining erasing period, a potential to be applied to each of said scanning electrodes is held to be at said first potential and an eighth potential is applied to each of said sustaining electrodes and a potential to be applied to each of said sustaining electrodes is gradually lowered from said eighth potential to said second potential, and wherein said eighth potential is a potential to be applied to each of said sustaining electrodes during said scanning period.

47. The plasma display device according to claim 41, wherein said erasing period includes a sustaining erasing period and wherein said control section drives said driving section so that, during said sustaining erasing period, a potential to be applied to each of said sustaining electrodes is boosted from said seventh potential to an eighth potential being higher than said seventh potential and a potential to be applied to each of said scanning electrodes is gradually lowered from said first potential to said second potential, and wherein said eighth potential is a potential to be applied to each of said sustaining electrodes during said scanning period.

48. The plasma display device according to claim 32, wherein said erasing period includes a sustaining erasing period and wherein said control section drives said driving section so that, during said sustaining erasing period, an eighth potential is applied to each of said sustaining electrodes and a potential to be applied to each of said scanning electrodes is gradually lowered from said first potential to a ninth potential being lower than said second potential, and wherein said eighth potential is a potential to be applied to each of said sustaining electrodes during said scanning period.

49. The plasma display device according to claim 42, wherein a change ratio, which indicates an average rate of change that occurs, during said sustaining erasing period, from time at which said first potential begins to lower to time at which it lowers fully to said second potential, is set to be 10 [V/μsec] or less.

50. The plasma display device according to claim 43, wherein a change ratio, which indicates an average rate of change that occurs, during said sustaining erasing period, from time at which said fourth potential begins to lower to time at which it lowers fully to said second potential, is set to be 10 [V/μsec] or less.

51. The plasma display device according to claim 44, wherein a change ratio, which indicates an average rate of change that occurs, during said sustaining erasing period, from time at which said sixth potential begins to lower to time at which it lowers fully to said second potential, is set to be 10 [V/μsec] or less.

52. The plasma display device according to claim 48, wherein a change ratio, which indicates an average rate of change that occurs, during said sustaining erasing period, from time at which said first potential begins to lower to time at which it lowers fully to said ninth potential, is set to be 10 [V/μsec] or less.

53. The plasma display device according to claim 45, wherein a change ratio, which indicates an average rate of change that occurs, during said auxiliary sustaining erasing period, from time at which said eighth potential begins to lower to time at which it lowers fully to said second potential, is set to be 10 [V/μsec] or less.

54. The plasma display device according to claim 42, wherein said initializing period includes a priming period and said erasing period includes a priming erasing period and wherein said control section drives said driving section so that, during said priming period, said second potential is applied to each of said sustaining electrodes and said first potential is applied to each of said scanning electrodes and a potential to be applied to each of said scanning electrodes is gradually boosted from said first potential to a tenth potential being higher than said first potential and so that, during said priming erasing period following said priming period, said eighth potential is applied to each of said sustaining electrodes and a potential to be applied to each of said scanning electrodes, after having been lowered from said tenth potential to said first potential, is gradually lowered from said first potential to said second potential.

55. The plasma display device according to claim 48, wherein said initializing period includes a priming period and said erasing period includes a priming erasing period and wherein said control section drives said driving section so that, during said priming period, said second potential is applied to each of said sustaining electrodes and said first potential is applied to each of said scanning electrodes and a potential to be applied to each of said scanning electrodes is gradually boosted from said first potential to a tenth potential being higher than said first potential and so that, during said priming erasing period following said priming period, said eighth potential is applied to each of said sustaining electrodes and a potential to be applied to each of said scanning electrodes, after having been lowered from said tenth potential to said first potential, is gradually lowered from said first potential to said ninth potential.

56. The plasma display device according to claim 42, wherein said control section drives said driving section so that, during said scanning period, said eighth potential is applied to each of said sustaining electrodes and, after a set potential being higher than said second potential has been applied to each of said scanning electrodes, when a scanning pulse potential that lowers from said set potential to said second potential is applied to each of said scanning electrodes, a data pulse potential corresponding to said video data is applied to each of said data electrodes.

57. The plasma display device according to claim 48, wherein said control section drives said driving section so that, during said scanning period, said eighth potential is applied to each of said sustaining electrodes and, after a set potential being higher than said ninth potential has been applied to each of said scanning electrodes, when a scanning pulse potential that lowers from said set potential to said ninth potential is applied to each of said scanning electrodes, a data pulse potential corresponding to said video data is applied to each of said data electrodes.

58. The plasma display device according to claim 57, wherein a final reaching potential being said ninth potential to be applied to each of said scanning electrodes during said priming erasing period is higher than a scanning pulse potential occurring when lowering from said set potential to said ninth potential as said scanning pulse potential to be applied to each of said scanning electrodes during said scanning period and a potential difference between said final reaching potential and said scanning pulse potential is 20 V or less.

59. The plasma display device according to claim 54, wherein said control section drives said driving section so that a field is operated periodically and said field is made up of a plurality of said sub-fields and each of said plurality of said sub-fields is operated sequentially and wherein said initializing period in at least one sub-field out of said plurality of said sub-fields does not include said priming period and said priming erasing period.

60. The plasma display device according to claim 42, wherein said eighth potential is said first potential.

61. The plasma display device according to claim 32, wherein said second potential is a ground potential.

62. The plasma display device according to claim 33, wherein a change ratio, which indicates an average rate of change that occurs, during said first wall charge adjusting period, from time at which said first potential begins to lower to time at which it lowers fully to said third potential, is set to be 10 [V/μsec] or less.

63. The plasma display device according to claim 33, wherein a change ratio, which indicates an average rate of change that occurs, during said second wall charge adjusting period, from time at which said third potential begins to lower to time at which it lowers fully to said second potential, is set to be 20 [V/μsec] or more.

64. The plasma display device according to claim 35, wherein a change ratio, which indicates an average rate of change that occurs, during said first wall charge adjusting period, from time at which said first potential begins to lower to time at which it lowers fully to said second potential, is set to be 10 [V/μsec] or less.

65. The plasma display device according to claim 33, wherein said wall charge adjusting pulse width is less than 2 μsec.

66. The plasma display device according to claim 34, wherein said wall charge adjusting pulse width is less than 2 μsec.

67. The plasma display device according to claim 35, wherein said wall charge adjusting pulse width is less than 2 μsec.

68. The plasma display device according to claim 34, wherein said erasing period includes a sustaining erasing period, wherein said control section drives said driving section so that, during said sustaining erasing period, an eighth potential is applied to each of said sustaining electrodes and a potential to be applied to each of said scanning electrodes is gradually lowered from said first potential to said second potential, and wherein said eighth potential is a potential to be applied to each of said sustaining electrodes during said scanning period.

* * * * *